US007386139B2

(12) United States Patent
Hashimoto et al.

(10) Patent No.: US 7,386,139 B2
(45) Date of Patent: Jun. 10, 2008

(54) SOUND IMAGE CONTROL SYSTEM

(75) Inventors: Hiroyuki Hashimoto, Ibaraki (JP); Kenichi Terai, Shijonawate (JP); Isao Kakuhari, Ikoma (JP); Takahisa Hachuda, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 653 days.

(21) Appl. No.: 10/454,541

(22) Filed: Jun. 5, 2003

(65) Prior Publication Data

US 2004/0032955 A1 Feb. 19, 2004

(30) Foreign Application Priority Data

Jun. 7, 2002 (JP) ..... 2002-167197

(51) Int. Cl.
*H04R 5/02* (2006.01)

(52) U.S. Cl. ..... 381/310; 381/17; 381/86

(58) Field of Classification Search ..... 381/86, 381/17, 18, 307, 309, 310
See application file for complete search history.

(56) References Cited

U.S. PATENT DOCUMENTS 5,333,200 A * 7/1994 Cooper et al. ..... 381/1
5,862,227 A 1/1999 Orduna-Bustamante et al.
6,038,324 A * 3/2000 Ambourn ..... 381/18
6,574,339 B1 * 6/2003 Kim et al. ..... 381/17
7,039,116 B1 * 5/2006 Zhang et al. ..... 375/240.26

FOREIGN PATENT DOCUMENTS

JP 10-276500 10/1998

OTHER PUBLICATIONS

Stephen J. Elliott et al., "A Multiple Error LMS Algorithm and Its Application to the Active Control of Sound and Vibration", IEEE Transactions on Acoustics, Speech, and Signal Processing, vol. ASSP-35, No. 10, pp. 1423-1434, Oct. 10, 1987.
Masato Miyoshi et al., "Inverse Filtering of Room Acoustics", IEEE Transactions on Acoustics, Speech, and Signal Processing, vol. 36, No. 2, pp. 145-152, Feb. 2, 1988.

* cited by examiner

*Primary Examiner*—Vivian Chin
*Assistant Examiner*—Con P Tran
(74) *Attorney, Agent, or Firm*—Wenderoth, Lind & Ponack, L.L.P.

(57) ABSTRACT

A sound image control system which is able to concurrently perform sound image localization control for two persons is provided. The sound image control system controls a sound image localization position by reproducing an audio signal from a plurality of loudspeakers. The sound image control system includes at least four loudspeakers for reproducing the audio signal and a signal processing section. The signal processing section sets four points corresponding to both ears of two listeners as control points, and performs signal processing for the audio signal input into the plurality of loudspeakers so that two target sound source positions indicating sound image localization positions of the respective two listeners are set in the same direction with respect to the two listeners. The two target sound source positions are set so as to satisfy the following condition, $T1=T2 \leqq T3<T4$.

7 Claims, 47 Drawing Sheets

SOUND IMAGE CONTROL SYSTEM

BACKGROUND OF THE INVENTION

1. Field of the Invention

The present invention relates to a sound image control system, and more particularly, to a sound image control system controlling a sound image localization position by reproducing an audio signal from a plurality of loudspeakers.

2. Description of the Background Art

In recent years, a multichannel signal reproduction system typified by a DVD has become prevalent. However, housing conditions often do not allow for the installation of five or six loudspeakers. Therefore, a sound image control system using a so-called virtual reproduction method, which realizes virtual reproduction of a surround signal with Lch and Rch loudspeakers, has been developed.

Also, especially in a sound image control system for car audio equipment, the placement of loudspeakers in a narrow inside space of a vehicle is limited due to considerable influences of reflection, reverberation, and standing waves. In such an arrow space as the inside of a vehicle, it is conventionally rather difficult to freely localize a sound image. However, there is still a strong demand to localize vocals, etc., included in music in the front center of a passenger. In order to satisfy the above-described demand, a sound image control system as described below is in the process of being developed.

Hereinafter, with reference to a drawing, the conventional sound image control system is described. FIG. 47 is an illustration showing the structure of the conventional sound image control system. In FIG. 47, the sound image control system installed in a vehicle 601 includes a sound source 61, a signal processing section 62, an FR loudspeaker 621 placed on the right front door of the vehicle 601, and an FL loudspeaker 622 placed on the left front door of the vehicle 601. The signal processing section 62 has control filters 63 and 64.

An operation of the sound image control system shown in FIG. 47 is described below. A signal from the sound source 61 is processed in the signal processing section 62, and reproduced from the FR loudspeaker 621 and the FL loudspeaker 622. The control filter 63 controls an Rch signal from the sound source 61, and the control filter 64 controls an Lch signal from the sound source 61. The signal processing section 62 performs signal processing so that sound from the FR loudspeaker 621 is localized in a position of a target sound source 631 and sound from the FL loudspeaker 622 is localized in a position of a target sound source 632. Specifically, the control filters 63 and 64 of the signal processing section 62 are controlled as follows. That is, assume that a center position (a small cross shown in FIG. 47) of a listener A is a control point, a transmission characteristic from the FR loudspeaker 62 to the control point is FR, a transmission characteristic from the FL loudspeaker 622 to the control point is FL, a transmission characteristic from the target sound source 631 to the control point is G1, and a transmission characteristic from the target sound source 632 to the control point is G2, characteristics HR and HL of the respective control filters 63 and 64 in the signal processing section 62 are represented by the following expressions.

$$HR=G1/FR$$

$$HL=G2/FL$$

The characteristics (HR and HL) satisfying the above-described expressions allow the FR loudspeaker 621 to be controlled so as to reproduce sound in the position of the target sound source 631, and the loudspeaker 622 to be controlled so as to reproduce sound in the position of the target sound source 632. As a result, a center component common to the Lch signal and the Rch signal is localized between the virtual target sound sources 631 and 632. That is, the listener A localizes a sound image in a position of a front target sound source 635.

However, the conventional system shown in FIG. 47 has only one control point. As a result, the difference between the right and left ears, which is the mechanism of perception, is not controlled, thereby having a limited sound image localization effect. Furthermore, most sound image control systems in practical use only correct a time lag between the FR loudspeaker 621 and the FL loudspeaker 622, thereby not actually realizing the virtual target sound sources 631 and 632.

As a sound image control system for home use, on the other hand, a sound image control system performing sound image control by setting both ears as control points has been developed. However, in the above-described sound image control system, the number of control points is assumed to be two, that is, both ears of a single listener are assumed to be the control points. Therefore, the above-described sound image control system does not concurrently perform sound image control for both ears of two listeners.

SUMMARY OF THE INVENTION

Therefore, an object of the present invention is to provide a sound image control system that concurrently performs sound image control for both ears of at least two listeners.

The present invention has the following features to attain the object mentioned above. The present invention is directed to a sound image control system for controlling sound image localization positions by reproducing an audio signal from a plurality of loudspeakers. The sound image control system comprises at least four loudspeakers for reproducing the audio signal. Further, the sound image control system comprises a signal processing section for setting four points corresponding to positions of both ears of first and second listeners as control points, and performing signal processing for the audio signal as input into each of the at least four loudspeakers so as to produce first and second target sound source positions. The first and second target sound source positions are sound image localization positions as perceived by the first and second listeners, respectively, such that the first target sound source position is in a direction relative to the first listener that extends from the first listener toward the second listener and is inclined at a predetermined azimuth angle, and the second target sound source position is in a direction relative to the second listener that extends from the first listener toward the second listener and is inclined at the predetermined azimuth angle. For example, in FIG. 7, "the first target sound source position" and "the second target sound source position" would correspond to positions of a target sound source 32 and a target sound source 31, respectively, and "the first listener" and "the second listener" would correspond to a listener B and a listener A, respectively. In FIG. 7, the direction of the target sound source 32 relative to the listener B is inclined at the same azimuth angle as the direction of the target sound source 31 relative to the listener A, i.e., the two directions are parallel (as will be further described in the DETAILED DESCRIPTION OF THE PREFERRED EMBODIMENTS section below). The first and second target sound source positions are controlled so that a distance from the second listener to the second target sound source position is shorter than a distance from the first listener to the first target sound source position.

According to the present invention, it is possible to set a target sound source position which can be realized, thereby allowing the four points corresponding to the positions of both ears of the two listeners to be set as control points. That is, it is possible to allow the two listeners to localize a sound image in similar manners and hear sound of the same sound quality.

In the above-described sound image control system, when the two target sound source positions are assumed to be set at an angle of θ degrees with respect to a forward direction of the respective listeners, a distance between the first and second listeners is assumed to be X, a velocity is assumed to be P, and transmission time from the first and second target sound source positions to control points of their corresponding listeners are assumed to be T1, T2, T3, and T4 in order of increasing distance from the respective target sound source positions, the two target sound source positions may be set so as to satisfy a following condition, $T1<T2\leqq T3\ (=T2+X\sin\theta/P)<T4$.

Also, the signal processing section may stop inputting the audio signal into a loudspeaker, among the plurality of loudspeakers, placed in a position diagonally opposite to the first and second target sound source positions with respect to a center position between the first and second listeners. Specifically, in the case (see FIG. 16) where the target sound source positions are set in the forward-right with respect to the above-described center position, the loudspeaker placed in a position diagonally opposite to the first and second target sound source positions with respect to a center position between the first and second listeners is a loudspeaker placed in the backward-left direction with respect to the above-described center position. On the other hand, in the case (see FIG. 18) where the target sound source positions are set in the backward-left direction with respect to the above-described center position, the loudspeaker placed in a position diagonally opposite to the first and second target sound source positions with respect to the above-described center position is a loudspeaker placed in the forward-right direction with respect to the above-described center position.

As a result, it is possible to reduce the number of loudspeakers required in the sound image control system. Also, the number of signals to be subjected to signal processing is reduced, whereby it is possible to reduce the amount of calculation performed in the signal processing.

Still further, when the two target sound source positions are set in front of the respective listeners, the signal processing section may stop inputting the audio signal into a loudspeaker, among the plurality of loudspeakers, placed in a rear position of the respective listeners. Also in this case, it is possible to reduce the number of loudspeakers required in the sound image control system.

Furthermore, the signal processing section may include a frequency dividing section, a lower frequency processing section, and a higher frequency processing section. Here, the frequency dividing section divides the audio signal into lower frequency components and higher frequency components relative to a predetermined frequency. The lower frequency processing section performs signal processing for the lower frequency components of the audio signal to be input into each one of the plurality of loudspeakers and inputs the processed signal thereinto. The higher frequency processing section inputs the higher frequency components of the audio signal into a loudspeaker closest to a center position between the first and second target sound source positions so that the processed signal is in phase with the signal input into the plurality of loudspeakers by the lower frequency processing section.

As a result, signal processing is performed for only the lower frequency components for which sound image localization control is effective, whereby it is possible to reduce the amount of calculation performed in the signal processing.

Still further, when a tweeter placed in front of a center position between the first and second listeners is included in the plurality of loudspeakers, that is, when the first and second target sound source positions are set in front of the respective listeners, the higher frequency processing section may input the higher frequency components of the audio signal into the tweeter.

As a result, it is possible to use the tweeter as a CT loudspeaker (see FIG. 1) placed in the front of the center position between the two listeners, thereby realizing size reduction of the CT loudspeaker. This is especially effective in the case where the sound image control system is applied to a vehicle.

Furthermore, at least one loudspeaker of the plurality of loudspeakers placed in a vehicle may be placed on a backseat side, and the first and second listeners are in the front seats of the vehicle. When signal processing is performed for an audio signal having a plurality of channels, the signal processing section placed in the vehicle inputs all channel audio signals into the at least one loudspeaker placed on the backseat side without performing signal processing.

As a result, in the case where the sound image control system is installed in the vehicle, it is possible to provide sound of high quality for the listeners in the front and back seats.

These and other objects, features, aspects and advantages of the present invention will become more apparent from the following detailed description of the present invention when taken in conjunction with the accompanying drawings.

DETAILED DESCRIPTION OF THE PREFERRED EMBODIMENTS

First Embodiment

Figure 1:
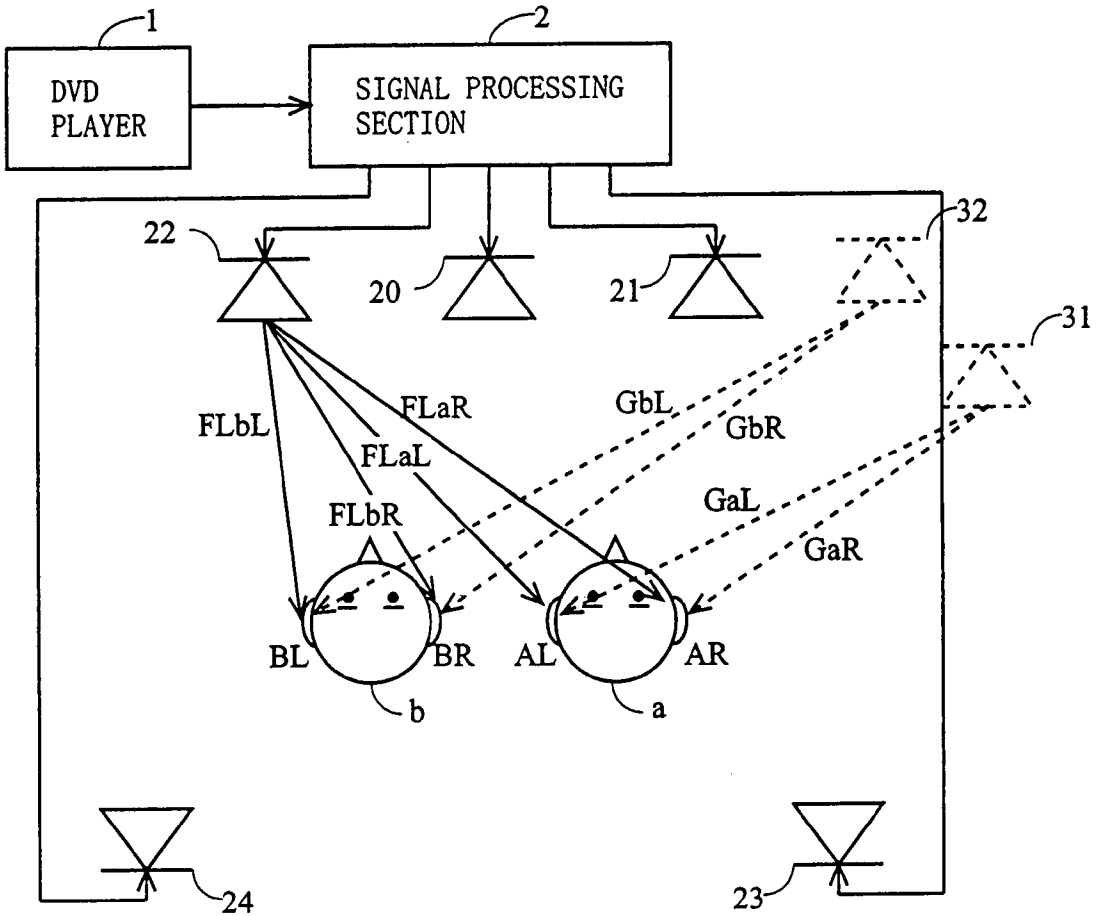
FIG. 1 is an illustration showing a sound image control system according to a first embodiment of the present invention.

FIG. 1 is an illustration showing a sound image control system according to a first embodiment of the present invention. The sound image control system shown in FIG. 1 includes a DVD player 1 that is a sound source, a signal processing section 2, a CT loudspeaker 20, an FR loudspeaker 21, an FL loudspeaker 22, an SR loudspeaker 23, an SL loudspeaker 24, a target sound source 31 for a listener A, and a target sound source 32 for a listener B.

The DVD player 1 outputs, for example, 5 channel audio signals (a CT signal, an FR signal, an FL signal, an SR signal, and an SL signal). The signal processing section 2 performs signal processing, which will be described below, for the signals output from the DVD player 1. The CT signal is subjected to signal processing by the signal processing section 2, and input into the five loudspeakers. That is, in the process of signal processing, five different types of filter processing are performed for one CT signal, and the processed CT signals are input into the respective five loudspeakers. As is the case with the CT signal, signal processing is performed for the other signals in similar manners, and the processed signals are input into the five loudspeakers.

FIG. 1 shows the positional relationship of the listeners A and B, the speakers 20 to 24, and the target sound sources 31 and 32. As shown in FIG. 1, in the first embodiment, the CT loudspeaker 20 is placed in the front of the center position between the two listeners A and B. The FR loudspeaker 21 and the FL loudspeaker 22 are placed in the forward-right and forward-left directions, respectively, from the above-described center position. Note that the FR loudspeaker 21 and the FL loudspeaker 22 are placed symmetrically. The SR loudspeaker 23 and the SL loudspeaker 24 are placed in the backward-right and backward-left directions, respectively, from the above-described center position. Note that the SR loudspeaker 23 and the SL loudspeaker 24 are placed symmetrically. In the first embodiment, the five loudspeakers are placed as described above. However, the five loudspeakers may be placed differently in another embodiment. Furthermore, in another embodiment, more than five loudspeakers may be placed.

Figure 2:
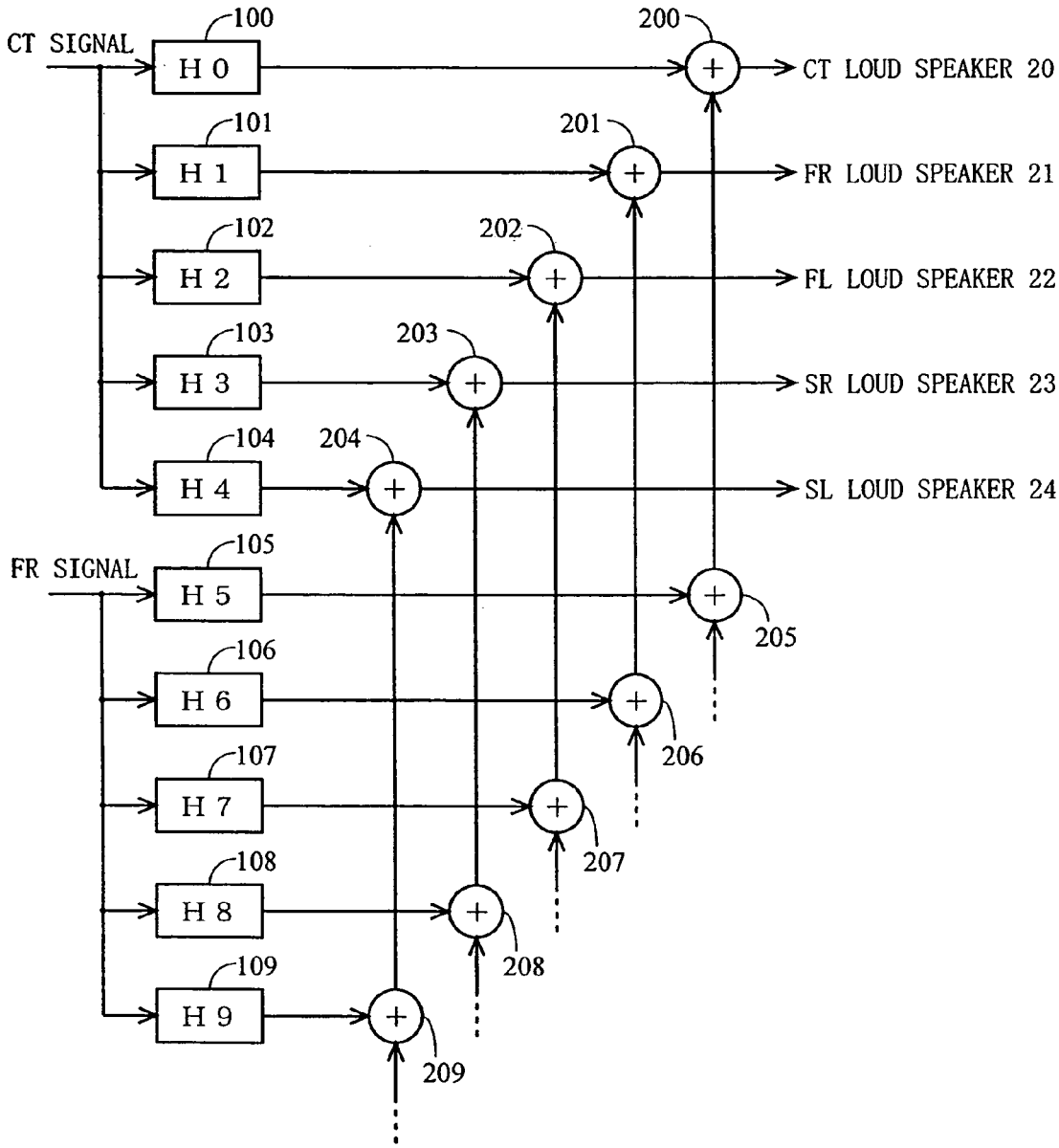
FIG. 2 is a block diagram showing the internal structure of a signal processing section 2 shown in FIG. 1.

FIG. 2 is a block diagram showing the internal structure of the signal processing section 2 shown in FIG. 1. The structure shown in FIG. 2 includes filters 100 to 109 and adders 200 to 209.

Hereinafter, with reference to FIGS. 1 and 2, an operation of the sound image control system is described. In this embodiment, four points (AR, AL, BR, and BL shown in FIG. 1) corresponding to positions of both ears of the listeners A and B are assumed to be control points. Also, by way of example, a case where the target sound sources 31 and 32 are set so that a sound image of the FR signal is localized in a rightward position relative to the actual position of the FR loudspeaker 21 is described. The two target sound source positions, that is, the positions of the target sound sources 31 and 32, are set in the same direction from the respective two listeners. The signal processing section 2 performs signal processing for the FR signal from the DVD player 1, and reproduces the resultant five processed FR signals from the CT loudspeaker 20, the FR loudspeaker 21, the FL loudspeaker 22, the SR loudspeaker 23, and the SL loudspeaker 24, respectively. In the above-described signal processing, if transmission characteristics GaR and GaL from the target sound source 31 to the respective control points AR and AL and transmission characteristics GbR and GbL from the target sound source 32 to the respective control points BR and BL are simulated, the listeners A and B hear sound of the FR signal as if it were reproduced in the respective positions of the target sound sources 31 and 32.

More specifically, in the signal processing section 2, signal processing is performed for the FR signal input from the DVD player 1 by the filters 105 to 109. The output signals from the filters 105 to 109 are reproduced from the CT loudspeaker 20, the FR loudspeaker 21, the FL loudspeaker 22, the SR loudspeaker 23, and the SL loudspeaker 24, respectively. If transmission characteristics of the reproduced sound, that is, transmission characteristics from each one of the loudspeakers to the four control points (AR, AL, BR, and BL), are identical with the transmission characteristics GaR, GaL, GbR, and GbL, respectively, at the corresponding control points (that is, corresponding positions of ears of the listeners A and B), the listeners A and B hear sound of the FR signal as if it were reproduced in the respective positions of the target sound sources 31 and 32. Note that each one of the output signals from the filters 105 to 109 is added to a corresponding processed signal output from another channel by a corresponding adder of the adders 205 to 209.

Note that FIG. 2 shows only the structure for processing the CT signal and the FR signal, but the signal processing section 2 also performs signal processing for the other signals (the FL signal, the SR signal, and the SL signal) in similar manners, and adds all the channel signals so as to obtain the five resultant signals for outputting.

Here, transmission characteristics from the FL loudspeaker 22 to the control points AR, AL, BR, and BL are assumed to be FLaR, FLaL, FLbR, and FLbL, respectively. Similarly, transmission characteristics from the FR loudspeaker 21 to the control points AR, AL, BR, and BL are assumed to be FRaR, FRaL, FRbR, FRbL, respectively, transmission characteristics from the SR loudspeaker 23 to the control points AR, AL, BR, and BL are assumed to be SRaR, SRaL, SRbR, and SRbL, respectively, transmission characteristics from the SL loudspeaker 24 to the control points AR, AL, BR, and BL are assumed to be SLaR, SLaL, SLbR, and SLbL, respectively, and transmission characteristics from the CT loudspeaker 20 to the control points AR, AL, BR, and BL are assumed to be CTaR, CTaL, CTbR, and CTbL, respectively. In this case, in order to perform signal processing so that the transmission characteristics from the target sound source 31 to the respective control points AR and AL coincide with GaR and GaL, and the transmission characteristics from the target sound source 32 to the respective control points BR and BL coincide with GbR and GbL, it is necessary to satisfy the following equations.

$$GaR=H5\cdot CTaR+H6\cdot FRaR+H7\cdot FLaR+H8\cdot SRaR+H9\cdot SLaR$$

$$GaL=H5\cdot CTaL+H6\cdot FRaL+H7\cdot FLaL+H8\cdot SRaL+H9\cdot SLaL$$

$$GbR=H5\cdot CTbR+H6\cdot FRbR+H7\cdot FLbR+H8\cdot SRbR+H9\cdot SLbR$$

$$GbL=H5\cdot CTbL+H6\cdot FRbL+H7\cdot FLbL+H8\cdot SRbL+H9\cdot SLbL$$

Here, H5 to H9 are filter coefficients of the respective filters 105 to 109 shown in FIG. 2. In the above-described set of equations, (hereinafter, referred to as equations (a)) the number of unknowns (filter coefficients) is larger than that of equations. This indicates that the above-described equations have an indefinite number of solutions depending on conditions, not indicating that they have no solutions. In fact, in the multi-input and multi-output inverse theorem (MINT) (for example, M. Miyoshi and Kaneda, "Inverse filtering of room acoustics", IEEE Trans. Acoust. Speech Signal Process. ASSP-36 (2), 145-152 (1988)), an approach performing control with more than one (the number of control points+1) loudspeaker is described. In general, it is known that the number of loudspeakers at least equal to or greater than that of control points allows filter coefficients (that is, solutions) for controlling the above-described loudspeakers to be obtained.

As such, the filter coefficients H5 to H9 of the respective filters 105 to 109 can be obtained using the aforementioned equations (a) by measuring the transmission characteristics from the CT loudspeaker 20, the FR loudspeaker 21, the FL loudspeaker 22, the SR loudspeaker 23, and the SL loudspeaker 24 to the control points (AR, AL, BR, and BL), and the transmission characteristics from the target sound sources 31 and 32 to the corresponding control points.

In the above descriptions, the FR signal has been taken as an example. Filter coefficients H0 to H4 of respective filters 100 to 104 for processing the CT signal can also be obtained in a similar manner as that described above. Furthermore, filter coefficients of the FL signal, the SL signal, and the SR signal, which are not shown in FIG. 2, can be obtained in the similar manners. As a result, sound image localization control is performed for all the channel signals.

As described above, obtained filter coefficients allow sound image localization control to be performed so as to localize a sound image in a set target sound source position. However, there may be a case where solutions of the aforementioned equations cannot be obtained due to the setting of the target sound source position. In this case, sound image localization cannot be performed so as to localize a sound image in the set target sound source position. Therefore, in the following descriptions, an appropriate method for setting the target sound source position is described.

Figure 3:
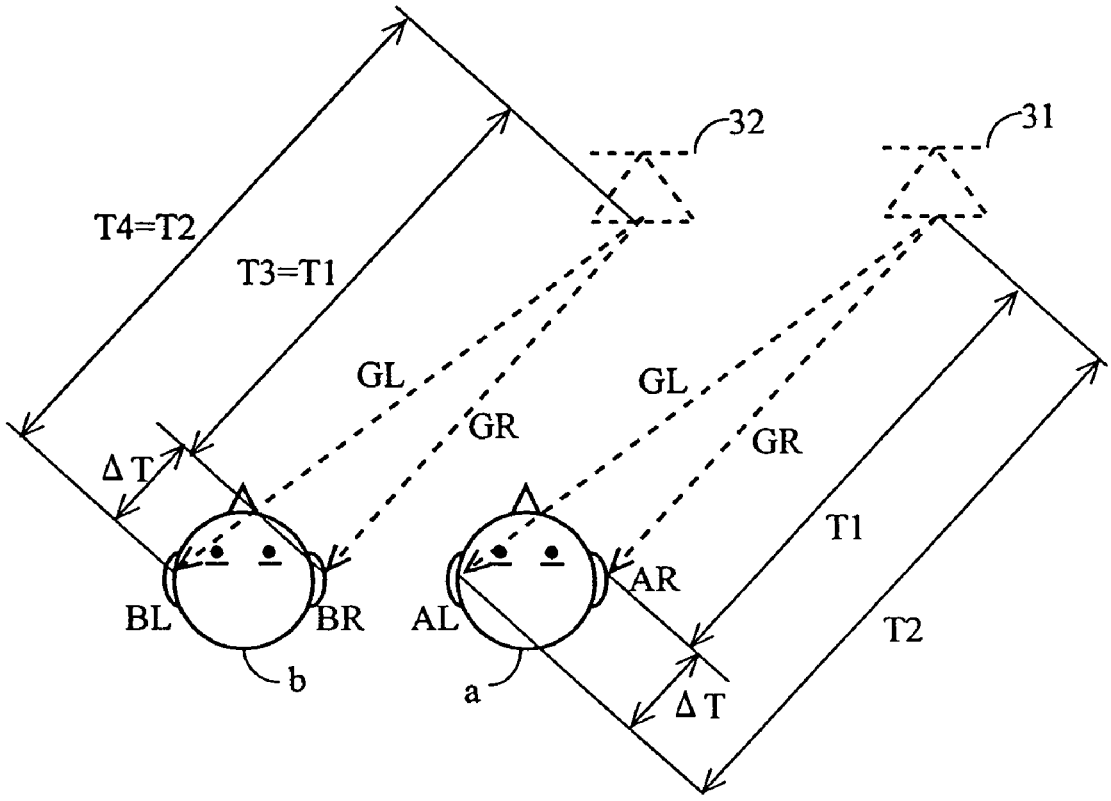
FIG. 3 is an illustration showing a case where the same transmission characteristic is provided to a listener A and a listener B from respective target sound sources 31 and 32.

FIG. 3 is an illustration showing a case where the same transmission characteristic is provided to the listener A and the listener B from the respective target sound sources 31 and 32. That is, the target sound sources 31 and 32 are set equidistant and in the same direction from the listeners A and B, respectively.

Figure 4C:
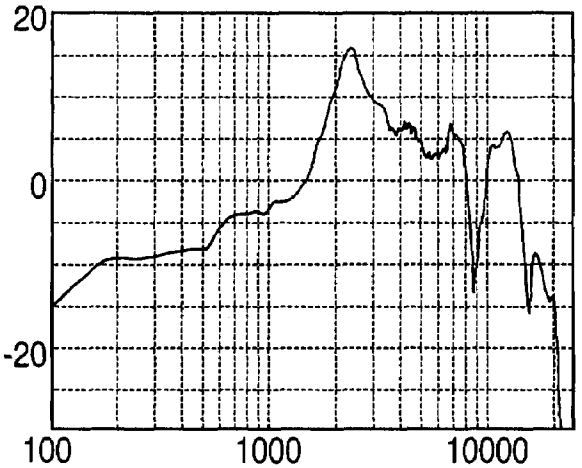
FIG. 4C is a line graph showing an amplitude frequency characteristic (transfer function) of the transmission characteristic GR in the first embodiment of the present invention.
Figure 4D:
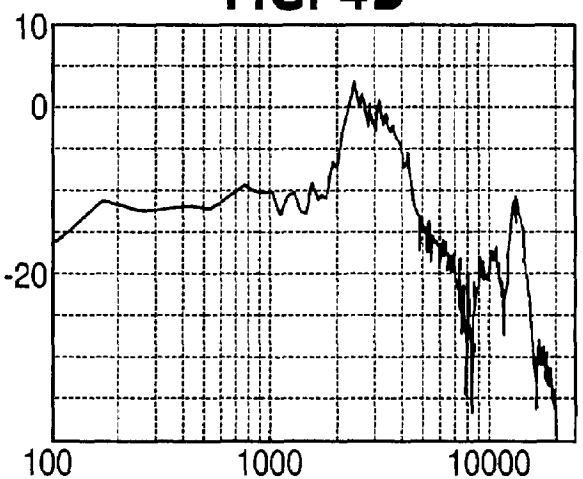
FIG. 4D is a line graph showing an amplitude frequency characteristic (transfer function) of the transmission characteristic GL in the first embodiment of the present invention.
Figure 4A:
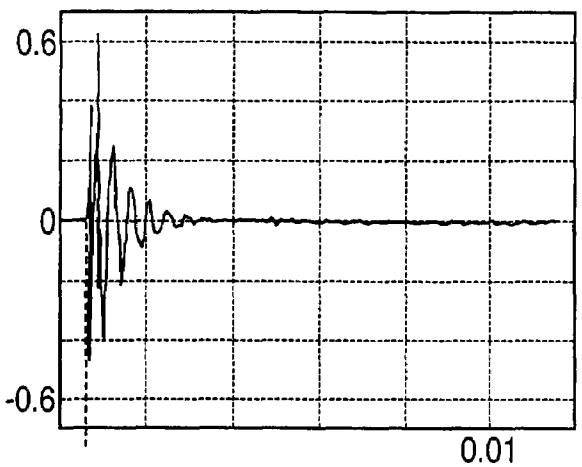
FIG. 4A is a line graph showing a time characteristic (impulse response) of a transmission characteristic GR in the first embodiment of the present invention.
Figure 4B:
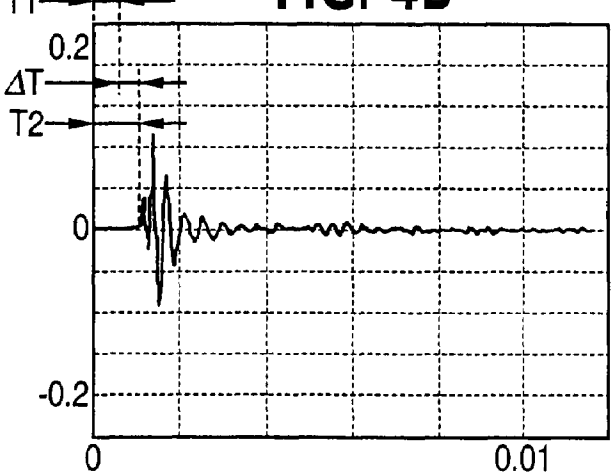
FIG. 4B is a line graph showing a time characteristic (impulse response) of a transmission characteristic GL in the first embodiment of the present invention.

FIGS. 4A and 4C are line graphs showing a time characteristic and a frequency characteristic (amplitude), respectively, of a transmission characteristic GR shown in FIG. 3. FIGS. 4B and 4D are line graphs showing a time characteristic and a frequency characteristic (amplitude), respectively, of a transmission characteristic GL shown in FIG. 3. Here, T1 shown in FIGS. 3 and 4 represents transmission time from the target sound source 31 to the right ear of the listener A. Similarly, T2 represents transmission time from the target sound source 31 to the left ear of the listener A, T3 represents transmission time from the target sound source 32 to the right ear of the listener B, and T4 represents transmission time from the target sound source 32 to the left ear of the listener B. Also, AT represents the difference (T2−T1) in transmission time between the right and left ears of the listener.

Figure 5:
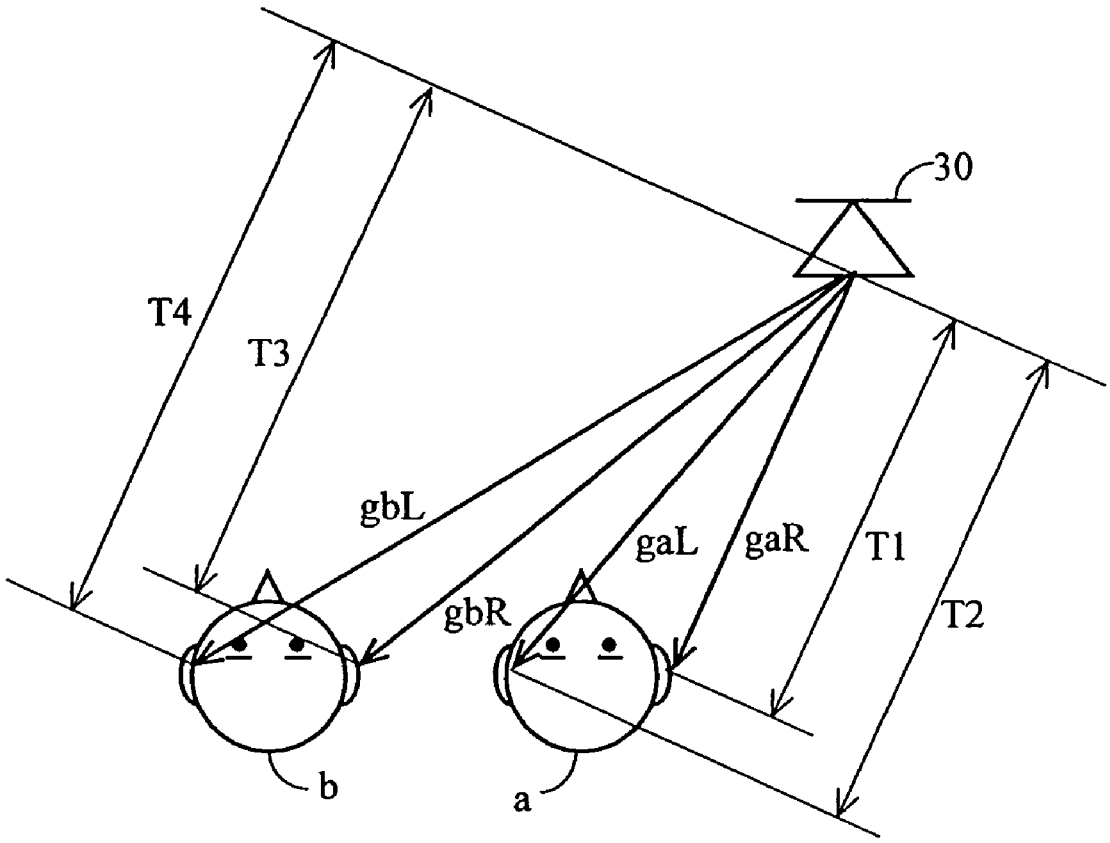
FIG. 5 is an illustration showing a case where a loudspeaker 30 is actually placed in the vicinity of the target sound sources 31 and 32.

FIG. 5 is an illustration showing a case where a loudspeaker 30 is actually placed in the vicinity of the target sound sources 31 and 32. A single loudspeaker is provided corresponding to a single channel (in this case, an FR channel). Thus, transmission characteristics from the loudspeaker 30 to both ears of the listener A are represented as gaR and gaL, respectively, and transmission characteristics from the loudspeaker 30 to both ears of the listener B are represented as gbR and gbL, respectively, as shown in FIG. 5. T1 represents transmission time from the loudspeaker 30 to the right ear of the listener A, T2 represents transmission time from the loudspeaker 30 to the left ear of the listener A, T3 represents transmission time from the loudspeaker 30 to the right ear of the listener B, and T4 represents transmission time from the loudspeaker 30 to the left ear of the listener B. Due to the greater distance between the loudspeaker 30 and the listener B compared to that between the loudspeaker 30 and the listener A, the relationship among the above-described T1 to T4 is as follows.

$$T1<T2<T3<T4 \quad (1)$$

Also, if the left ear of the listener A is placed at a near touching distance from the right ear of the listener B, the relationship among the above-described T1 to T4 is as follows.

$$T1<T2\leqq T3<T4 \quad (2)$$

That is, the above-described inequality (2) indicates a physically possible time relationship.

However, in the case shown in FIG. 3 where the same transmission characteristic is provided to the listeners A and B, the listeners A and B are assumed to be located in the same position with respect to the loudspeaker 30, which is physically impossible. More specifically, T1 to T4 have to basically satisfy the inequality (1) or the inequality (2). However, in the case of the target sound sources 31 and 32 shown in FIG. 3, T3 (=T1)<T2 is given with respect to the positions of the left ear of the listener A and the right ear of the listener B, which does not satisfy the inequalities (1) and (2). The signal processing section 2, which performs signal processing for the signals to be input into the five loudspeakers 20 to 24 in order to localize a sound image in the target source position, has to satisfy causality (the above-described inequality (1) or (2)). Thus, the signal processing section 2 cannot perform control shown in FIG. 3. As described above, in the case where the target sound sources 31 and 32 are set for the two listeners A and B, respectively, it is not possible to set the target sound source positions equidistant and in the same direction from the respective listeners. Therefore, it is important to set the target sound sources 31 and 32 in positions satisfying the causality.

Figure 6:
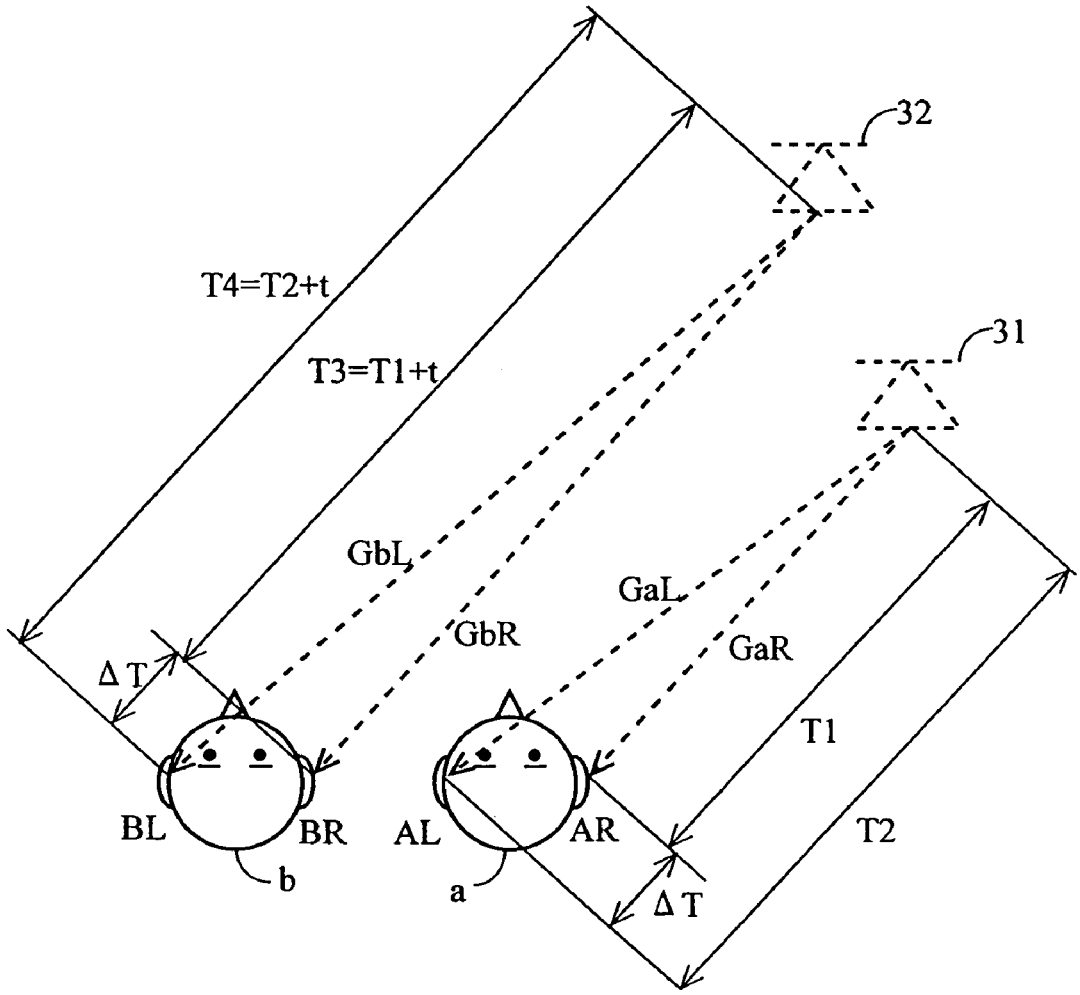
FIG. 6 is an illustration showing a method for setting a target sound source in the present invention.

FIG. 6 is an illustration showing a method for setting a target sound source in the present invention. The transmission characteristics GaR and GaL from the target sound source 31 to both ears of the listener A are identical with the transmission characteristics GR and GL shown in FIG. 3. That is, the time characteristics thereof are shown in FIGS. 4A and 4B, respectively. The target sound source 32 for the listener B is set in a position in the same direction as that of the target sound source 32 shown in FIG. 3, but at a greater distance by time t compared thereto. That is, the target sound source 32 is set so as to satisfy T3=T1+t and T4=T2+t. By setting the target sound source 32 as described above, the time characteristics are shifted by time t from the respective time characteristics shown in FIGS. 4A and 4B to the right (along the time axis). Also, amplitude frequency characteristics are identical with the respective amplitude frequency characteristics shown in FIGS. 4C and 4D (that is, the direction of the target sound sources is identical with that shown in FIG. 3). Thus, even if the target sound source 32 is placed in the same direction from the listener B as that shown in FIG. 3, it can be set so as to satisfy the causality. That is, by setting the target sound source 32 in a position at a greater distance than that shown in FIG. 3 by time t, it is possible to satisfy the inequality (1) or the inequality (2). As a result, the signal processing section 2 can control the FR signal, and obtain the filter coefficients for localizing a sound image of the FR signal in the target sound source position.

Figure 7:
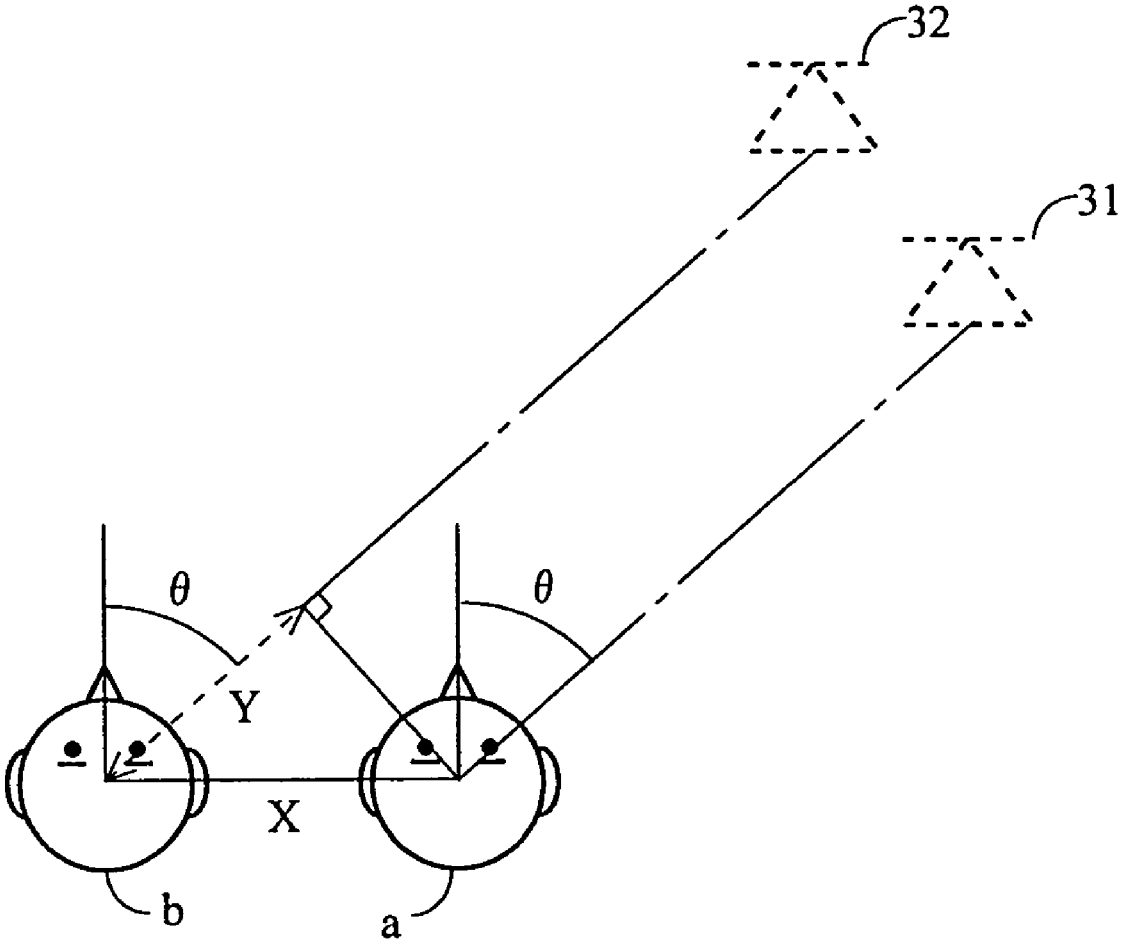
FIG. 7 is an illustration showing transmission paths from the target sound sources 31 and 32 to respective center positions of the listeners A and B.

Hereinafter, a method for determining the above-described t in more detail is described. FIG. 7 is an illustration showing transmission paths from the target sound sources 31 and 32 to respective center positions of the listeners A and B. In FIG. 7, arrows shown in dashed line indicate the same time (distance). Therefore, the transmission path for the listener B requires more time compared to that for the listener A due to a portion corresponding to an arrow shown in dotted line. That is, assume that the two target sound sources are set in the positions at an angle of θ degrees with respect to a forward direction of the respective listeners, and the distance between the listeners A and B is X, the transmission path for the listener B is longer than that for the listener A by distance Y=Xs in θ. Thus, the causality is satisfied if the length of time that sound of the FR signal travels over the distance Y is taken into consideration. That is, assume that the velocity of sound is P, t is obtained by the following equation.

$$t=X\sin\theta/P \quad (3)$$

As described above, it is possible to localize a sound image in the target sound source position by setting the target sound source in the position satisfying the above-described inequality (1) or (2). Note that at least one loudspeaker of the actual loudspeakers 20 to 24 is preferably placed in a position where the relationship among a plurality of transmission times from the target sound source positions to the corresponding control points is satisfied. In the above description, the relationship among the transmission time (T1, T2, T3, T4) from the target sound source positions to the corresponding control points (AR, AL, BR, and BL) is expressed as T1<T2<T3<T4. If there is a loudspeaker placed in the position that satisfies the above-described relationship, it is possible to easily localize a sound image in the target sound source position. Specifically, in the first embodiment, the FR loudspeaker 21 is placed in the position that satisfies the relationship T1<T2<T3<T4. Therefore, the sound image control system according to the first embodiment allows a sound image to be easily localized in the target sound source position. Note that the target sound sources shown in FIG. 3 cannot be set due to the following reason. That is, there is no position of a loudspeaker where the relationship T1=T3<T2=T4 shown in FIG. 3 is satisfied, whereby it is not possible to set the target sound sources shown in FIG. 3.

Note that the filter coefficients for localizing a sound image in the target sound source position set as described above may be obtained by a calculator using the above-described equations (a), or may be obtained using an adaptive filter shown in FIG. 8, which will be described below.

Figure 8:
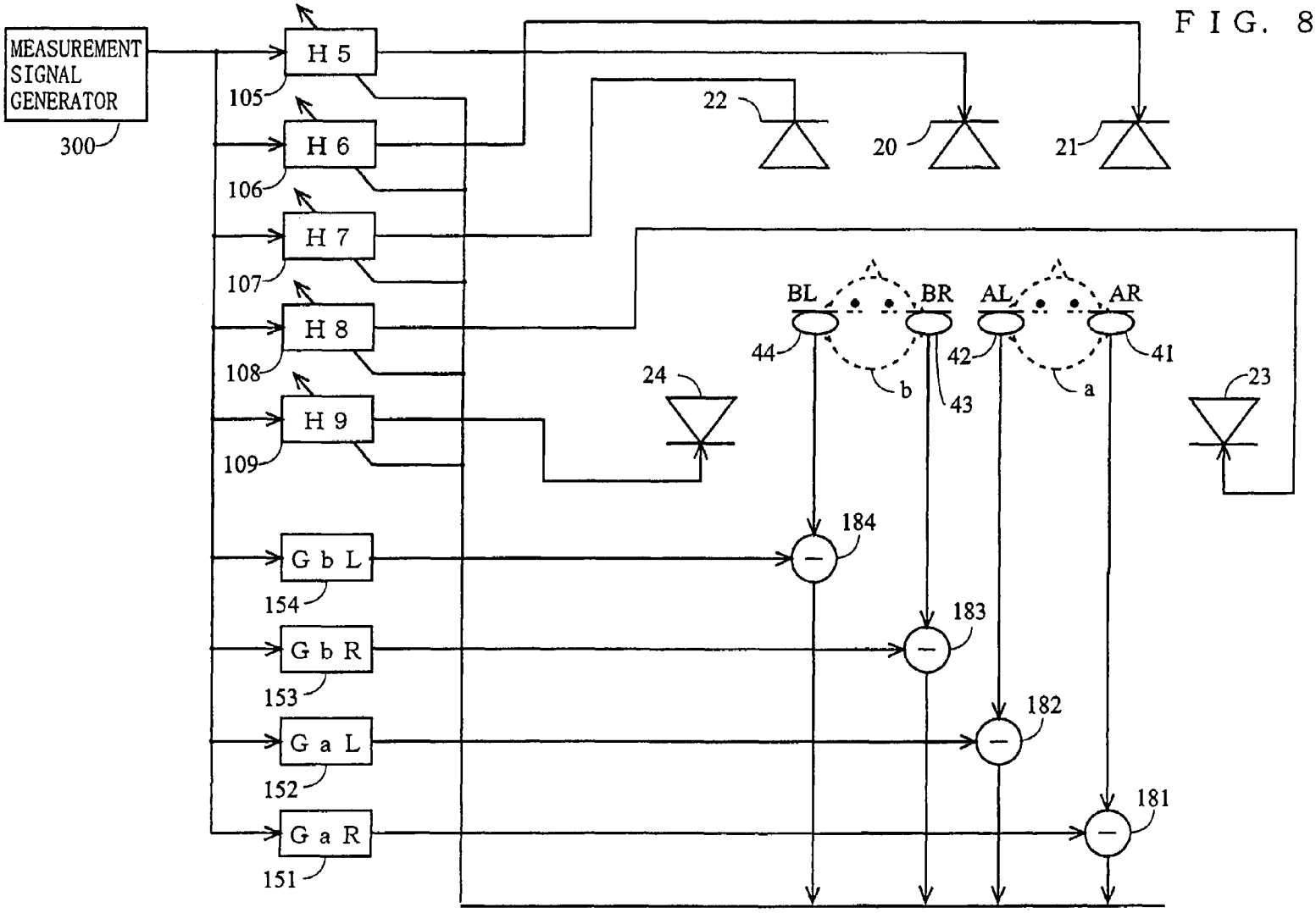
FIG. 8 is an illustration showing a method for obtaining a filter coefficient using an adaptive filter in the first embodiment of the present invention.

FIG. 8 is an illustration showing a method for obtaining a filter coefficient using the adaptive filter in the first embodiment of the present invention. In FIG. 8, reference numbers 105 to 109 denote adaptive filters, a reference number 300 denotes a measurement signal generator, a reference number 151 denotes a target characteristic filter in which the target characteristic GaR is set, a reference number 152 denotes a target characteristic filter in which the target characteristic GaL is set, a reference number 153 denotes a target characteristic filter in which the target characteristic GbR is set, a reference number 154 denotes a target characteristic filter in which the target characteristic GbL is set, a reference number 41 denotes a microphone placed in a position of the right ear of the listener A, a reference number 42 denotes a microphone placed in a position of the left ear of the listener A, a reference number 43 denotes a microphone placed in a position of the right ear of the listener B, a reference number 44 denotes a microphone placed in a position of the left ear of the listener B, and reference numbers 181 to 184 denote subtracters.

A measurement signal output from the measurement signal generator 300 is input into the target characteristic filters 151 to 154, and provided with the transmission characteristics of the target sound sources shown in FIG. 6. At the same time, the above-described measurement signal is input into the adaptive filters 105 to 109 (denoted with the same reference numbers shown in FIG. 2 for indicating correspondence) as a reference signal, and outputs from the adaptive filters 105 to 109 are reproduced from the respective loudspeakers 20 to 24. The reproduced sound is detected by the microphones 41 to 44, and input into the respective subtracters 181 to 184. The subtracters 181 to 184 subtract the output signals of the target characteristic filters 151 to 154 from the output signals of the respective microphones 41 to 44. A residual signal output from the subtracters 181 to 184 is input into the adaptive filters 105 to 109 as an error signal.

In the respective adaptive filters 105 to 109, calculation is performed so as to minimize the input error signal, that is, so as to bring it close to 0, based on the multiple error filtered-x LMS (MEFX-LMS) algorithm (for example, S. J. Elliott, et al., "A multiple error LMS algorithm and application to the active control of sound and vibration", IEEE Trans. Acoust. ASSP-35, No. 10, 1423-1434 (1987)). Therefore, the target transmission characteristics GaR, GaL, GbR, and GbL are realized in the positions of both ears of the listeners A and B by obtaining the sufficiently convergent coefficients H5 to H9 of the respective adaptive filters 105 to 109. As described above, the causality described in FIG. 5 has to be satisfied in the case where the filter coefficient is obtained in the time domain. Thus, the target sound source has to be set as described in FIGS. 6 and 7.

As described above, in the present invention, the target sound sources 31 and 32, which satisfy the causality, are set as shown in FIG. 6 in consideration of the fundamental physical principle that sound waves sequentially reach from the loudspeaker 30 to the listeners A and B in order of increasing distance of the transmission path. That is, sound waves reach the listener along a shorter transmission path first (see FIG. 5). As a result, it is possible to perform sound image localization control by setting both ears of the two listeners A and B as control points. Thus, the listeners A and B feel as if they were hearing sound from the virtual target sound sources 31 and 32, respectively. That is, they feel as if the FR loudspeaker 21 were placed in a position shifted in a rightward direction from its actual position.

The method for setting the target sound source with respect to the FR signal has been described in the above descriptions. With respect to the FL signal, the target sound source is similarly set in a leftward position. Therefore, the above-described method also allows sound image localization control to be performed for the FL signal, setting both ears of the two listeners A and B as control points.

Figure 9:
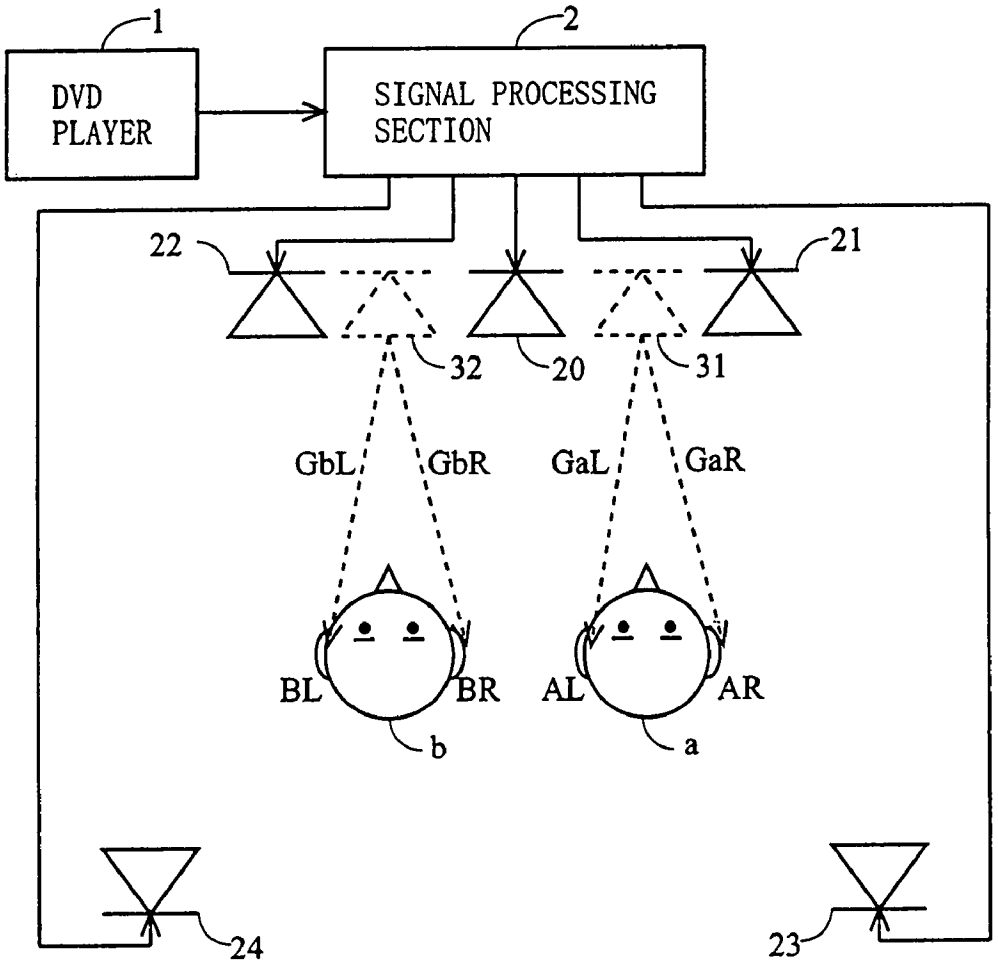
FIG. 9 is an illustration showing a case where a sound image of a CT signal is concurrently localized at the respective fronts of the listeners A and B.
Figure 10:
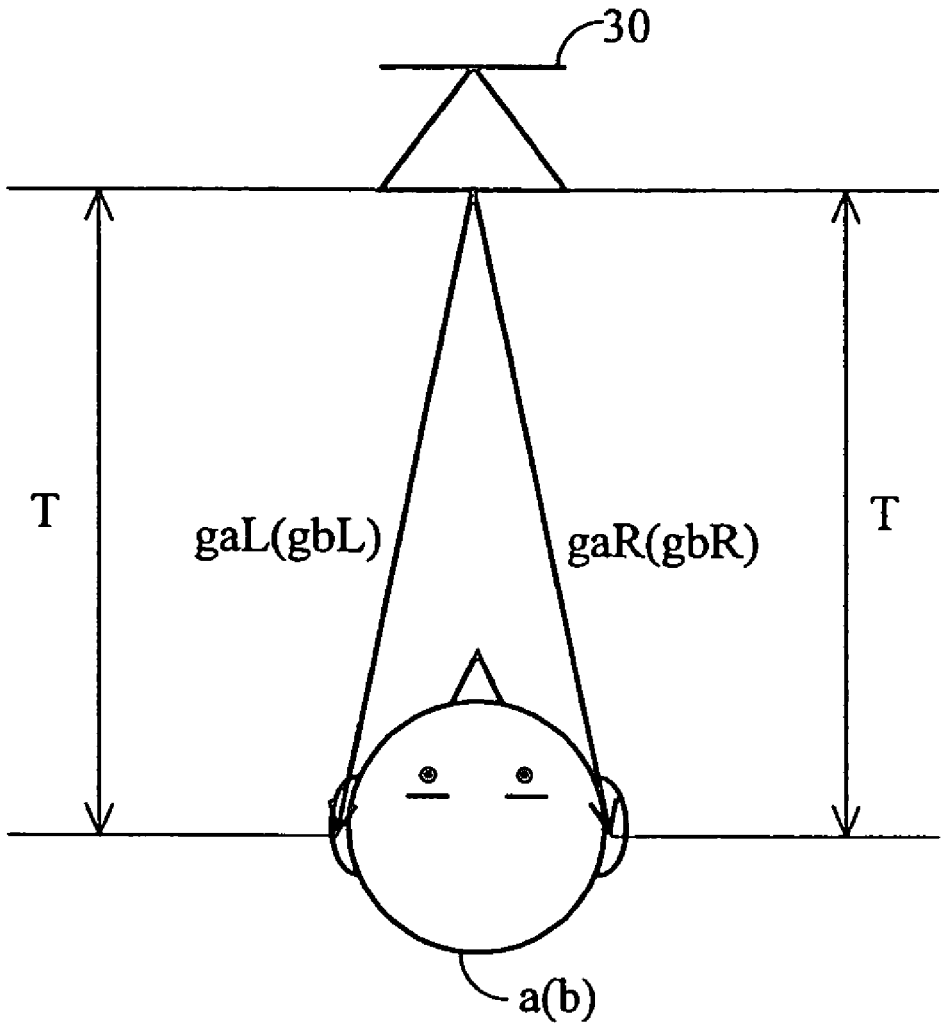
FIG. 10 is an illustration showing a case where the loudspeaker 30 is actually placed in the front of the listener A (or listener B)

Next, a case where sound image localization control is performed for the CT signal is described. FIG. 9 is an illustration showing a case where a sound image of the CT signal is concurrently localized at the respective fronts of the listeners A and B. FIG. 10 is an illustration showing a case where the loudspeaker 30 is actually placed in the front of the listener A (or listener B). As shown in FIG. 10, transmission characteristics gaR, gaL, gbR, and gbL are substantially equal to each other, and transmission time T thereof are also substantially equal to each other. Therefore, it is not necessary to consider special causality in the case where the target sound source is set in the front of the listener. For example, the filter coefficients for realizing the above-described transmission characteristics can be obtained by setting the transmission characteristics gaR, gaL, gbR, and gbL equal (or substantially equal) to each other in the respective target characteristic filters 151 to 154 shown in FIG. 8. Thus, the listeners A and B feel as if they were hearing sound from the virtual target sound sources 31 and 32, respectively. That is, they feel as if the CT loudspeaker 20 were placed in their respective fronts.

Figure 11:
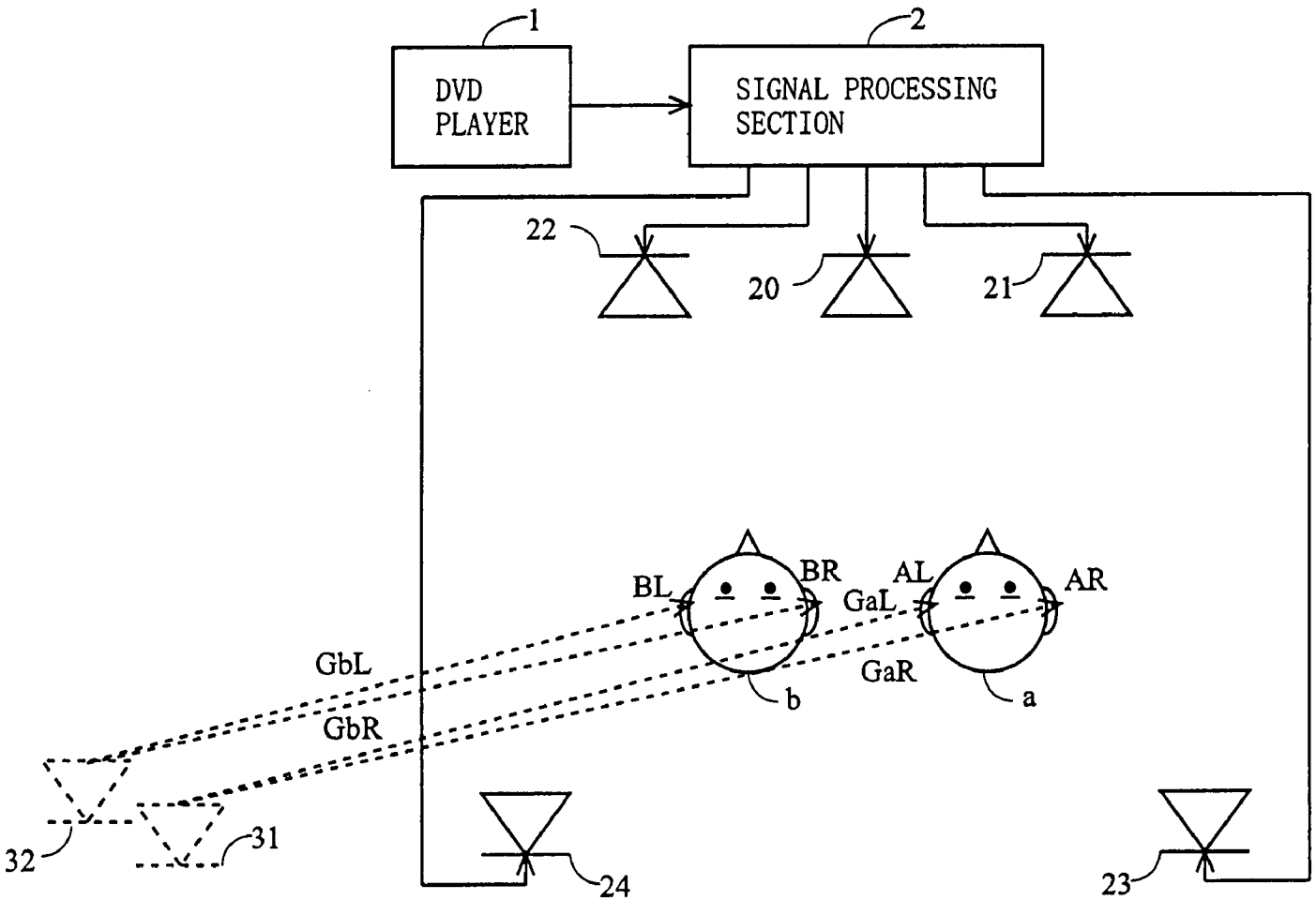
FIG. 11 is an illustration showing a case where sound image localization control is performed so that sound from an SL loudspeaker 24 is localized in a leftward position compared to the actual position of the SL loudspeaker 24.
Figure 12:
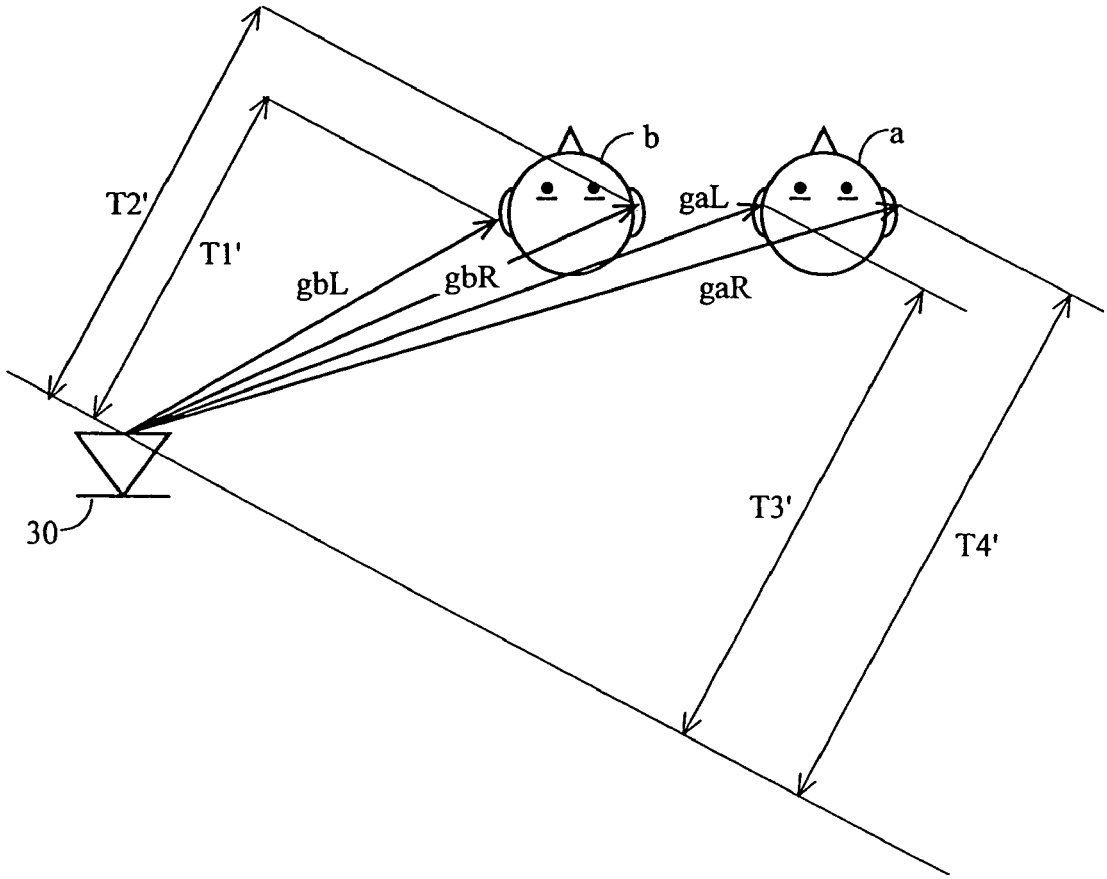
FIG. 12 is an illustration showing a case where the loudspeaker 30 is actually placed in the vicinity of the target sound sources 31 and 32.

Next, a case where sound image localization control is performed for the SL signal is described. FIG. 11 is an illustration showing a case where sound image localization control is performed so that sound from the SL loudspeaker 24 is localized in a leftward position compared to the actual position of the SL loudspeaker 24. FIG. 12 is an illustration showing a case where the loudspeaker 30 is actually placed in the vicinity of the target sound sources 31 and 32. In FIG. 12, gaR and gaL represent the transmission characteristics from the loudspeaker 30 to both ears of the listener A, respectively, and gbR and gbL represent the transmission characteristics from the loudspeaker 30 to both ears of the listener B, respectively. Also, T4' represents transmission time from the loudspeaker 30 to the right ear of the listener A, T3' represents transmission time from the loudspeaker 30 to the left ear of the listener A, T2' represents transmission time from the loudspeaker 30 to the right ear of the listener B, and T1' represents transmission time from the loudspeaker 30 to the left ear of the listener B. Due to the greater distance between the loudspeaker 30 and the listener A compared to that between the loudspeaker 30 and the listener B, the relationship among the above-described T1' to T4' is as follows.

$$T1'<T2'<T3'<T4' \tag{4}$$

Also, if the left ear of the listener A is placed at a near touching distance from the right ear of the listener B, the relationship among the above-described T1' to T4' is as follows.

$$T1'<T2'\leqq T3'<T4' \tag{5}$$

That is, the above-described inequality (5) indicates physically possible time relationship.

Figure 13:
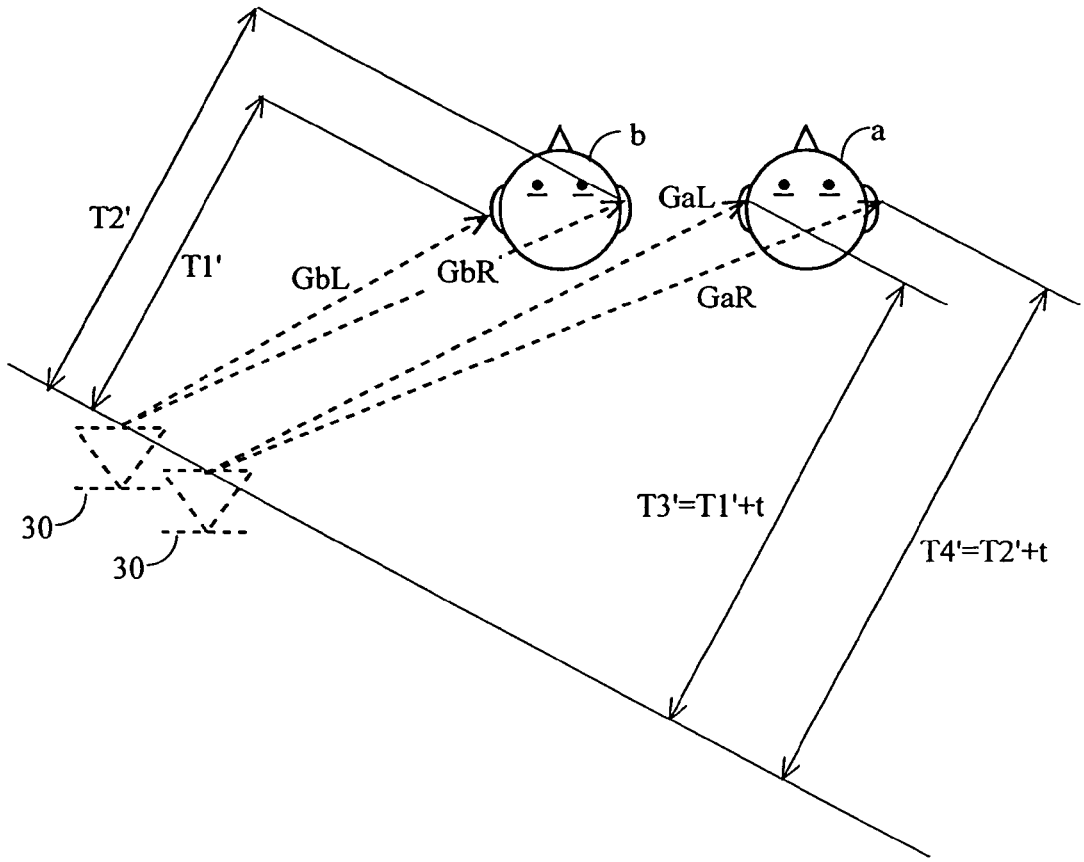
FIG. 13 is an illustration showing a target sound source setting method, which takes causality into consideration, in the first embodiment of the present invention.

In order to satisfy the above-described inequality (4) or (5), the target sound source 31 and 32 are set as shown in FIG. 13. The transmission characteristic GaR from the target sound source 31 to the right ear of the listener A and the transmission characteristic GbR from the target sound source 32 to the right ear of the listener B have the same amplitude frequency characteristic (that is, the same direction), but the distance between the target sound source 31 and the right ear of the listener A is greater by time t than that between the target sound source 32 and the right ear of the listener B. Similarly, the transmission characteristic GaL from the target sound source 31 to the left ear of the listener A and the transmission characteristic GbL from the target sound source 32 to the left ear of the listener B have the same amplitude frequency characteristic (that is, the same direction), but the distance between the target sound source 31 and the left ear of the listener A is greater by time t than that between the target sound source 32 and the left ear of the listener B. The target characteristics set as described above allow the causality (the above-described inequality (4) or (5)) to be satisfied. As a result, the signal processing section 2 can control the SL signal, and obtain the filter coefficients for localizing a sound image of the SL signal in the target sound source position.

Also, as is the case with the SL signal, the above-described method also allows sound image localization control to be performed for the SR signal, setting both ears of the two listeners A and B as control points.

Figure 14:
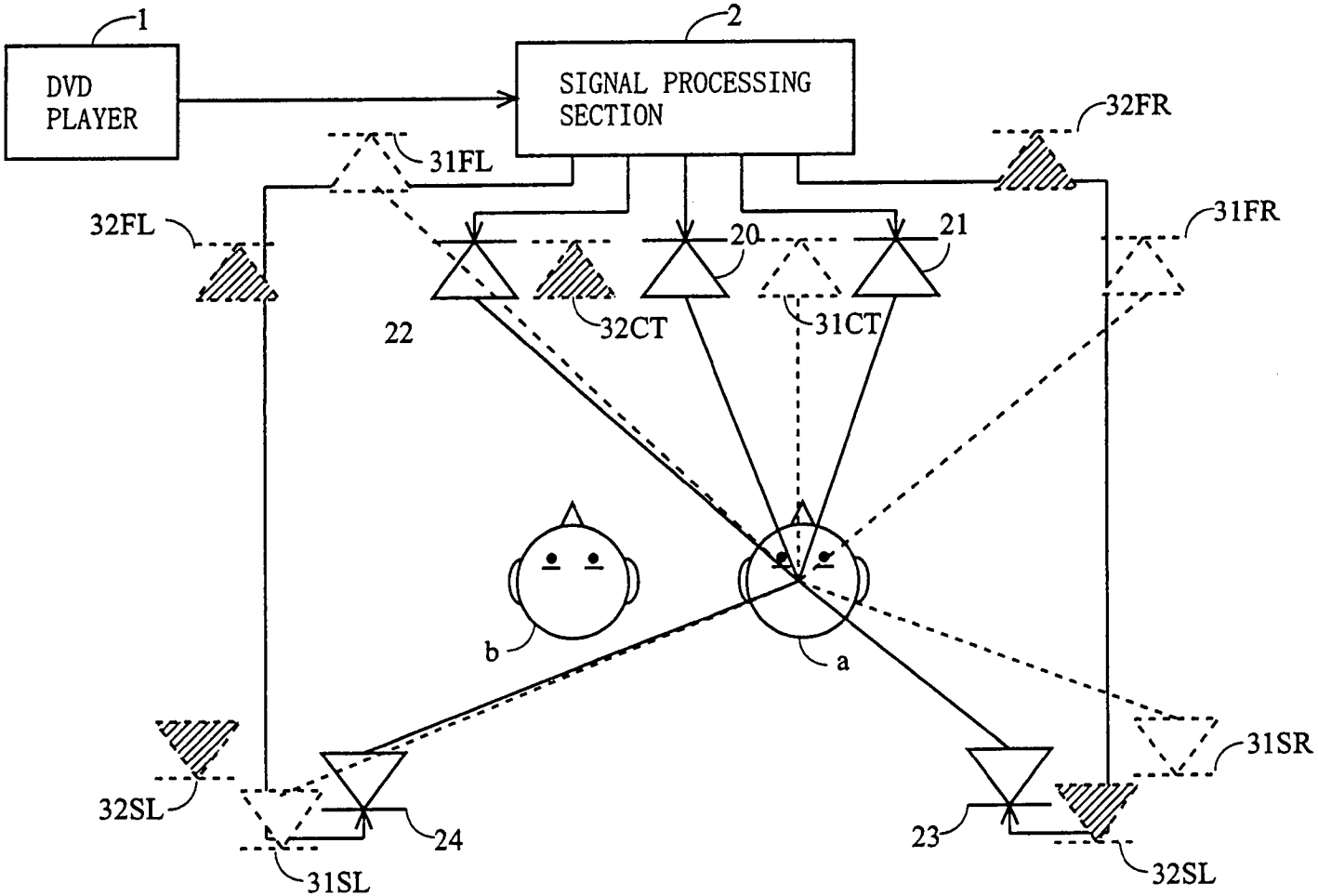
FIG. 14 is an illustration showing a case where five signals are combined.

In the above descriptions, the target sound source setting method and sound image localization control based on the above-described method have been described with respect to all the 5 channel signals (A WF signal is not described in the above descriptions, because the necessity to perform sound image localization control for the WF signal is smaller compared to the other channel signals due to its lack in directional stability. If required, however, it may be controlled in accordance with the above-described method). FIG. 14 is an illustration showing a case where five signals are combined. In FIG. 14, the target sound sources 31FR, 31CT, 31FL, 31SR, and 31SL for the listener A are represented as loudspeakers shown by the dotted lines. Also, the target sound sources 32FR, 32CT, 32FL, 32SR, and 32SL for the listener B are represented as shaded loudspeakers.

In FIG. 14, arrows in solid line connecting the center position of the listener A with the respective actual loudspeakers (the CT loudspeaker 20, the FR loudspeaker 21, the FL loudspeaker 22, the SR loudspeaker 23, and the SL loudspeaker 24) are shown. Those arrows in solid line show an ill-balanced relationship (with respect to distance or angle) between the listener A and the actual loudspeakers. On the other hand, the arrows in dotted line connecting the center position of the listener A with the respective target sound sources (the target sound sources 31FR, 31CT, 31FL, 31SR, and 31SL) show a better-balanced relationship, which is improved by performing sound image localization control as described in the embodiment of the present invention. As shown in FIG. 14, the ill-balanced relationship between the listener B and the actual loudspeakers can also be improved by performing sound image localization control as described above.

In the first embodiment, the target sound source is set in a rightward or leftward position compared to the actual position of the loudspeaker. Thus, a user can enjoy the effects of surround sound even if in a narrow room, for example, which does not allow the actual loudspeakers to be placed at a sufficient distance from him/herself, or even if the FR loudspeaker 21, the FL loudspeaker 22, and the CT loudspeaker 20 are built into a television.

In the first embodiment, the target sound sources of the CT signal are set in the respective fronts of the listeners A and B. However, if there is a screen of a television, for example, the target sound source of the CT signal may be set in a position of the television screen.

Figure 15:
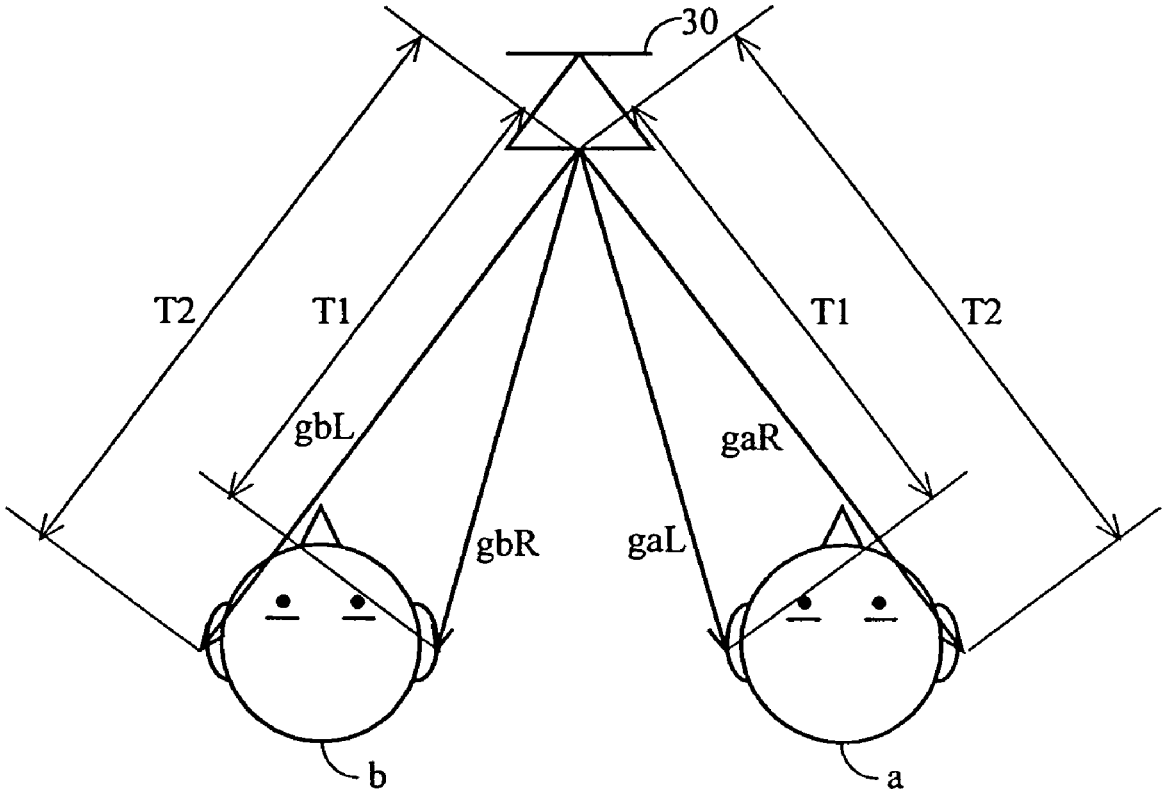
FIG. 15 is an illustration showing a case where the listeners A and B are provided with a single target sound source set in a position equidistant from the listeners A and B.

FIG. 15 is an illustration showing a case where the listeners A and B are provided with a single target sound source set in a position equidistant from the listeners A and B. If the television is placed in the front of the center position between the two listeners A and B, for example, the loudspeaker 30 is placed in the position of the television. In this case, the transmission characteristic gaL from the loudspeaker 30 to the left ear of the listener A is substantially equal to the transmission characteristic gbR from the loudspeaker 30 to the right ear of the listener B. Similarly, the transmission characteristic gaR from the loudspeaker 30 to the right ear of the listener A is substantially equal to the transmission characteristic gbL from the loudspeaker 30 to the left ear of the listener B. Therefore, as described in FIGS. 9 and 10, it is possible to obtain the filter coefficients by setting the transmission characteristics shown in FIG. 15 in the respective target characteristic filters 151 to 154.

As such, in sound image localization control for the CT signal, it is not necessary to satisfy the aforementioned causality as described with respect to the FR signal, etc., if the target sound sources are set in the respective fronts of the listeners A and B, or the target sound source is set in a position (for example, a front center position) equidistant from the listeners A and B. That is, it is possible to set the target sound source in a position in the same direction and equidistant from the listeners A and B.

As such, according to the first embodiment, sound image localization control can be performed concurrently for the two listeners, thereby obtaining the same sound image localization effect with respect to the respective listeners.

Second Embodiment

Figure 16:
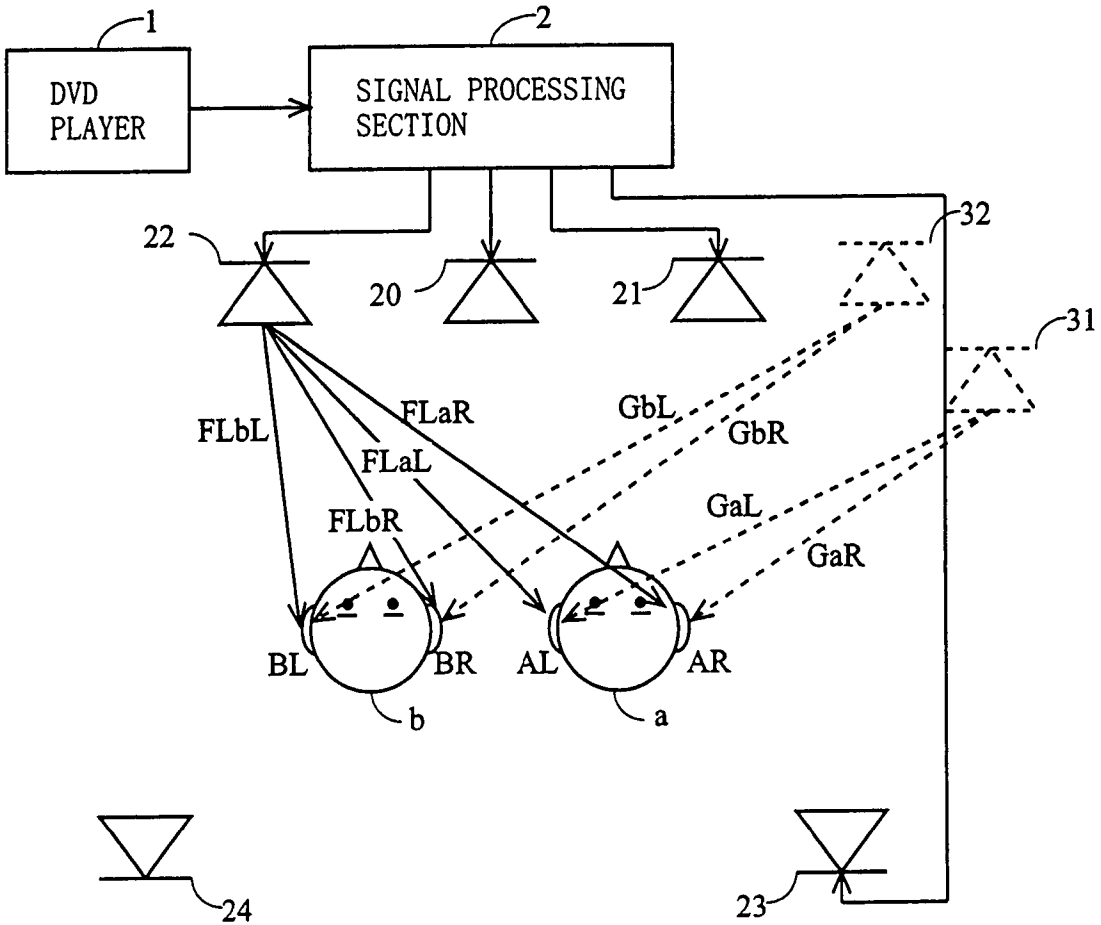
FIG. 16 is an illustration showing a sound image control system performing sound image localization control for an FR signal in a second embodiment of the present invention.

Hereinafter, a sound image control system according to a second embodiment is described. FIG. 16 is an illustration showing the sound image control system performing sound image localization control for the FR signal in the second embodiment. The structure of the sound image control system shown in FIG. 16 differs from that shown in FIG. 1 in that sound image localization control is performed for the FR signal without using the SL loudspeaker 24. As is the case with the first embodiment, the object of the second embodiment is to localize a sound image of the FR signal (and likewise for the other channel signals) in the positions of the target sound sources 31 and 32, but the number of loudspeakers used in the second embodiment is different from that used in the first embodiment. Specifically, in the first embodiment, four control points are controlled by the five loudspeakers 20 to 24. In the second embodiment, on the other hand, four control points are controlled by the four loudspeakers 20 to 23. The number of control loudspeakers is equal to that of control points in the second embodiment, whereby the characteristics of the respective control filters in the signal processing section 2 are uniquely obtained (that is, solutions of the equations (a) are obtained).

The SL loudspeaker 24 is not used because it is diagonally opposite to the target sound sources 31 and 32 of the FR signal. Due to the above-described position of the SL loudspeaker 24, sound from the loudspeaker 24 reaches the control points from the direction opposite to sound from the target sound sources 31 and 32. In this case, the characteristic of sound from the target sound sources 31 and 32 agrees with that of sound from the SL loudspeaker 24 at the control points, but the difference therebetween (especially, with respect to phase) becomes greater with distance from the respective control points (that is, a wavefront of the target characteristic becomes inconsistent with a wavefront of the sound from the SL loudspeaker 24). For that reason, the loudspeaker diagonally opposite to the target sound source may be preferably not used (that is, a signal is not input thereinto).

In general, the reduced number of control loudspeakers can degrade the sound image localization effect. However, the sound image control system of the present invention includes the SR loudspeaker 23 placed in the right rear of the listeners, and the FL loudspeaker 22 placed at the left front of the listeners. The above-described loudspeakers 23 and 22 are placed at diametrically opposed locations to the target sound sources 31 and 32, respectively. Therefore, in the case where sound image localization control is performed for the FR signal using a plurality of loudspeakers whose number is equal to that of control points, it is possible to obtain the control filter coefficients of the signal processing section 2 with loudspeakers 20 to 23, not using the loudspeaker 24 diagonally opposite to the target sound sources 31 and 32. In this case, even if the number of control filters is smaller than that used in the first embodiment, it is possible to realize the same localization effect as that in the first embodiment because the loudspeaker outputting sound whose wavefront is relatively consistent with that of the target characteristic is used. Note that the target characteristic setting method is the same as that described in the first embodiment. Thus, the descriptions thereof are omitted.

As is the case with the FR signal as described above, the number of loudspeakers can be reduced with respect to the FL signal. Specifically, it is possible to localize a sound image of the FL signal in the positions of the respective target sound sources 31FL and 31FR shown in FIG. 14 without using the SR loudspeaker 23.

Figure 17:
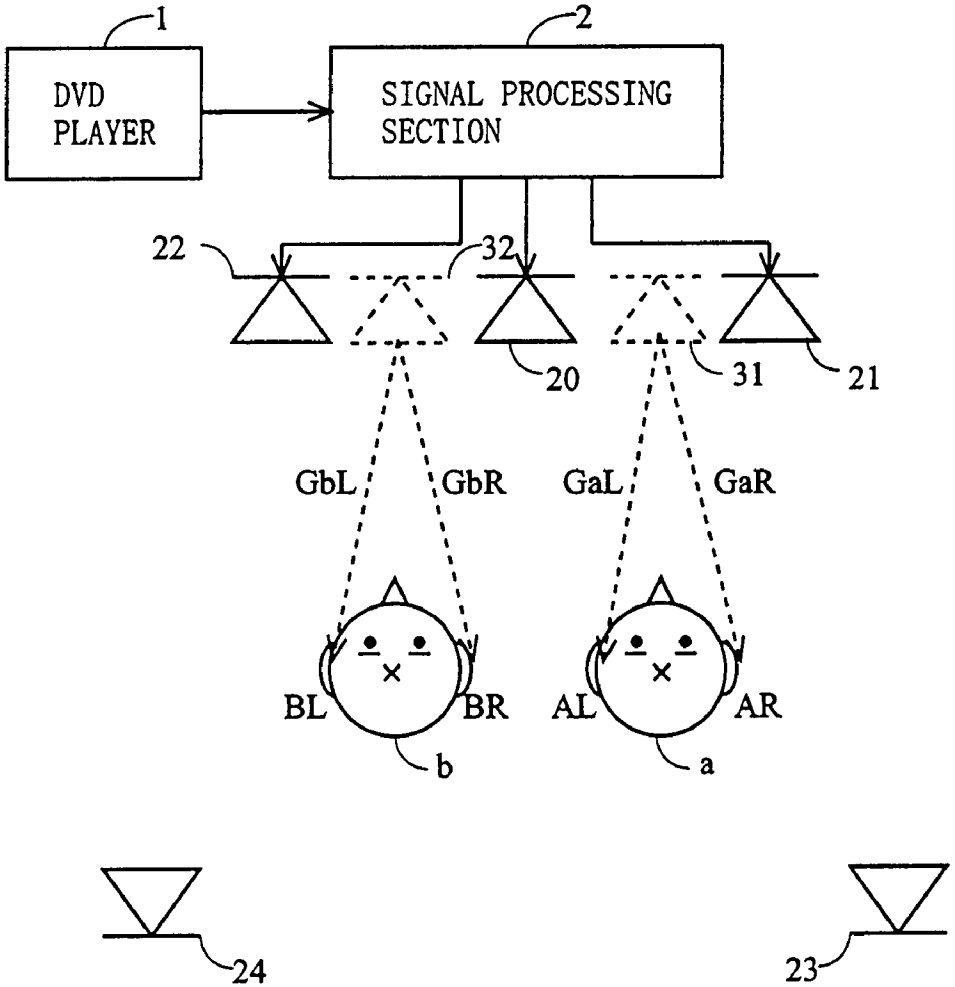
FIG. 17 is an illustration showing a sound image control system performing sound image localization control for a CT signal in the second embodiment of the present invention.

Next, a case where sound image localization control is performed for the CT signal is described. FIG. 17 is an illustration showing a sound image control system performing sound image localization control for the CT signal in the second embodiment. The sound image control system of the second embodiment differs from that (shown in FIG. 9) of the first embodiment in that the SR loudspeaker 23 and the SL loudspeaker 24 are not used as control loudspeakers. The SR loudspeaker 23 and the SL loudspeaker 24 placed at diametrically opposed locations to the target sound sources 31 and 32, respectively, are not used for the same reason as described in the case of the FR signal.

In the case shown in FIG. 17, it may be assumed that the characteristics of the control filters of the signal processing section 2 can not be obtained (that is, solutions of the equations (a) can not be obtained) due to the smaller number of control loudspeakers (the loudspeakers 20 to 22) than that of control points. However, the loudspeakers 20 to 22 (the loudspeakers outputting the sound whose wavefronts are relatively consistent with the target characteristics) are placed in substantially the same direction as those of the target sound sources 31 and 32 with respect to the listeners. Thus, it is possible to obtain the characteristics even if the number of loudspeakers is smaller than that of control points (that is, the three loudspeakers are used for the four control points). Especially, lower frequencies (below about 2 kHz) enhance the localization effect produced by phase control, whereby sound image localization control performed for only lower frequency components of a signal allows control characteristics to be obtained even if the three loudspeakers are used for the four control points. Specifically, the listener generally perceives two types of sound as the same if the phase difference therebetween is within $\lambda/4$ ($\lambda$: wavelength). If a distance between both ears of a person is assumed to be 17 cm, the frequency having a wavelength satisfying $\lambda/4=0.17$ (that is, $\lambda=0.68$) allows one point (a small cross shown in FIG. 17) near the center position between both ears of the listener to be determined as the control point. That is, a frequency below 500 Hz ($f=v/\lambda=340/0.68=500$, v: velocity) allows one control point to be determined. In this case, the number of control points with respect to two listeners is two, which is smaller than the number of loudspeakers, whereby it is possible to obtain the solutions. As a result, it is possible to realize the same localization effect as that in the first embodiment even in the structure shown in FIG. 17 where the number of control filters is smaller than that of the first embodiment. Note that the target characteristic setting method is the same as that described in the first embodiment. Thus, the descriptions thereof are omitted.

Figure 18:
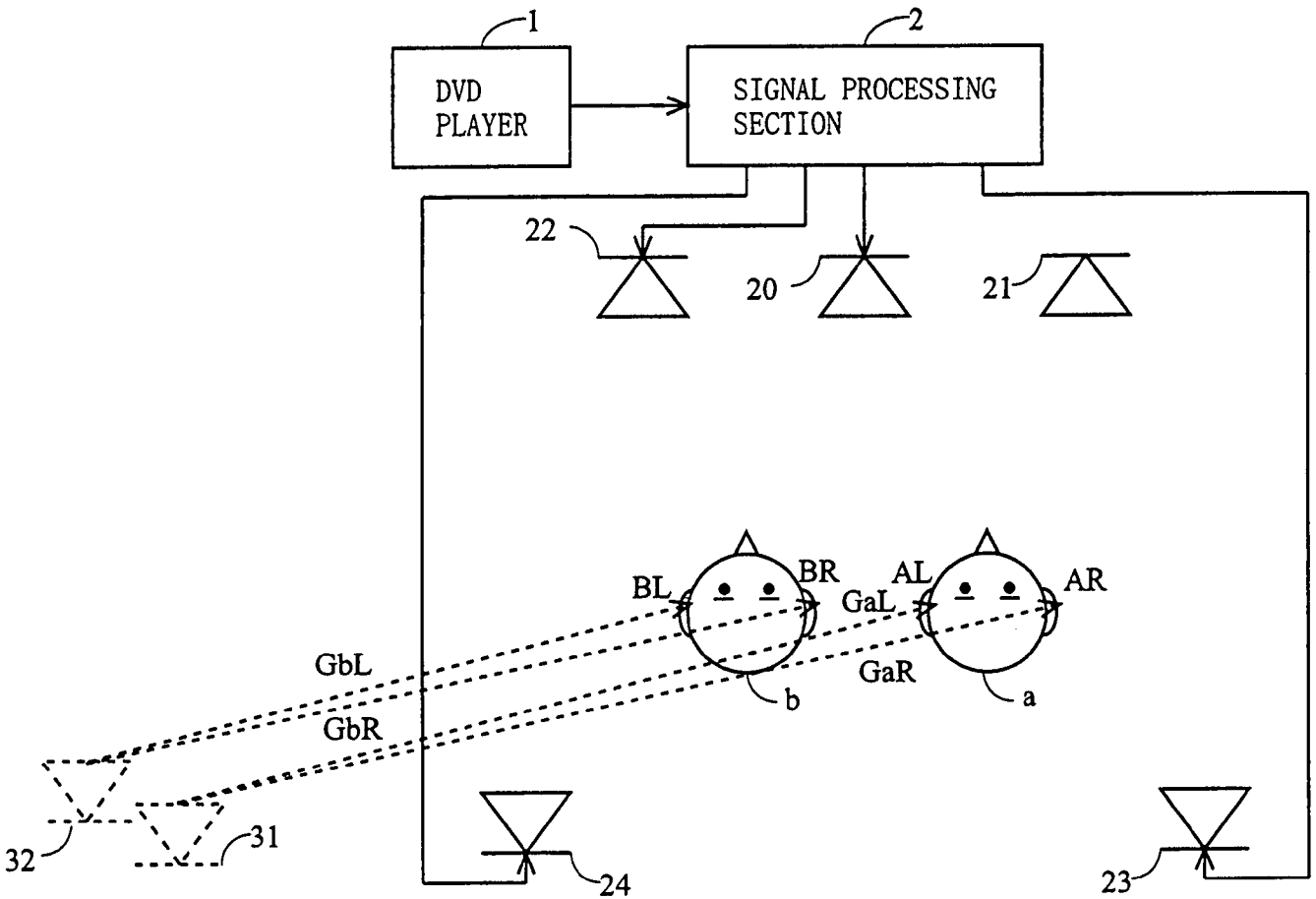
FIG. 18 is an illustration showing a sound image control system performing sound image localization control for an SL signal in the second embodiment of the present invention.

Next, a case where sound image localization control is performed for the SL signal is described. FIG. 18 is an illustration showing a sound image control system performing sound image localization control for the SL signal in the second embodiment. The sound image control system of the second embodiment differs from that of the first embodiment (FIG. 11) in that the FR loudspeaker 21 is not used as the control loudspeaker. The FR loudspeaker 21 placed at a diametrically opposed location to the target sound sources 31 and 32 is not used for the same reason as that described in the case of the FR signal. It is also possible to realize the same localization effect as that in the first embodiment even in the structure shown in FIG. 18 where the number of control filters is smaller than that of the first embodiment. Note that the target characteristic setting method is the same as that described in the first embodiment. Thus, the descriptions thereof are omitted.

As is the case with the SL signal as described above, the number of loudspeakers can be reduced with respect to the SR signal. Specifically, it is possible to localize a sound image of the SR signal in the positions of the respective target sound sources 31SR and 32SR shown in FIG. 14 without using the FL loudspeaker 22.

As described above, in the case where the channel signals are combined using the reduced number of loudspeakers, the entire structure of the sound image control system is the same as that shown in FIG. 14, but the internal structure of the signal processing section 2 differs from that of the first embodiment. Specifically, as described above, the two control filters 103 and 104 shown in FIG. 2 are removed with respect to the CT signal, and the control filter 109 shown in FIG. 2 is removed with respect to the FR signal. Similarly, with respect to the FL, SR, and SL signals, one control filter is removed per signal. As a result, six control filters are removed from the sound image control system, whereby the above-described system advantageously reduces the total amount of calculation of the signal processing section 2, or increases the number of taps of each one of the control filter in order to equalize the amount of calculation.

Figure 19:
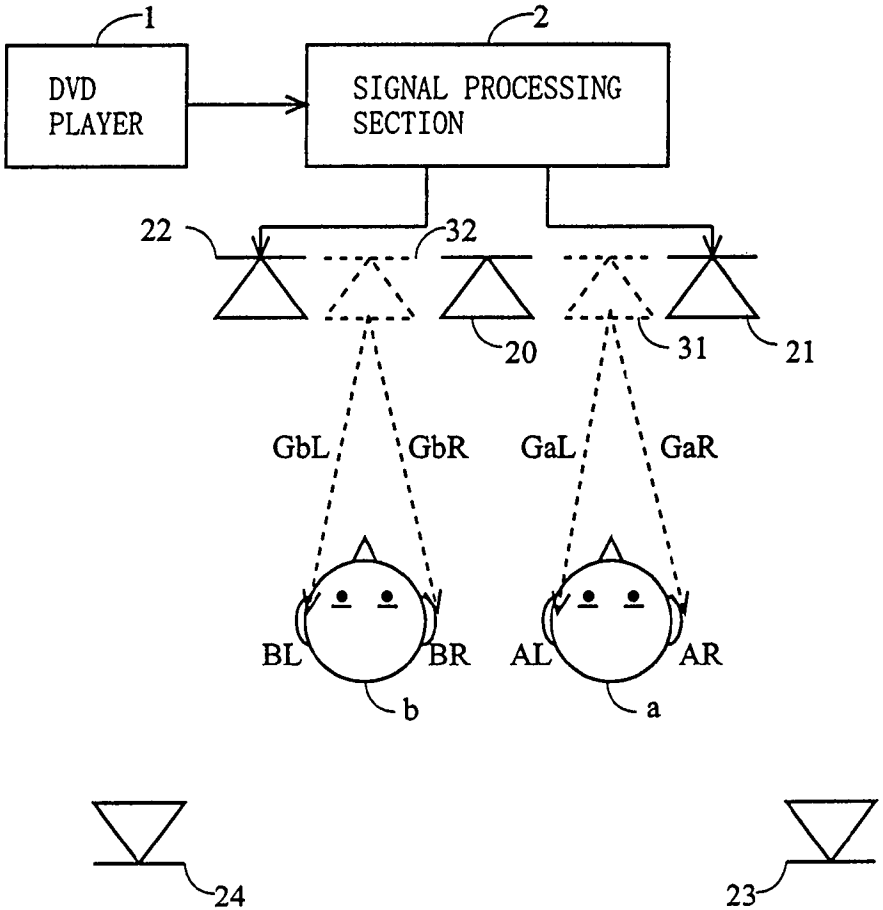
FIG. 19 is an illustration showing the entire structure of the sound image control system performing sound image localization control for, for example, the CT signal in the second embodiment of the present invention.

Note that, as shown in FIG. 19, the structure using only the FR loudspeaker 21 and the FL loudspeaker 22 may be applied to the CT signal. In this case, one control filter can be further removed.

In the first and second embodiments, the case where the number of listeners is two has been described, but the number thereof is not limited thereto. That is, in the case where the number of listeners is equal to or greater than three, control can be performed as described in the first and second embodiments. However, the number of control points is greater than that of the first embodiment in the case where the number of listeners is equal to or greater than three. Thus, it is necessary to increase the number of loudspeakers depending on the number of control points.

In the above-descriptions, no mention has been made of a loudspeaker system or a soundproof room. However, to say nothing of the general system or room, the present invention can also be applied to car audio equipment, etc.

Third Embodiment

Figure 20:
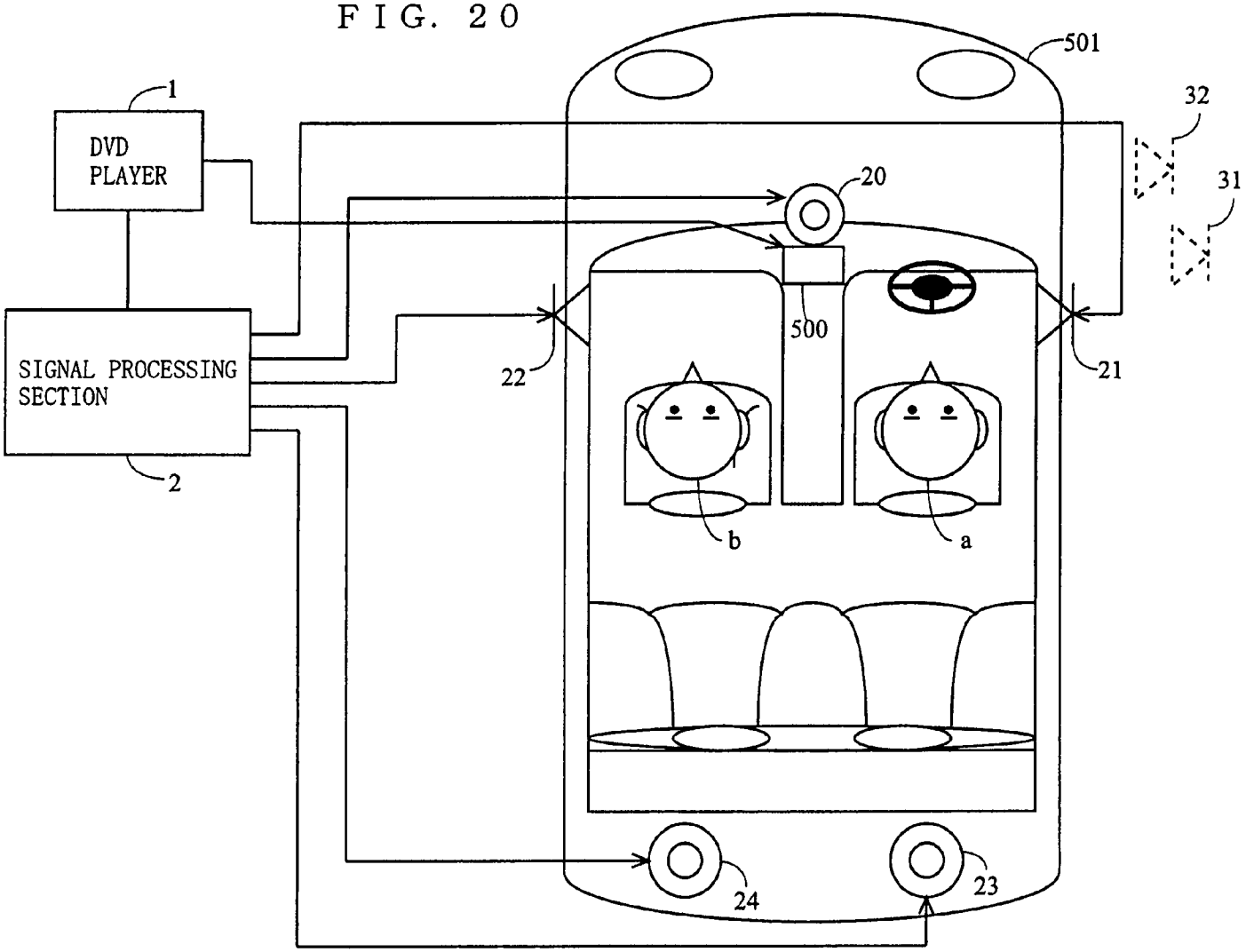
FIG. 20 is an illustration showing a sound image control system according to a third embodiment of the present invention.

Hereinafter, a sound image control system according to a third embodiment is described. FIG. 20 is an illustration showing the sound image control system according to the third embodiment. In FIG. 20, the above-described sound image control system includes the DVD player 1, the signal processing section 2, the CT loudspeaker 20, the FR loudspeaker 21, the FL loudspeaker 22, the SR loudspeaker 23, the SL loudspeaker 24, the target sound source 31 for the listener A, the target sound source 32 for the listener B, a display 500, and a vehicle 501. FIG. 20 shows the structure of the sound image control system (FIG. 1) of the first embodiment, which is applied to a vehicle. As is the case with the first embodiment, the object of the third embodiment is to localize a sound image of the FR signal (and likewise for the other channel signals) in the positions of the target sound sources 31 and 32. In FIG. 20, the loudspeakers 21 and 22 are placed on the front doors (or in the vicinities thereof), respectively, the CT loudspeaker 20 is placed in the vicinity of the center of a front console, and the loudspeakers 23 and 24 are placed on a rear tray. Note that, in the third embodiment, a video signal is also output from the DVD player 1 along with the audio signal. The video signal is reproduced by the display 500.

The space in a vehicle tends to have a complicated acoustic characteristic such as a tendency to form standing waves or strong reverberations, etc., due to its confined small space and the presence of reflective objects, such as a glass, etc., found therein. Therefore, it is rather difficult to perform sound image localization control for a plurality of (in this case, four) control points over the entire frequency range from low to high under the situation where the number of loudspeakers or cost performance, etc., is limited.

In the third embodiment, therefore, the signal is frequency divided relative to a predetermined frequency, and sound image localization control is performed for the lower frequencies for which control can be performed with relative ease. With respect to the crossover frequency for dividing the signals, sound image localization control may be performed for the lower frequencies (for example, below about 2 kHz) whose phase characteristic is important. If a hard-to-control acoustic characteristic is found at frequencies below 2 kHz, the signal may be divided at that point. Hereinafter, an operation of the sound image control system according to the third embodiment is described.

Figure 21:
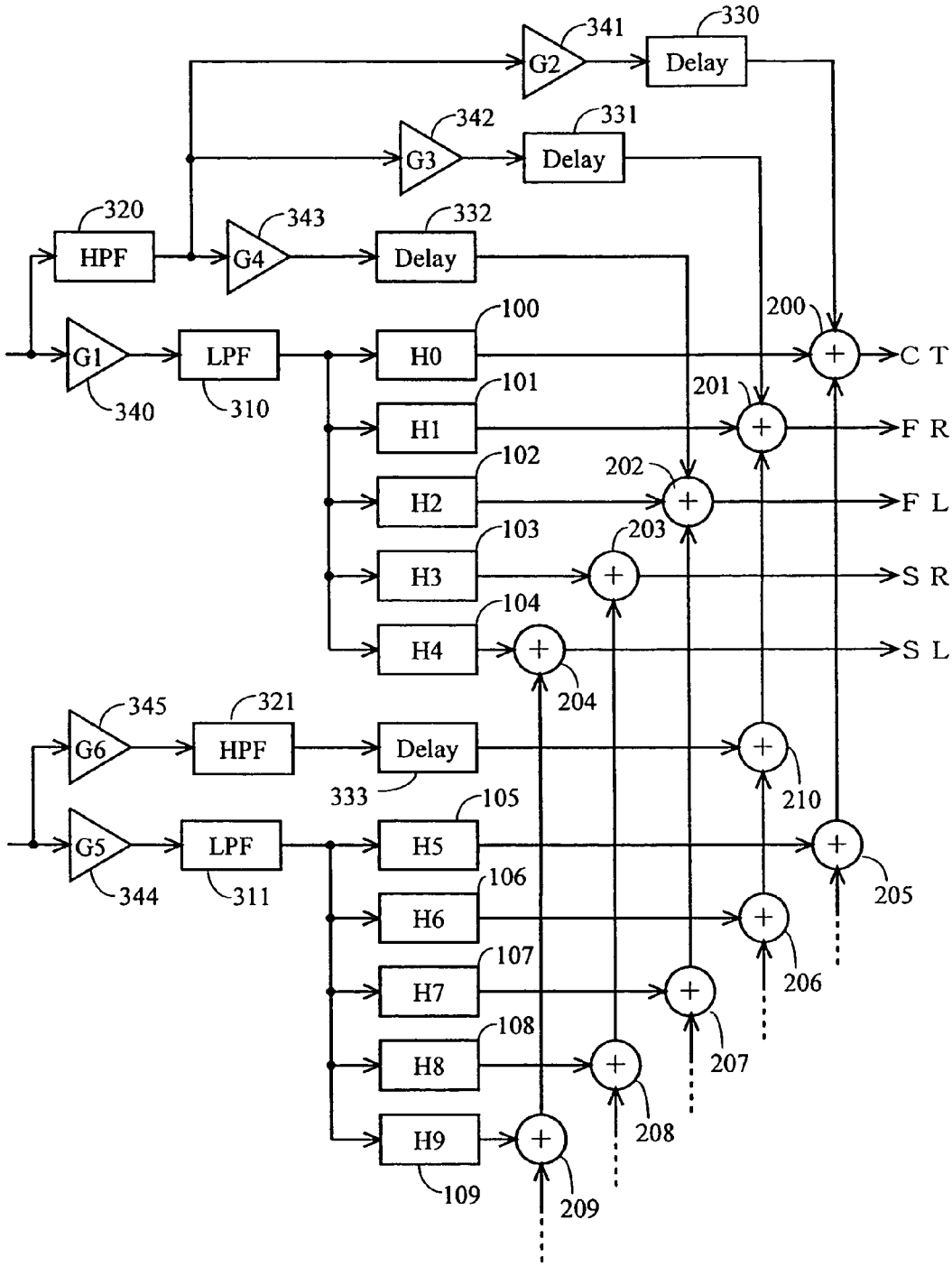
FIG. 21 is an illustration showing the internal structure of the signal processing section 2 of the third embodiment of the present invention.

FIG. 21 is an illustration showing the internal structure of the signal processing section 2 of the third embodiment. In the structure shown in FIG. 21, the input signal (in FIG. 21, only the CT signal and the FR signal are shown) is divided into lower frequencies and high frequencies. Note that an overlap portion of the descriptions between the structure shown in FIG. 2 and that shown in FIG. 21 is omitted.

The structure shown in FIG. 21 includes low-pass filters (hereinafter, referred to as LPF) 310 and 311, high-pass filters (hereinafter, referred to as HPF) 320 and 321, delay devices (in the drawing, denoted as "Delay") 330 to 333, and level adjusters (in the drawing, denoted as "G1" to "G6", respectively) 340 to 345. The input FR signal is subjected to appropriate level adjustment by the level adjusters 344 and 345, and input into the LPF 311 and the HPF 321. The LPF 311 extracts the lower frequency components of the FR signal, and signal processing is performed for the extracted signal by the filters 105 to 109. The filters 105 to 109 operate in a manner similar to those shown in FIG. 2 except that they process the lower frequency components of the signal.

On the other hand, the HPF 321 extracts the higher frequency components of the input signal, and the extracted signal is subjected to time adjustment by the delay device 333. The delay device 333 performs time adjustment for the extracted signal mainly for correcting a time lag between the higher frequency components and the lower frequency components processed by the filter 106. The output signal of the delay device 333 is added by the adder 210 to the output signal of the filter 106, which passes through the adder 206, and input into the FR loudspeaker 21 (in FIG. 21, simply denoted as "FR", and likewise in the other drawings). As described above, the lower frequency components of the input signal are controlled by the filters 105 to 109 so as to be localized in positions of the target sound sources 31 and 32, and the higher frequency components of the input signal are reproduced by the FR signal placed in substantially the same direction of the target sound sources. As a result, even in the space of a vehicle where an acoustic characteristic is complicated, control can be performed so that the listeners A and B can hear the FR signal as if it were reproduced from the target sound sources 31 and 32.

In the above-described case where the input signal (in this case, the FR signal) is divided into lower frequencies and higher frequencies for performing signal processing, the listeners may hear the entire sound image of the FR signal from the positions shifted from those of the target sound sources 31 and 32 due to the higher frequency sound reproduced from the loudspeaker 21. In this case, with respect to the higher frequency components, a sound image can be localized more easily based on the amplitude (sound pressure) characteristic rather than based on the phase characteristic. Thus, it is possible to perform intensity control of sound image localization by dividing the higher frequency components of the signal into two loudspeakers. Hereinafter, a specific example thereof is described.

Figure 22:
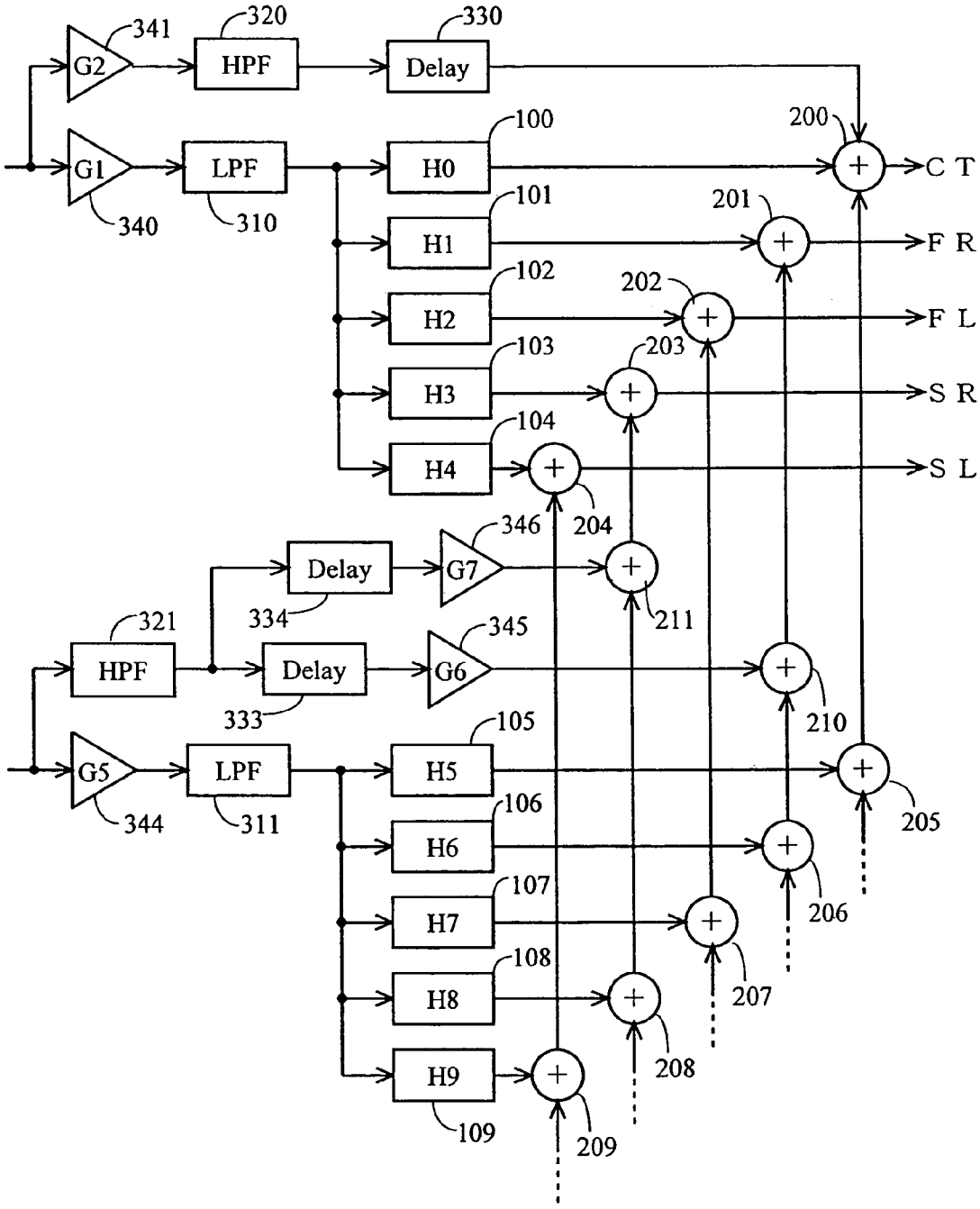
FIG. 22 is an illustration showing the internal structure of the signal processing section 2 in the case where intensity control is performed for higher frequency components of an input signal in the third embodiment of the present invention.

FIG. 22 is an illustration showing the internal structure of the signal processing section 2 in the case where intensity control is performed for the higher frequency components of the input signal in the third embodiment. In the structure shown in FIG. 22, the higher frequency components of the FR signal are divided into the FR loudspeaker 21 and the SR loudspeaker 23, and intensity control is performed by the level adjusters 345 and 346.

The FL signal is processed, as is the case with the FR signal. That is, the higher frequency components of the FL signal can be reproduced from the FL loudspeaker 22 alone, or can be subjected to intensity control using the FL loudspeaker 22 and the SL loudspeaker 24.

Figure 23:
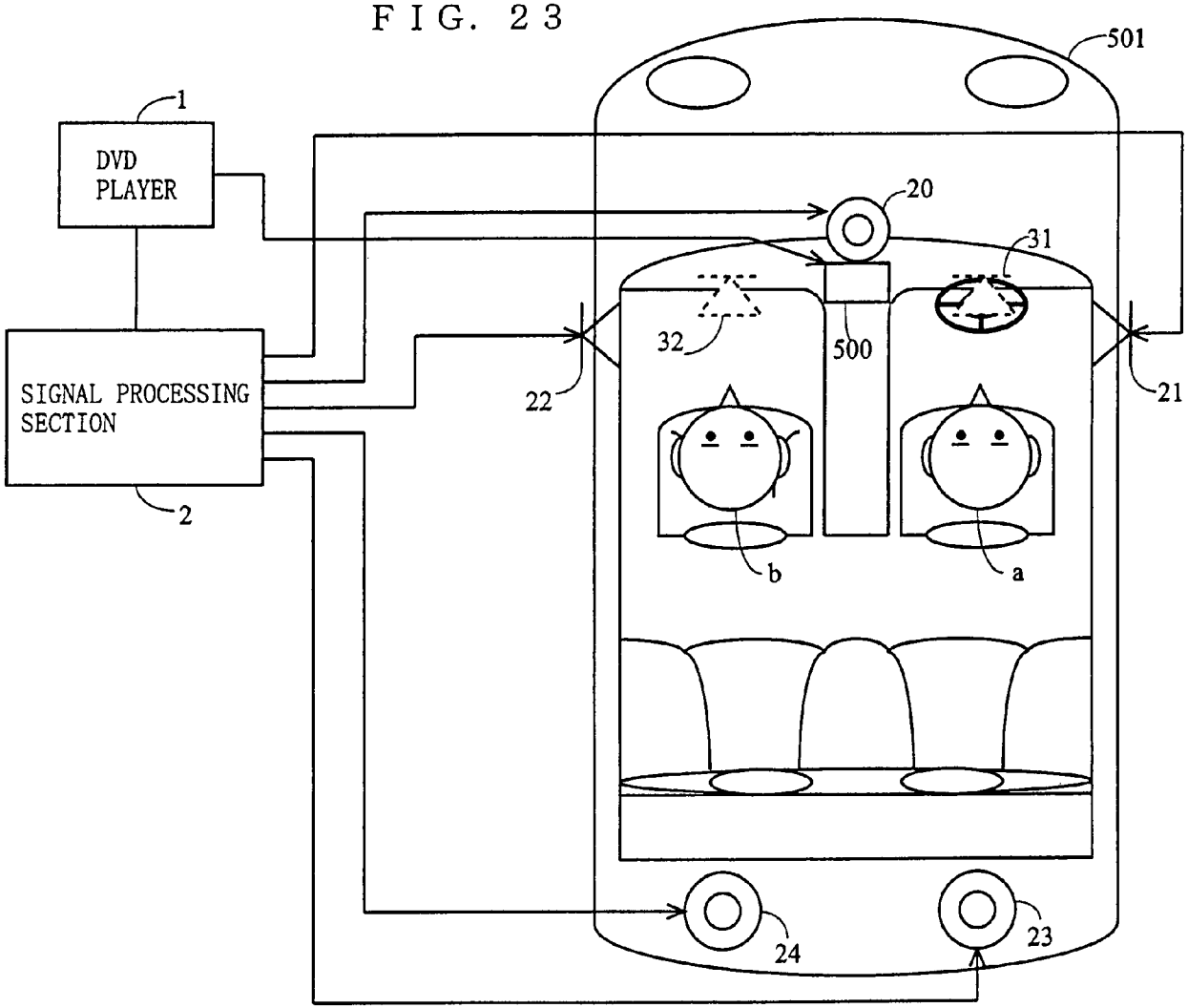
FIG. 23 is an illustration showing a sound image control system performing sound image localization control for the CT signal in the third embodiment of the present invention.

Next, a case where sound image localization control is performed for the CT signal is described. FIG. 23 is an illustration showing a sound image control system performing sound image localization control for the CT signal in the third embodiment In FIG. 23, the target sound sources 31 and 32 are set in the respective fronts of the listeners A and B. Note that the structure (including the structure of the signal processing section 2) of the sound image control system is the same as that described in FIG. 20.

In FIG. 21, the lower frequency components of the CT signal are extracted by the LPF 310, and signal processing is performed for the extracted signal by the filters 100 to 104. The filters 100 to 104 operate in a manner similar to those shown in FIG. 2 except that they process the lower frequency components of the signal.

On the other hand, the higher frequency components of the CT signal are extracted by the HPF 320. The extracted signal is subjected to appropriate level adjustment by the level adjusters 341 and 343 so as to be subjected to intensity control for localizing a sound image of the extracted signal at the respective fronts of the listeners A and B. The level adjusted signals are subjected to time adjustment by the respective delay devices 330 to 332, added to the outputs from the respective filters 100 to 102 by the adders 200 to 202, and input into the CT loudspeaker 20. The delay devices 330 to 332 perform time adjustment for the extracted signal for correcting a time lag between the higher frequency components and the lower frequency components processed by the filters 100 to 104, which are perceived by both ears of the listeners A and B, for example. As described above, the lower frequency components of the CT signal are subjected to sound image localization control by the filters 100 to 104, and the higher frequency components of the CT signal are subjected to intensity control. Thus, it is possible to allow the listeners A and B to hear the CT signal as if it were reproduced from the respective target sound sources 31 and 32.

Figure 24:
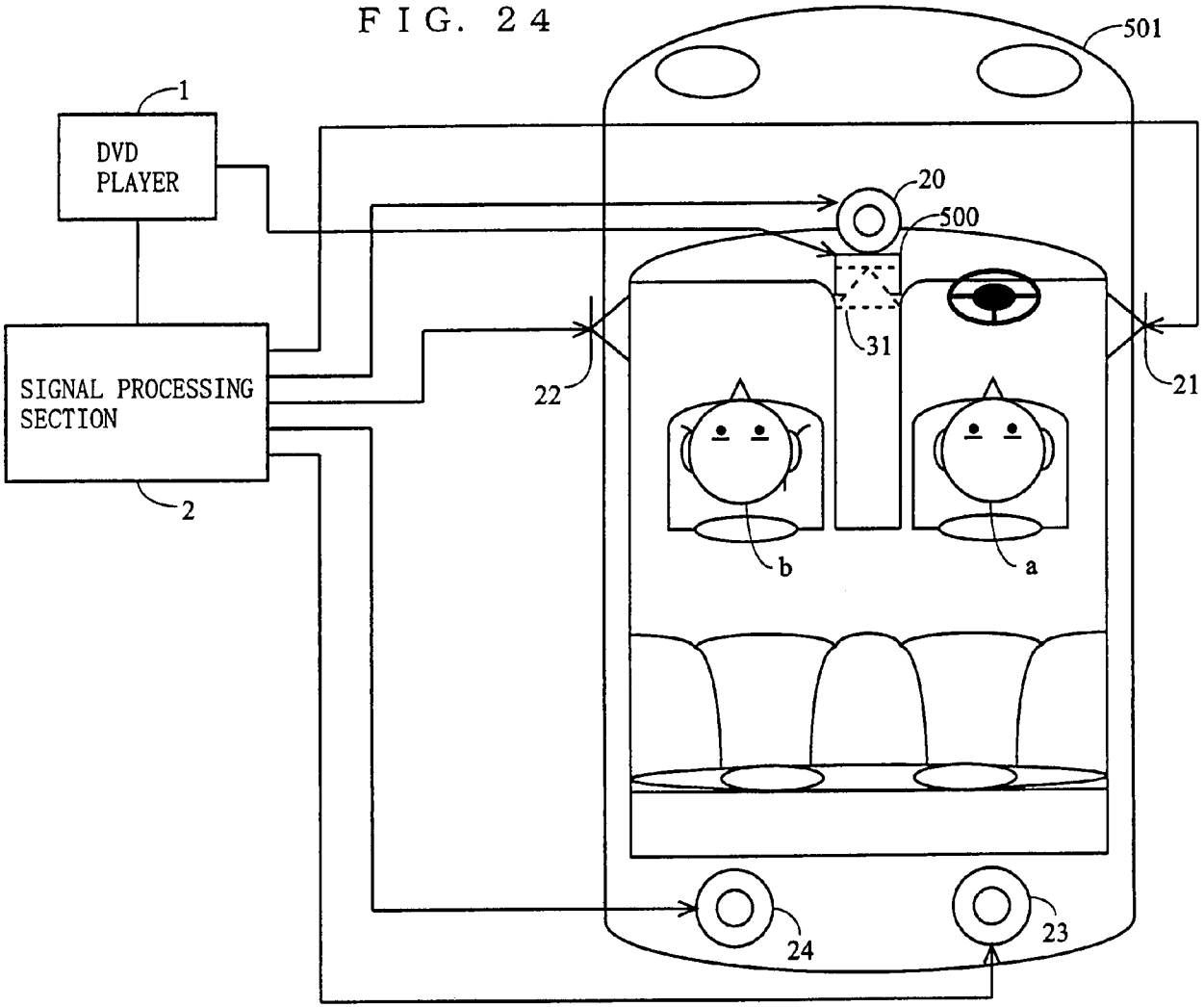
FIG. 24 is an illustration showing a sound image control system performing sound image localization control for the CT signal in the third embodiment of the present invention.

FIG. 24 is an illustration showing a sound image control system performing sound image localization control for the CT signal in the third embodiment. FIG. 24 differs from FIG. 23 in that the target sound source 31 (in this case, the target sound source 31 is a single target sound source equidistant from the listeners A and B) of the CT signal is set in a position of the display 500. In the case where video reproduction as well as audio reproduction is performed, it is effective to set the target sound source in the position of the display 500 because it is natural for a listener to hear a speech of a movie or vocals of a singer from a position where video is reproduced, that is, the position of the display 500. Note that the target sound source 31 shown in FIG. 24 is set in a manner similar to that described in FIG. 15.

In the case where the target sound source 31 shown in FIG. 24 is set, the signal processing section 2 is structured, for example, as shown in FIG. 22. In FIG. 22, the lower frequency components of the CT signal are extracted by the LPF 310, and signal processing is performed for the extracted signal by the filters 100 to 104. On the other hand, the higher frequency components of the CT signal are extracted by the HPF 320, and the extracted signal is subjected to time adjustment by the delay device 330. Furthermore, the time adjusted signal is added to the output from the filter 100 by the adder 200, and input into the CT loudspeaker 20. The delay device 330 performs time adjustment for the extracted signal in order to correct a time lag between the higher frequency components and the lower frequency components processed by the filters 100 to 104, which are perceived by both ears of the listeners A and B, for example. Note that a level of the sound pressure added by the adder 200 may be adjusted by the level adjusters 340 and 341. As described above, the lower frequency components of the CT signal are subjected to sound image localization control by the filters 100 to 104, and the higher frequency components of the CT signal are reproduced from the CT loudspeaker 20 placed in the vicinity of the display 500. As a result, it is possible to allow the listeners A and B to hear the CT signal as if it were reproduced from the display 500 shown in FIG. 24.

Figure 25:
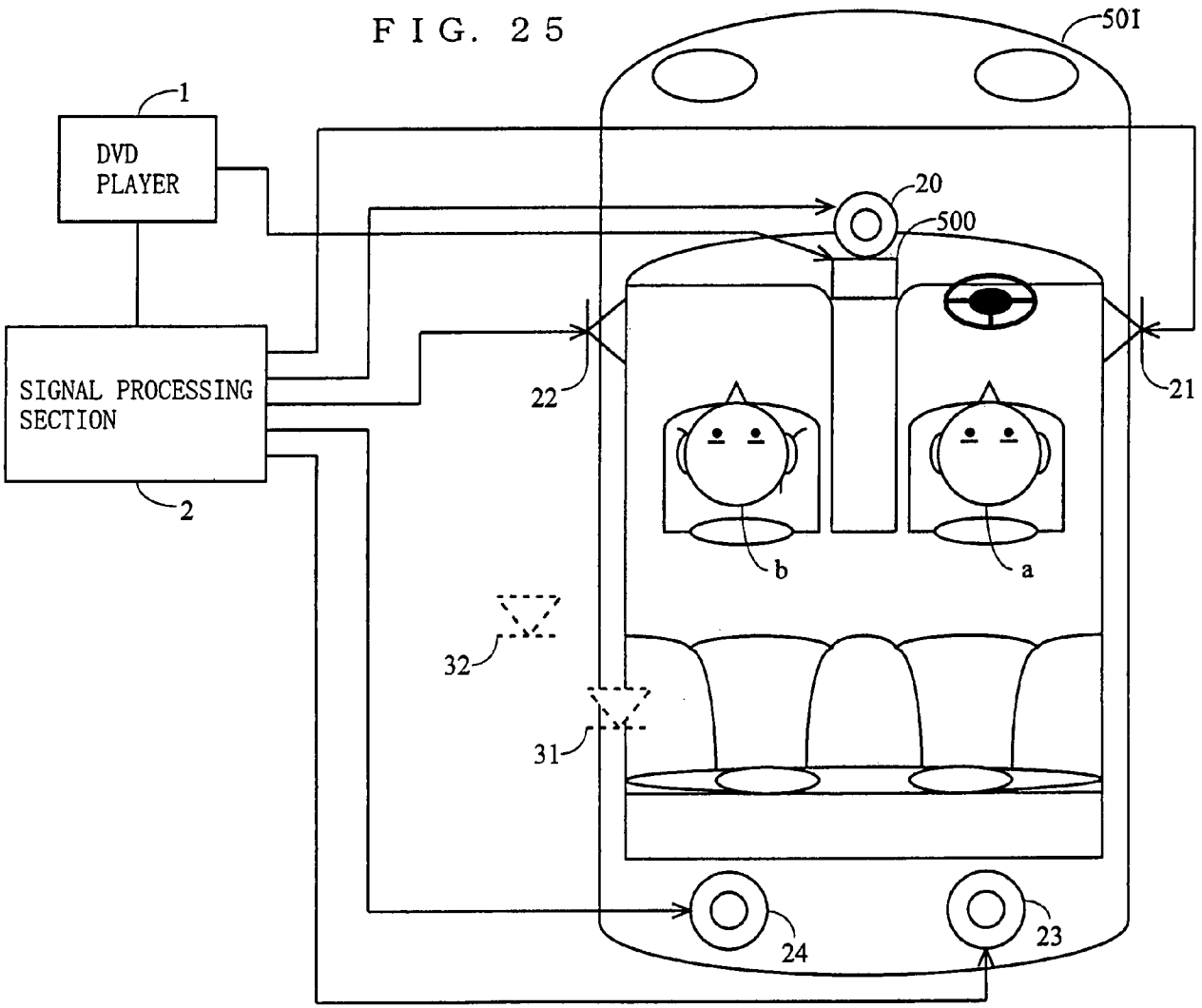
FIG. 25 is an illustration showing a sound image control system performing sound image localization control for the SL signal in the third embodiment of the present invention.

Next, a case where sound image localization control is performed for the SL signal is described. FIG. 25 is an illustration showing a sound image control system performing sound image localization control for the SL signal in the third embodiment. In FIG. 25, the target sound sources 31 and 32 are set in to the left rear of the listeners A and B, respectively.

Figure 26:
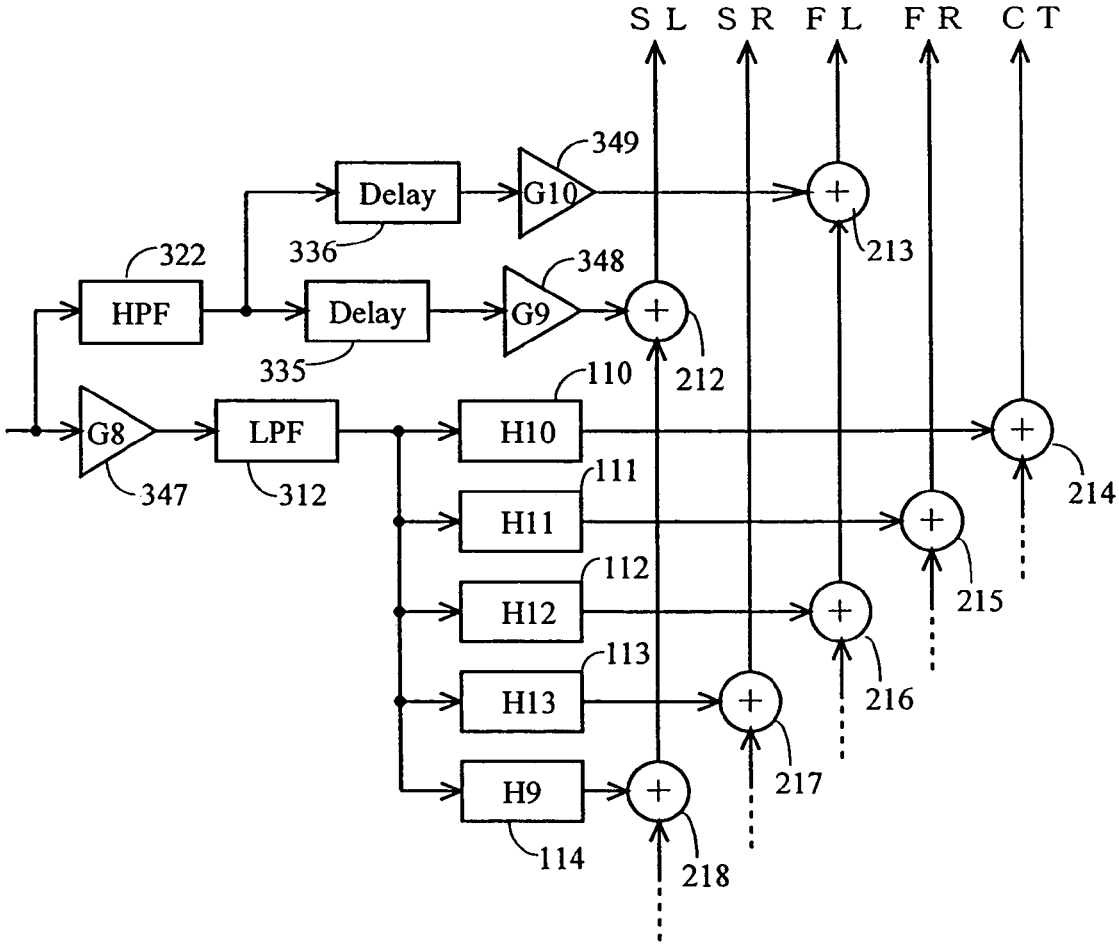
FIG. 26 is an illustration showing the internal structure of the signal processing section 2 of the third embodiment of the present invention.

FIG. 26 is an illustration showing the internal structure of the signal processing section 2 of the third embodiment. In FIG. 26, the lower frequency components of the SL signal are extracted by the LPF 312, and signal processing is performed for the extracted signal by filters 110 to 114. On the other hand, the higher frequency components of the SL signal are extracted by the HPF 322, and the extracted signal is subjected to time adjustment by the delay devices 335 and 336. The delay devices 335 and 336 perform time adjustment for the extracted signal for correcting a time lag between the higher frequency components and the lower frequency components processed by the filters 110 to 114, which are perceived by both ears of the listeners A and B, for example. The time adjusted signal is subjected to appropriate level adjustment by the level adjusters 348 and 349 so as to be subjected to intensity control for localizing a sound image of the extracted signal in the positions of the target sound sources 31 and 32 shown in FIG. 25. The level adjusted signals are added to the outputs from the filters 112 and 114 by the respective adders 212 and 213, and input into the SL loudspeaker 24 and the FL loudspeaker 22, respectively. As described above, the lower frequency components of the SL signal are subjected to sound image localization control by the filters 110 to 114, and the higher frequency components of the SL signal are subjected to intensity control. Thus, it is possible to allow the listeners A and B to hear the SL signal as if it were reproduced in the positions of the target sound sources 31 and 32 shown in FIG. 25.

As is the case with the SL signal, it is possible to process the SR signal. That is, the higher frequency components of the SR signal can be reproduced from the SR loudspeaker 23 alone, or can be subjected to intensity control in the SR loudspeaker 23 and the FR loudspeaker 21.

Figure 27:
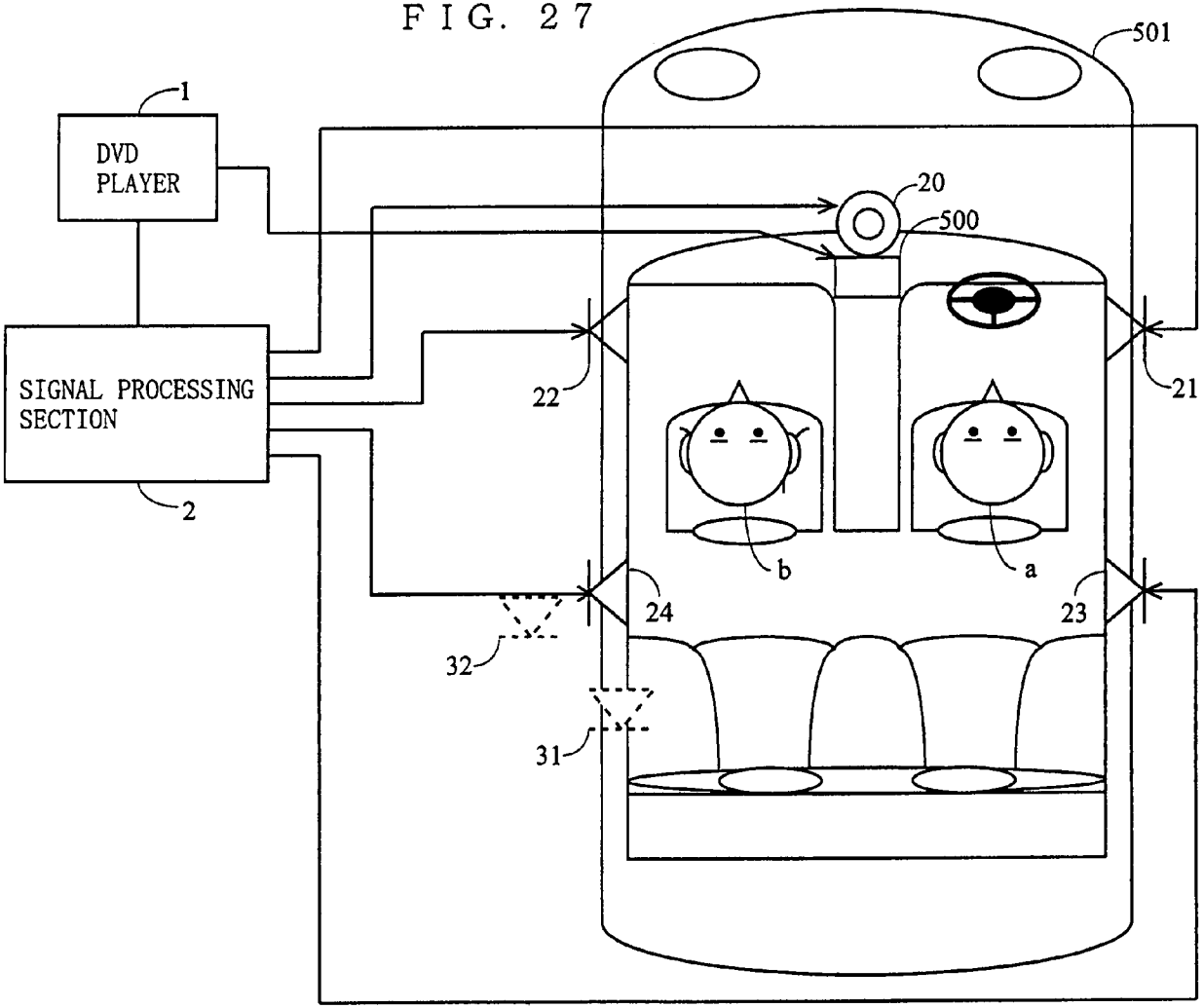
FIG. 27 is an illustration showing a sound image control system performing sound image localization control for the SL signal in the case where the loudspeakers are placed in different positions from those shown in FIGS. 20 and 23 to 25.

Note that the above-described control can be performed in the case where the loudspeakers are placed in positions different from those shown in FIGS. 20 and 23 to 25. FIG. 27 is an illustration showing a sound image control system performing sound image localization control for the SL signal in the case where the loudspeakers are placed in different positions from those shown in FIGS. 20 and 23 to 25. In FIG. 27, the SR loudspeaker 23 and the SL loudspeaker 24 are placed on the right rear door and the left rear door of the vehicle, respectively.

In FIG. 27, the target sound sources 31 and 32 of the SL signal are set in substantially the same position as that of the SL loudspeaker 24. Therefore, the higher frequency components of the SL signal may be reproduced from the SL loudspeaker 24. Also, the entire band of the SL signal may be reproduced from the SL loudspeaker 24 without performing sound image localization control for the entire band thereof for the same reason as described above. In this case, the delay device 335 shown in FIG. 26 is used for adjusting time of the SL signal to time of the other channel signals. As described above, in the case where the target sound source is set in substantially the same position of the loudspeaker, it is possible to remove the filters 110 to 114, the LPF 312, and the HPF 322.

As described above, the methods for controlling the respective five channel signals in the case where the sound image control system is applied to the space in the vehicle are described. Therefore, if all the signals are combined as described in FIG. 14, it is possible to concurrently perform sound image localization control for the 5 channel signals.

In the above-described third embodiment, the four control points are assumed to be two pairs of ears of each of the listeners in the front seats of the vehicle. However, the positions of the control points are not limited thereto, and positions of both ears of both listeners in the backseat may be assumed to be the controls points.

Fourth Embodiment

Hereinafter, a sound image control system according to a fourth embodiment is described. The sound image control system according to the fourth embodiment is also applied to the vehicle, as is the case with the third embodiment, and a case where the number of control loudspeakers is smaller than that of control points, as is the case with the second embodiment, will be described. Note that, with respect to the FR, FL, SR, and SL signals, the method for reducing the number of control loudspeakers is the same as that described in the second embodiment, and the higher frequency components of the signals are processed in a manner similar to that described in the third embodiment. On the other hand, with respect to the CT signal, the method for reducing the number of control loudspeakers may be the same as that described in the second embodiment, or may be a method that will be described below.

Figure 28:
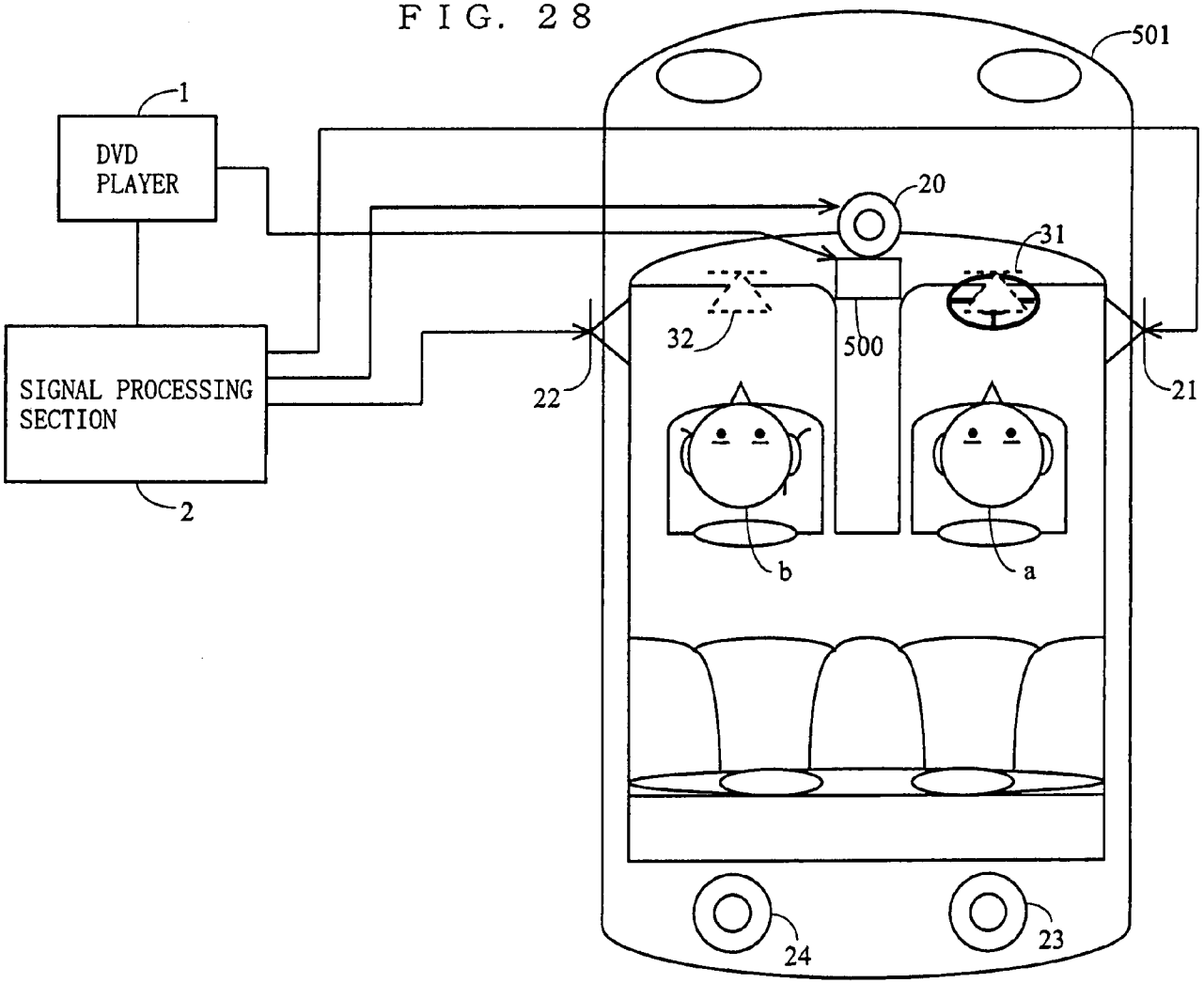
FIG. 28 is an illustration showing a sound image control system performing sound image localization control for the CT signal in a fourth embodiment of the present invention.
Figure 29:
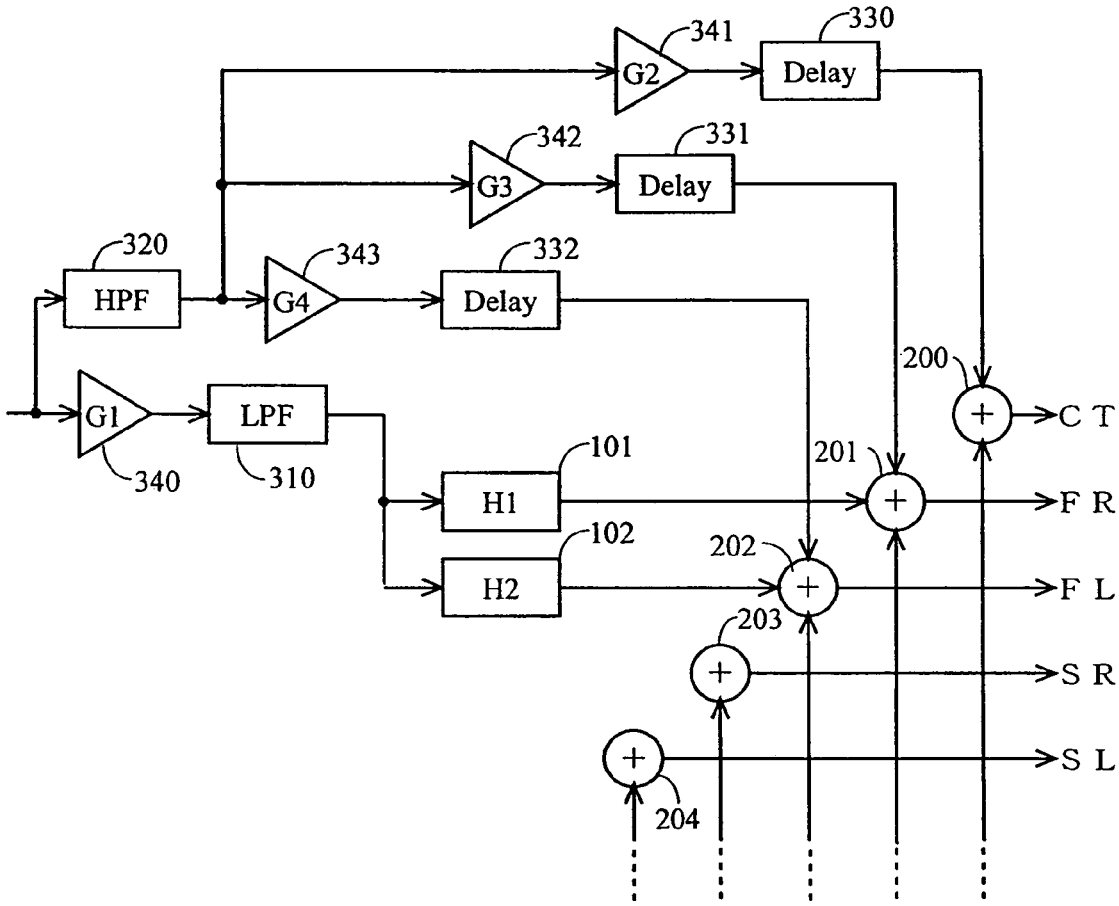
FIG. 29 is an illustration showing the internal structure of the signal processing section 2 of the fourth embodiment of the present invention.

In the fourth embodiment, the lower frequency components of the CT signal are subjected to sound image localization control using the two loudspeakers, that is, the FR loudspeaker 21 and the FL loudspeaker 22, and the higher frequency components of the CT signal are subjected to control using the CT loudspeaker. That is, with respect to the lower frequency components of the CT signal, the four control points are controlled by the two loudspeakers 21 and 22 due to long wavelength of the lower frequency components. The higher frequency components of the CT signal are subjected to intensity control in the three loudspeakers 20 to 22. FIG. 28 is an illustration showing a sound image control system performing sound image localization control for the CT signal in the fourth embodiment. As shown in FIG. 28, the CT signal is not input into the SR loudspeaker 23 and the SL loudspeaker 24 when the CT signal is controlled. FIG. 29 is an illustration showing the internal structure of the signal processing section 2 of the fourth embodiment. Note that, with respect to the CT signal, the signal processing section 2 shown in FIG. 29 operates in a manner similar to that shown in FIG. 21 except that it has the smaller number of filters than that shown in FIG. 21. Thus, the detailed descriptions of the operation thereof are omitted.

In FIG. 29, only the higher frequency components of the CT signal are input into the CT loudspeaker 20. That is, the CT loudspeaker 20 is only required to reproduce the higher frequency components. Thus, it is possible to use a small loudspeaker such as a tweeter, for example, as the CT loudspeaker. In general, the CT loudspeaker 20 is not allowed to occupy a wide space (especially, in the vehicle), whereby it is often difficult to place the CT loudspeaker 20. Therefore, as described in the fourth embodiment, the use of the small loudspeaker as the CT loudspeaker 20 allows the CT loudspeaker 20 to be placed in the narrow space, for example, in the vehicle. Furthermore, if the CT loudspeaker 20 can be built into the display 500, thereby resulting in space savings.

Figure 30:
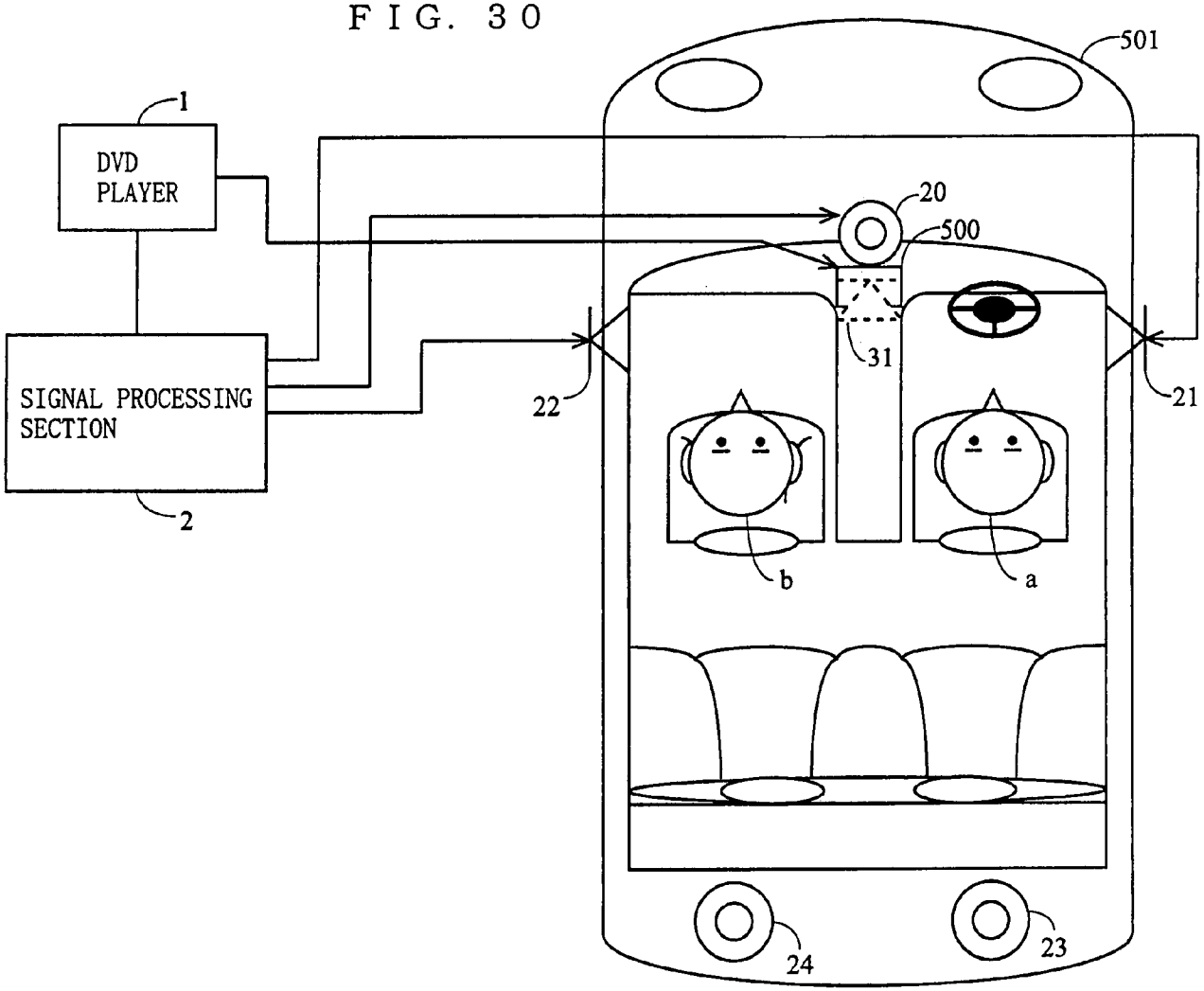
FIG. 30 is an illustration showing a case where a target sound source position of the CT signal is set in a position of a display 500 in the third embodiment of the present invention.
Figure 31:
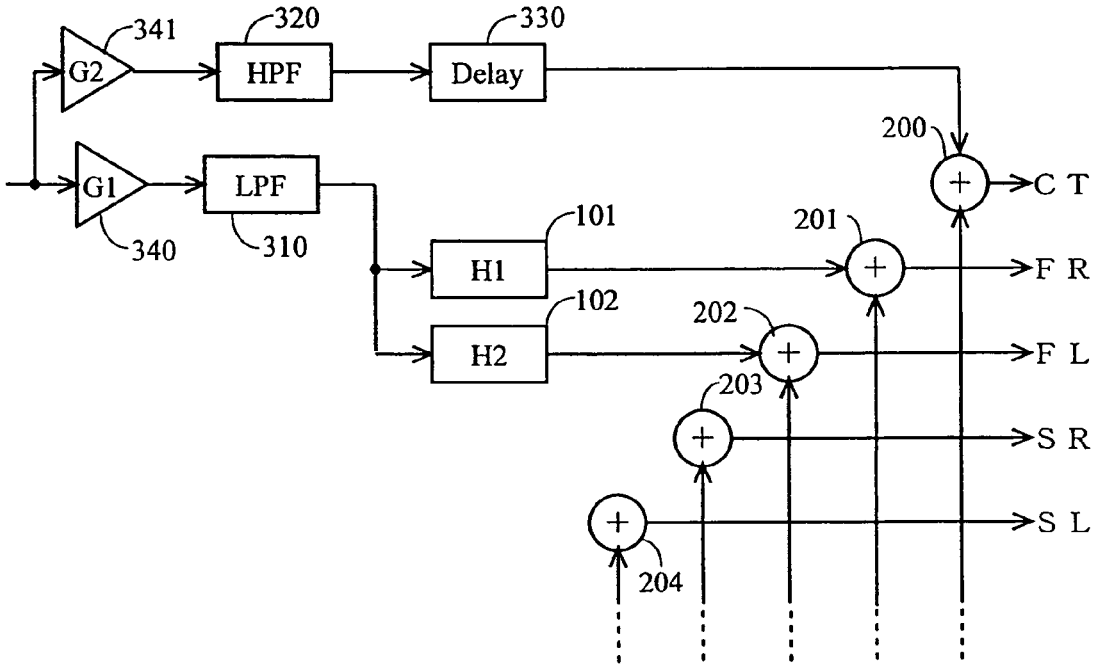
FIG. 31 is an illustration showing the internal structure of the signal processing section 2 localizing a sound image in the target sound source position shown in FIG. 30.

Note that, in the forth embodiment, the target sound source of the CT signal may be set in the position of the display 500. FIG. 30 is an illustration showing a case where a target sound source position of the CT signal is set in the position of the display 500 in the third embodiment. As shown in FIG. 30, the target sound source 31 (in this case, the target sound source 31 is a single target sound source equidistant from the listeners A and B) of the CT signal is set in the position of the display 500. In this case, the structure of the signal processing section 2 is assumed to be that shown in FIG. 31, for example. FIG. 31 is an illustration showing the internal structure of the signal processing section 2 localizing a sound image in the target sound source position shown in FIG. 30. The structure shown in FIG. 31 differs from that shown in FIG. 29 in that the higher frequency components of the CT signal are input into the CT loudspeaker 20 alone. Thus, the detailed descriptions thereof are omitted. Note that, in this case, the CT loudspeaker 20 is assumed to be built into the display 500, or placed in the vicinity of the display 500.

Note that, in the fourth embodiment, the four control points are assumed to be two pairs of ears of each of both listeners in the front seats of the vehicle. However, the positions of the control points are not limited thereto, and positions of both ears of both listeners in the backseat may be assumed to be the controls points.

Also, in the fourth embodiment, the case where the sound image control system is applied to the space in the vehicle has been described. As another embodiment, for example, the sound image control system may be applied by using a television and an audio system for home use. Specifically, as is the case with the fourth embodiment, if the CT loudspeaker 20 can be used as a higher frequency driver, it is possible to use a loudspeaker built into the television and audio loudspeakers as the CT loudspeaker 20 and the other loudspeakers, respectively.

Fifth Embodiment

Figure 32:
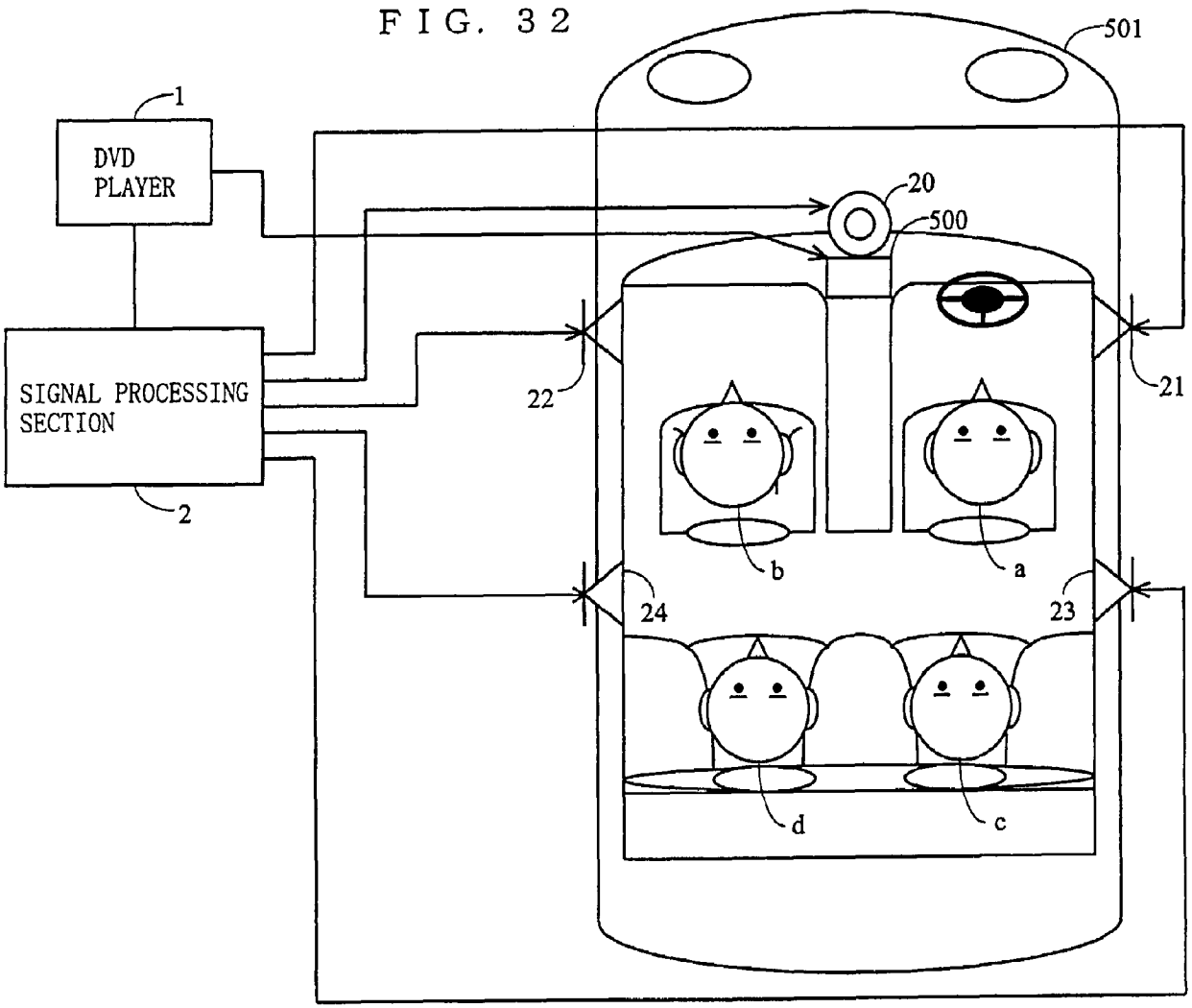
FIG. 32 is an illustration showing an outline of a sound image control system according to a fifth embodiment of the present invention.

Hereinafter, a sound image control system according to a fifth embodiment is described. FIG. 32 is an illustration showing an outline of the sound image control system according to the fifth embodiment. In the fifth embodiment, listeners in the backseat of the vehicle are taken into consideration. That is, as shown in FIG. 32, a case where the four listeners A to D sit in the vehicle is described in the fifth embodiment.

Figure 33:
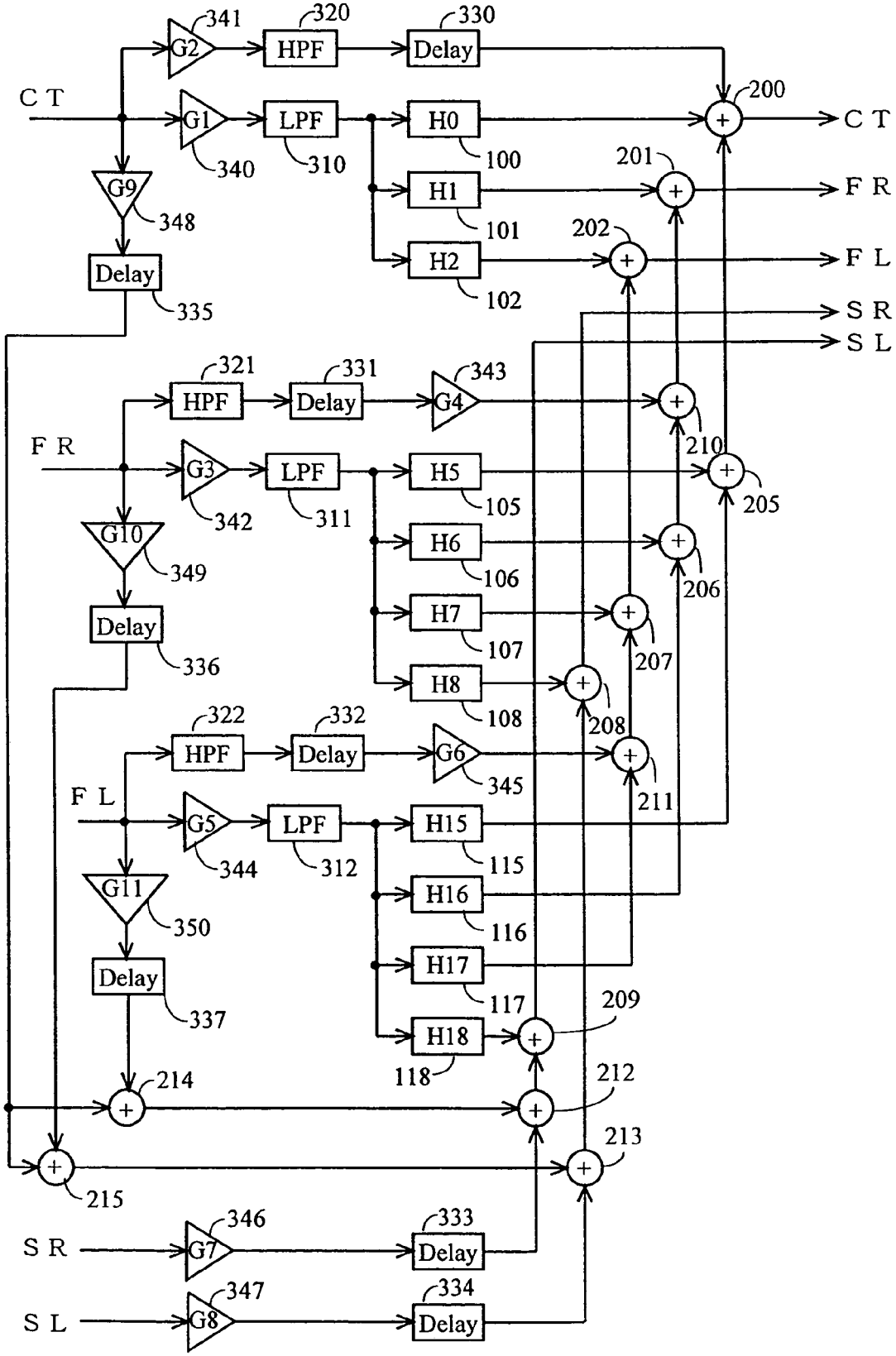
FIG. 33 is an illustration showing the structure of the signal processing section 2 of the fifth embodiment of the present invention.

FIG. 33 is an illustration showing the structure of the signal processing section 2 of the fifth embodiment. The signal processing section 2 shown in FIG. 33 performs sound image localization control for the two listeners A and B in the front seats, and reproduces all the channel signals for the two listeners C and D in the backseat from the rear loudspeakers 23 and 24 (denoted with the same reference numbers due to the correspondence with the above-described SR loudspeaker 23 and SL loudspeaker 24), thereby preventing information for the listeners in the backseat from being degraded or missed. Furthermore, in this case, a sound image of the CT signal is assumed to be localized in the position of the display 500. However, the target sound source position of the CT signal is not limited thereto, and it may be set in the respective fronts of the listeners A and B as described above. Hereinafter, an operation of the signal processing section 2 is described in detail.

The lower frequency components of the CT signal are extracted by the LPF 310, and the signal processing is performed for the extracted signal by the filters 100 to 102 so as to perform sound image localization control. On the other hand, an appropriate time delay is applied by the delay device 330 to the higher frequency components of the CT signal, which are extracted by the HPF 320, and the time delayed signal is added to the output from the filter 100 by the adder 200. The output signals from the filters 100 to 102 and the higher frequency components of the CT signal are input into the respective loudspeakers 20 to 22, and reproduced therefrom. Thus, it is possible to localize a sound image of the CT signal in the position of the display 500.

Note that the rear loudspeakers 23 and 24 are not used in the structure shown in FIG. 33, but the above-described two loudspeakers may be used therein. However, sound image or the quality of sound, for example, in the backseat has to be taken into consideration. The structure shown in FIG. 33 allows an undesirable effect in the backseat caused by sound image localization control by the filters 100 to 102 to be minimized, and also allows the excellent sound image localization effect to be obtained with respect to the front seats because only the front speakers 20 to 22 placed in the same direction as that of the target sound sources are used.

The lower frequency components of the FR signal are extracted by the LPF 311, and signal processing is performed for the extracted signal by the filters 105 to 108 so as to perform sound image localization control. On the other hand, an appropriate time delay is applied by the delay device 331 to the higher frequency components of the FR signal, which are extracted by the HPF 321, and the time delayed signal is added to the output from the filter 106 by the adder 210. The outputs from the filters 105 to 108 and the higher frequency components are input into and reproduced from the loudspeakers 20 to 23, thereby performing sound image localization control for the FR signal.

Note that the rear loudspeaker 24 (the SL loudspeaker) is not used in the structure shown in FIG. 33, but the above-described loudspeaker may be used therein. Also, the higher frequency components of the FR signal is reproduced by the FR loudspeaker 21 alone in the structure shown in FIG. 33, but intensity control may be performed by a plurality of loudspeakers, as is the case with the third embodiment. However, sound image or the quality of sound, for example, in the backseat has to be taken into consideration. The structure shown in FIG. 33 allows an undesirable effect in the backseat caused by sound image localization control by the filters 105 to 108 to be minimized, and also allows the excellent sound image localization effect to be obtained with respect to the front seats.

As is the case with the FR signal, it is possible to process the FL signal. That is, the lower frequency components of the FL signal are extracted by the LPF 312, and signal processing is performed for the extracted signal by filters 115 to 118 so as to perform sound image localization control. On the other hand, an appropriate time delay is applied by the delay device 322 to the higher frequency components of the FL signal, which are extracted by the HPF 322, and the time delayed signal is added to the output from the filter 117 by the adder 211. The outputs from the filters 115 to 118 and the higher frequency components are reproduced from the loudspeakers 20 to 22, and 24, thereby performing sound image localization control for the FL signal.

Note that the rear loudspeaker 23 (the SR loudspeaker) is not used in the structure shown in FIG. 33, but the above-described loudspeaker may be used therein. Also, the higher frequency components of the FL signal are reproduced from the FL loudspeaker 22 alone in the structure shown in FIG. 33, but intensity control may be performed by a plurality of loudspeakers, as is the case with the third embodiment. However, sound image or the quality of sound, for example, in the backseat has to be taken into consideration. The structure shown in FIG. 33 allows an undesirable effect in the backseat caused by sound image localization control by the filters 115 to 118 to be minimized, and also allows the excellent sound image localization effect to be obtained with respect to the front seats.

The SR signal is subjected to appropriate level adjustment by the level adjuster 347, and an appropriate time delay is applied to the resultant signal by the delay device 334, and reproduced from the SR loudspeaker 23. That is, in the fifth embodiment, the SR signal is not subjected to sound image localization control by the filters. This is because, if sound image localization control is also performed for the front seats with respect to the SR signal in the case where the listeners C and D sit in the backseat and the listeners A and B sit in the front seats, those rear loudspeakers have significant effects on the listeners C and D closer thereto, and the quality of sound, etc., for the listeners C and D is highly likely to be degraded. Note that, in the case where the rear loudspeakers 23 and 24 are placed on the respective rear doors as shown in FIG. 27, the target sound source positions are relatively close to the positions of the rear loudspeakers 23 and 24, thereby obtaining a surround effect with ease without performing sound image localization control. Therefore, in this case, the necessity to perform sound image localization control for the SR signal by the filters may be small. Note that, as is the case with the SR signal, sound image localization control is also not performed for the SL signal for the same reason. As described above, sound image localization control with respect to all the channel signals is performed for the listeners A and B in the front seats shown in FIG. 32.

Next, sound image localization control performed for the backseat will be described. In the structure described in the first to fourth embodiments where only the front seats are subjected to control, sound image or the quality of sound for the listeners in the backseat is not taken into consideration, and adjustment is performed so as to obtain the maximized effect in the front seats. In this case, the listeners in the backseat hear high-volume sound from the rear loudspeakers 23 and 24 placed close to them, and low-volume sound from the front loudspeakers 20 to 22 (the CT loudspeaker, the FR loudspeaker, the FL loudspeaker). As a result, the listeners in the backseat feel that the sound from the front and the sound from behind significantly lack in balance. In order to allow the listeners C and D in the backseat to enjoy surround sound as shown in FIG. 32, it is necessary to correct the imbalance between the levels of the sound reproduced from the front loudspeakers and the sound reproduced from the rear loudspeakers.

Thus, the structure described in the fifth embodiment can correct the above-described imbalance without preventing the sound image localization effect on the listeners A and B in the front seats from being reduced. In the above-described structure, as shown in FIG. 33, sound image localization control whose effect in the backseat is minimized is performed for the front seats. On the other hand, sound image localization control is not performed for the backseat, and only the imbalance between the CT, FR, and FL signals and the SR and SL signals is corrected. Hereinafter, FIG. 33 is described in detail.

The CT signal is subjected to level adjustment by the level adjuster 348, and a time delay is applied to the level adjusted signal by the delay device 335, and the resultant signal is added to the adders 214 and 215. The FR signal is subjected to level adjustment by the level adjuster 349, and a time delay is applied to the level adjusted signal by the delay device 336, and the resultant signal is added to the adder 215. The FL signal is subjected to level adjustment by the level adjuster 350, and a time delay is applied to the level adjusted signal by the delay device 337, and the resultant signal is added to the adder 214. The output signals from the adders 214 and 215 are added to the adders 212 and 213, respectively. As a result, the SR signal to which the CT signal and the FR signal are added is reproduced from the rear loudspeaker 24. Also, the SL signal to which the CT signal and the FL signal are added is reproduced from the rear loudspeaker 23.

As described above, in the fifth embodiment, along with the SR signal and the SL signal, the CT signal, the FR signal, and the FL signal are reproduced from the rear loudspeakers 23 and 24. Thus, it is possible to solve the above-described problem where the listeners in the backseat feel that the sound from the front and the sound from behind significantly lack in balance. Also, it is possible to minimize the undesirable mutual effects between the front seats and the backseat by adjusting the overall level balance by the level adjusters 340 to 347 for the front seats and the level adjusters 348 to 350 for the backseat. As a result, the excellent quality of sound can be obtained in the front seats and the backseat.

Sixth Embodiment

Figure 34:
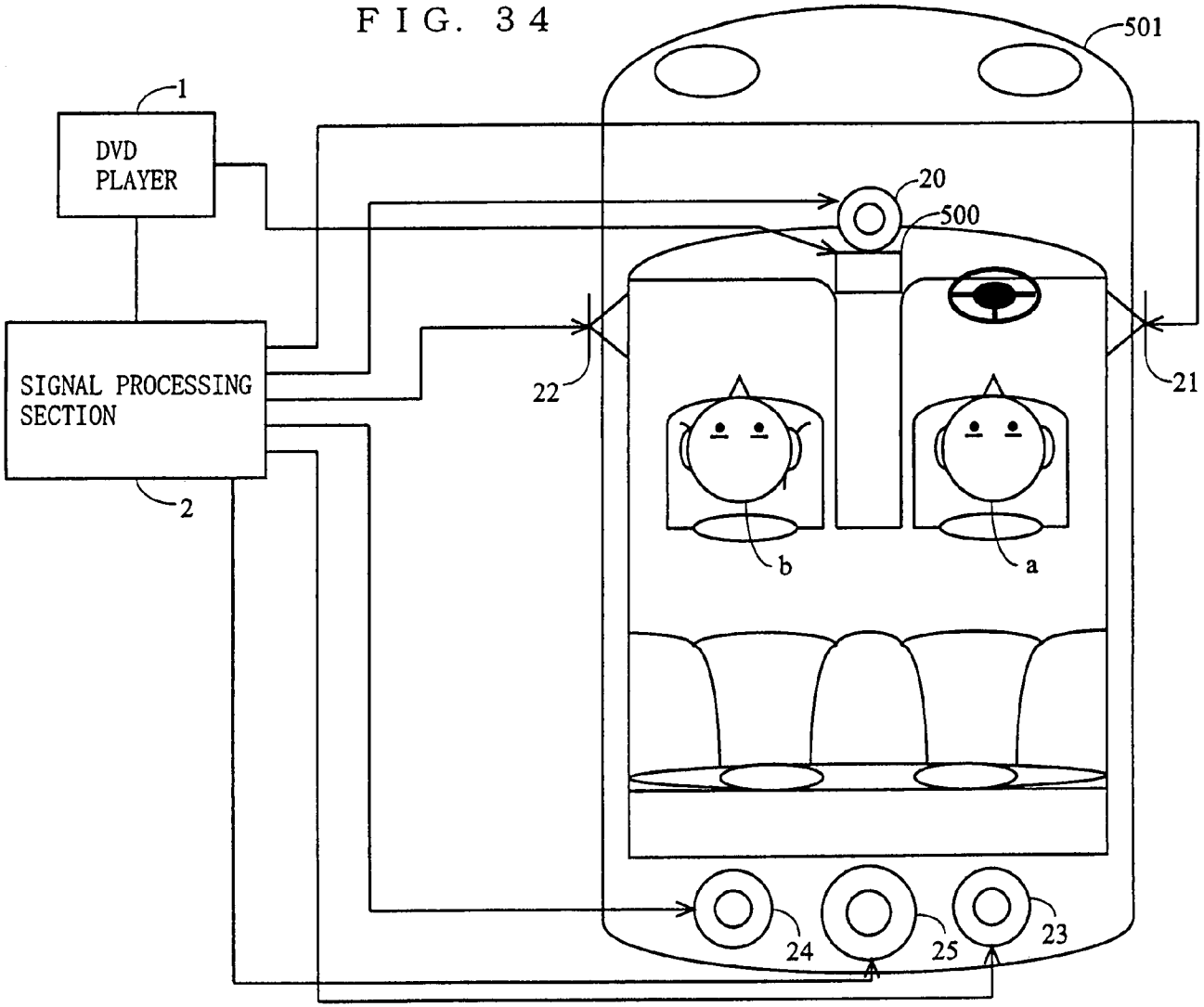
FIG. 34 is an illustration showing an outline of a sound image control system according to a sixth embodiment of the present invention.

Hereinafter, a sound image control system according to a sixth embodiment is described. FIG. 34 is an illustration showing an outline of the sound image control system according to the sixth embodiment. The sound image control system according to the sixth embodiment performs control for the woofer signal (WF signal) included in 5.1 channel audio signals. FIG. 34 shows the case where only the front seats are controlled, and the signal processing section 2 used in this case has the structure as shown in FIG. 35, for example.

Figure 35:
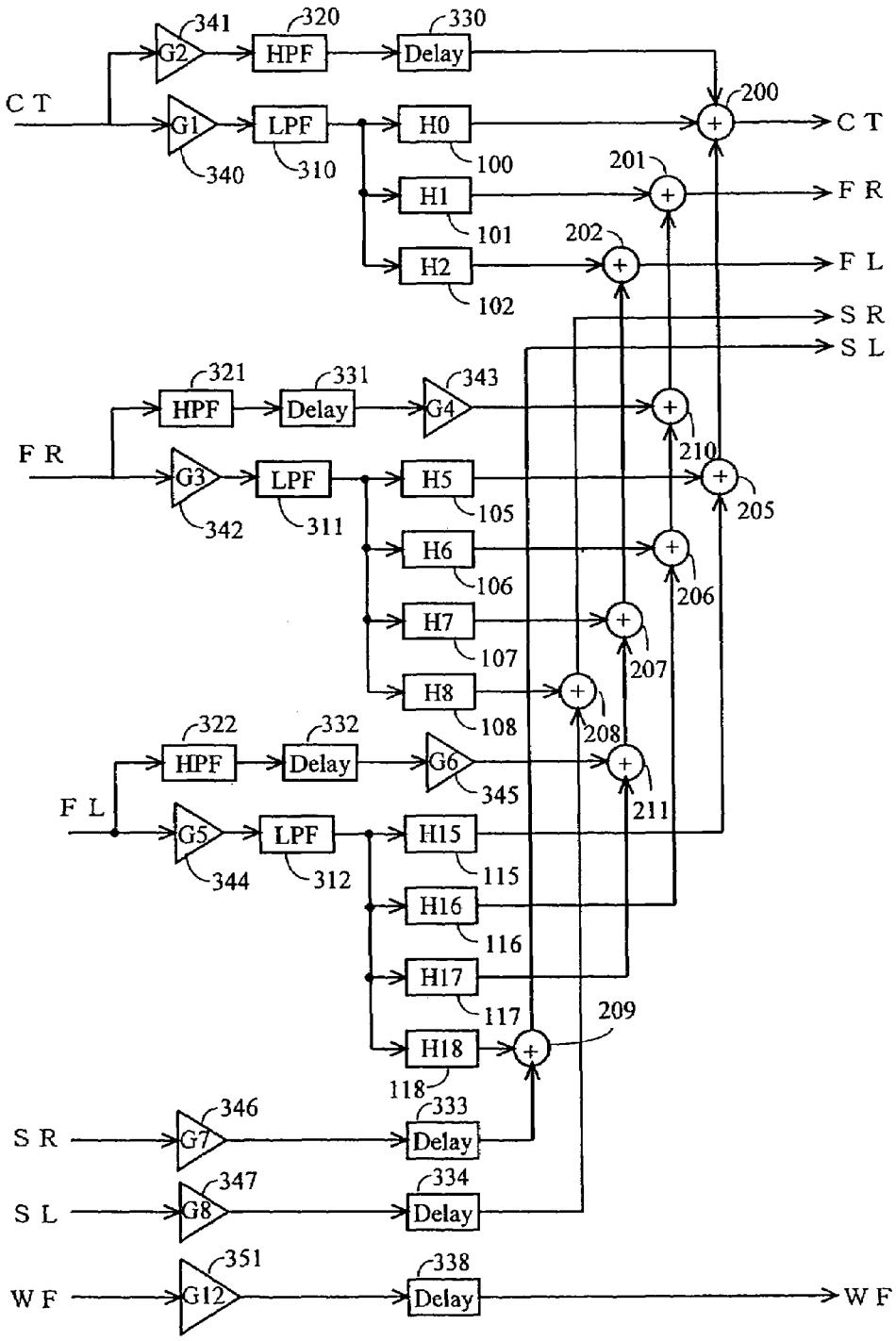
FIG. 35 is an illustration showing the structure of the signal processing section 2 of the sixth embodiment of the present invention.

FIG. 35 is an illustration showing the structure of the signal processing section 2 of the sixth embodiment. Note that the control for the listeners in the front seats is performed in a manner similar to that shown in FIG. 33 except that the WF signal is processed. With respect to the WF signal, adjustment is only performed for the front seats, and the listeners A and B are assumed to receive substantially the same sound pressure of the WF signal because it is reproduced at a very low frequency band (for example, below about 100 Hz). As such, in the structure shown in FIG. 35, the WF signal is subjected to level adjustment and delay adjustment, and reproduced from a WF loudspeaker 25.

The structure shown in FIG. 35 functions appropriately in the case where control is performed for only the listeners in the front seats. However, in the case (see FIG. 36) where the listeners in the backseat are also controlled, the reproduction level of the WF signal as set for the listeners in the front seats is excessively high for those in the backseat. In order to solve the above-described problem, the method described below may be used. Hereinafter, the sound image control system according to the sixth embodiment, in which the listeners in the backseat are taken into consideration, is described.

Figure 36:
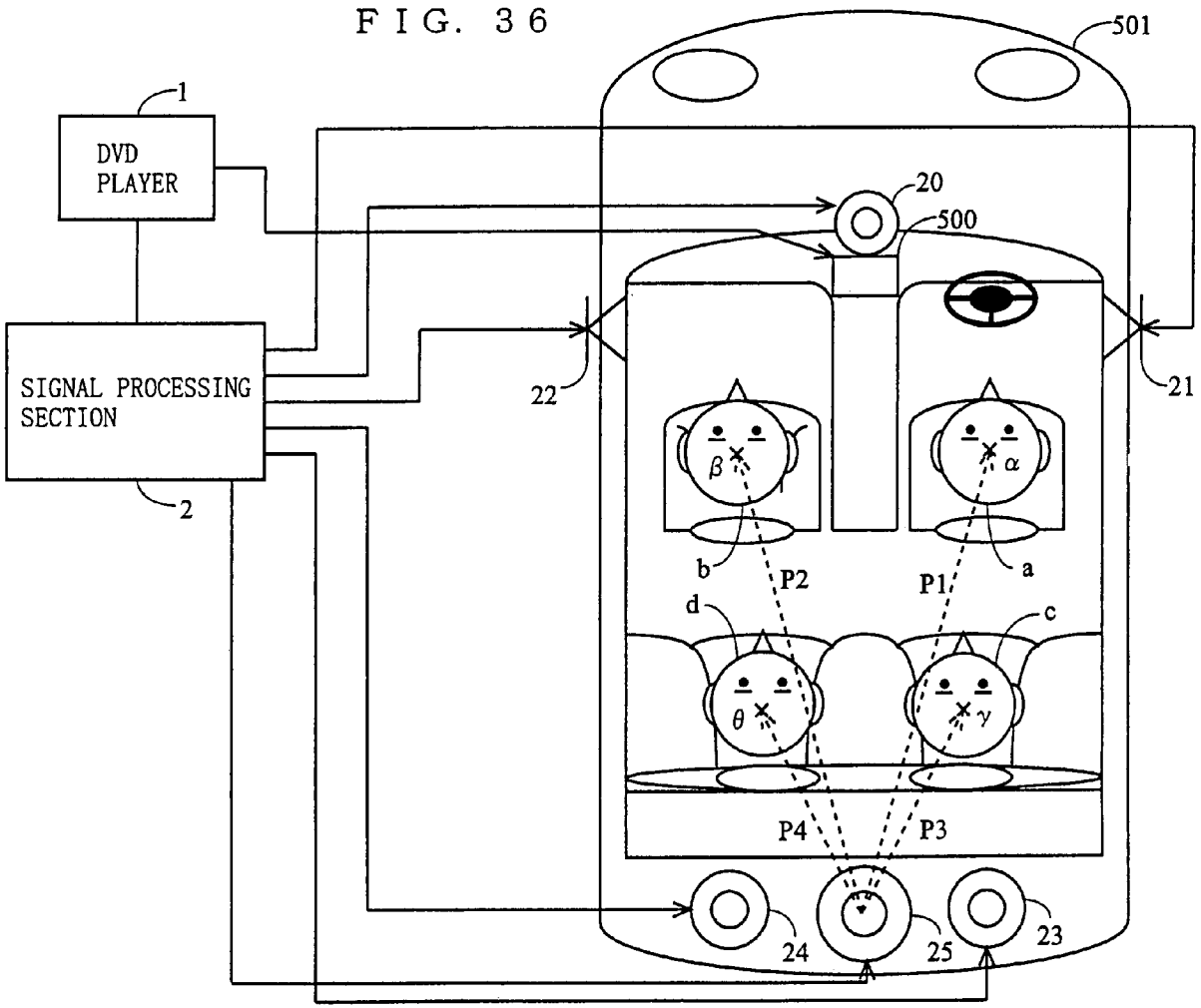
FIG. 36 is an illustration showing an outline of a sound image control system according to the sixth embodiment of the present invention in the case where additional listeners sit in the backseat.

FIG. 36 is an illustration showing an outline of the sound image control system according to the sixth embodiment of the present invention in the case where additional listeners sit in the backseat. As shown in FIG. 36, control is performed using the loudspeakers 21 to 25 (the CT loudspeaker 20 is not used) for reproducing the WF signal at substantially the same sound pressure at four control points, α, β, γ, and θ. Note that the CT loudspeaker 20 is not used here as the control loudspeaker, but it may be used. However, the CT loudspeaker 20 is much less likely to be used, because, in general, it has difficulty reproducing a very low frequency. Also, one point near the listener is set as the control point in place of both ears of the listener because it is considered to be adequate due to a lower frequency wavelength of the target frequency.

Figure 37:
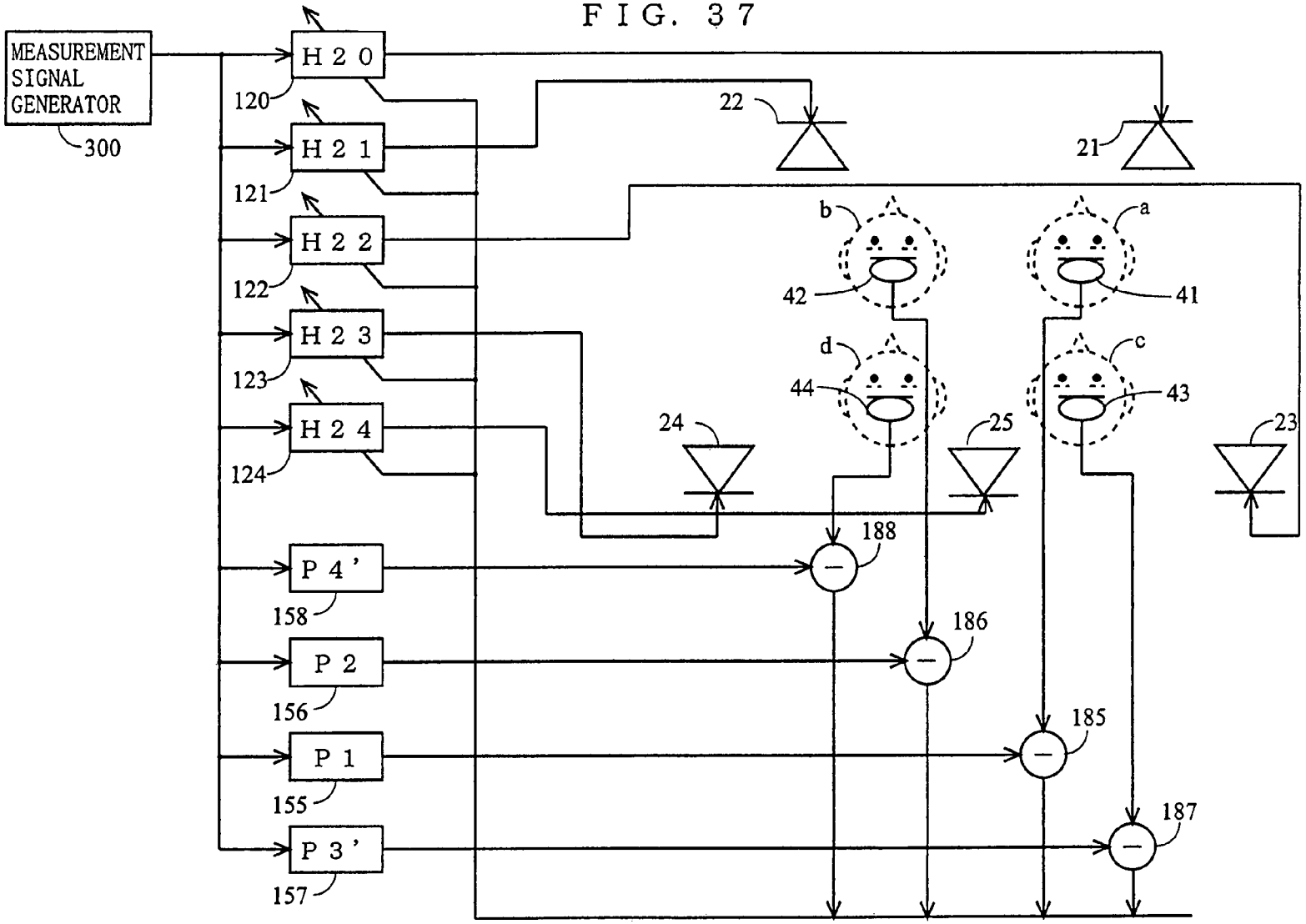
FIG. 37 is an illustration showing a method for obtaining a filter coefficient using the adaptive filter in the sixth embodiment of the present invention.

FIG. 37 is an illustration showing a method for obtaining a filter coefficient using the adaptive filter in the sixth embodiment. In FIG. 37, target characteristics at the control points α, β, γ, and θ (that is, microphones 41 to 44) are set in respective target characteristic filters 155 to 158. Here, the transmission characteristic from the WF loudspeaker 25 to the control point α is assumed to be P1, the transmission characteristic from the WF loudspeaker 25 to the control point β is assumed to be P2, the transmission characteristic from the WF loudspeaker 25 to the control point γ is assumed to be P3, and the transmission characteristic from the WF loudspeaker 25 to the control point θ is assumed to be P4. Also, P1 is set in the target characteristic filter 155, P2 is set in the target characteristic filter 156, P3' is set in the target characteristic filter 157, and P4' is set in the target characteristic filter 158. Here, P3' is a characteristic of P3, whose level is adjusted so as to be substantially the same as those of P1 and P2 and whose time characteristic is substantially the same as that of P3. Also, P4' is a characteristic of P4, whose level is adjusted so as to be substantially the same as those of P1 and P2 and whose time characteristic is substantially the same as that of P4.

In FIG. 37, the sound reproduced from the loudspeakers 21 to 25 are controlled by respective adaptive filters 120 to 124 so as to be equal to the target characteristics of the target characteristic filters 155 to 158 at the respective positions of the microphones 41 to 44. Then, the filter coefficients are determined so as to minimize an error signal from subtracters 185 to 188. The filter coefficients obtained as described above are set in the respective filters 120 to 124 shown in FIG. 37. Note that the levels of the target characteristic filters 157 and 158 may be adjusted to the levels of the target characteristic filters 155 to 156. Alternatively, the levels of the target characteristic filters 155 and 156 may be adjusted.

Figure 38:
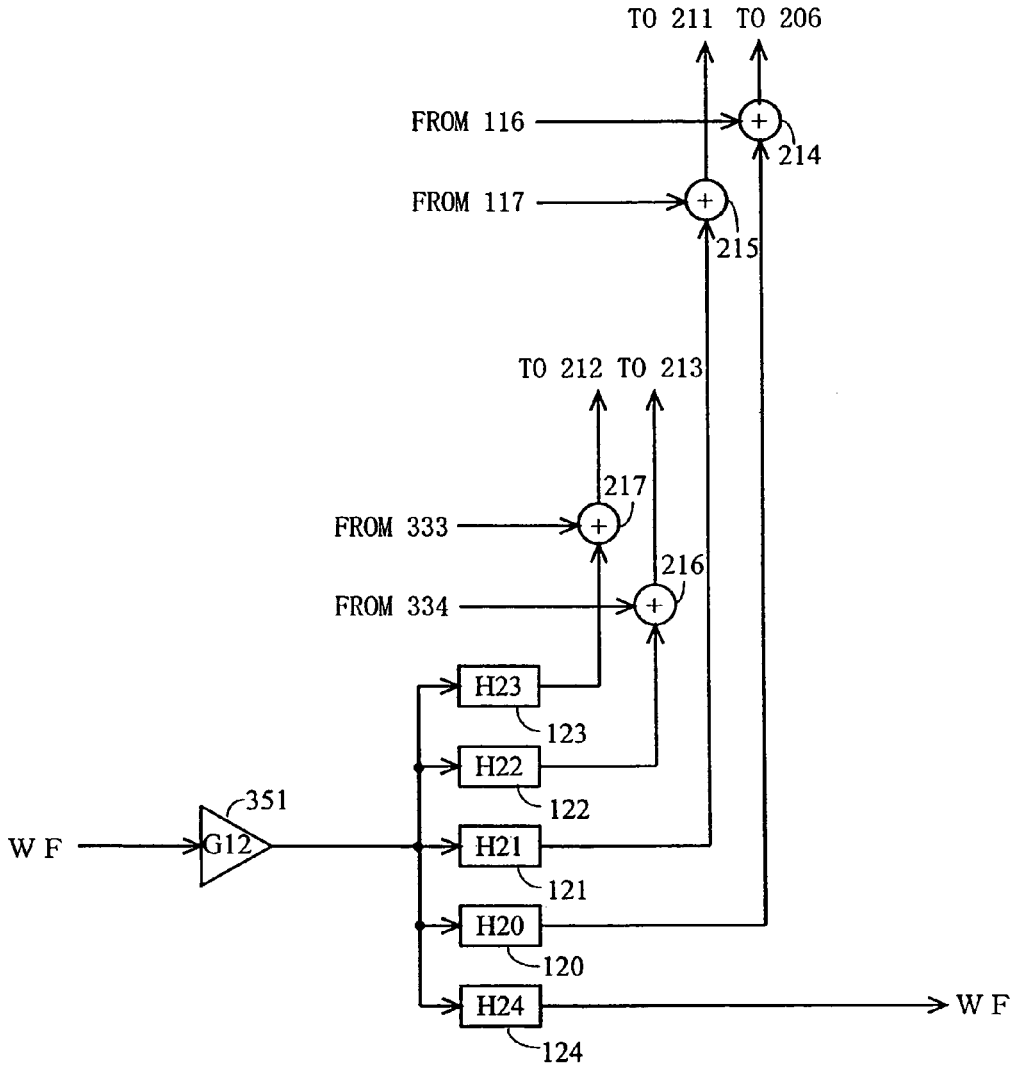
FIG. 38 is an illustration showing the structure of the signal processing section 2 in the case where the additional listeners in the backseat are taken into consideration.

FIG. 38 is an illustration showing the structure of the signal processing section 2 in the case where the additional listeners in the backseat are taken into consideration. As shown in FIG. 38, the WF signal is subjected to an appropriate time delay by a delay device 351, and signal processing is performed for the time delayed signal by the filters 120 to 124. The resultant signal is input into all the loudspeakers except the CT loudspeaker 20, and reproduced therefrom. Thus, the listeners A to D can hear the reproduced sound of the WF signal, which are equal in level. Note that the case where the sound of the WF signal are reproduced at an equal level for the respective listeners A to D has been described. However, the reproduction level can be freely changed by setting a desired target characteristic. Also, in the above-described structure, the four control points are controlled by the five loudspeakers, but the four loudspeakers 21 to 24 may be used as the control loudspeakers in the case where the WF loudspeaker is not provided, for example.

Figure 39:
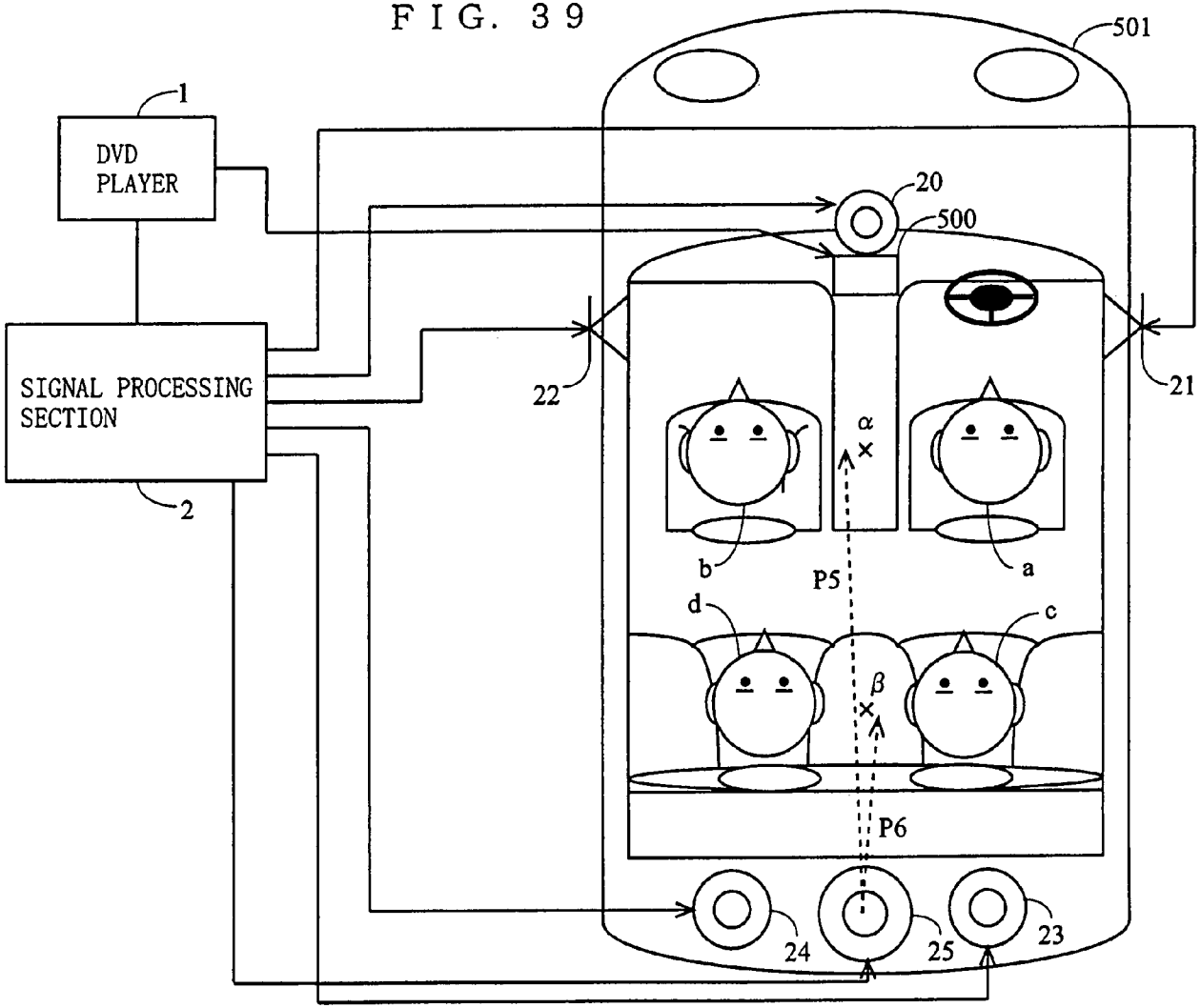
FIG. 39 is an illustration showing an outline of a sound image control system according to the sixth embodiment in the case where the number of control points for a WF signal is reduced to two.
Figure 40:
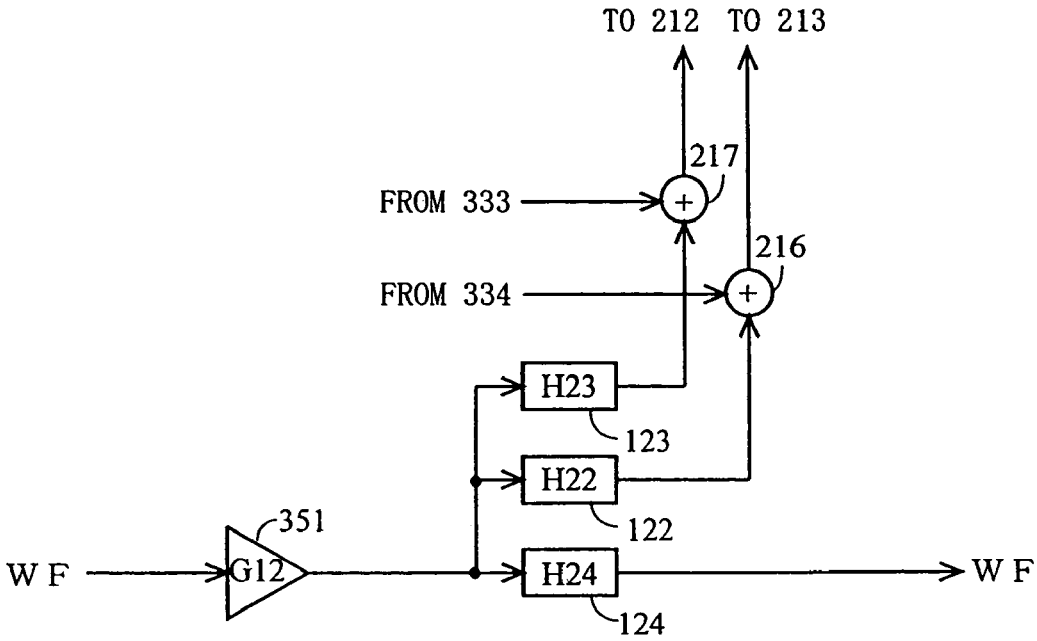
FIG. 40 is an illustration showing another structure of the signal processing section 2 of the sixth embodiment of the present invention.

FIG. 39 is an illustration showing an outline of a sound image control system according to the sixth embodiment in the case where the number of control points for the WF signal is reduced to two. In this case, due to a lower frequency wavelength of the target frequency, control for the WF signal may be performed by controlling two control points (a control point α set in a position between the listeners A and B, and a control point β set in a position between the listeners C and D) by the three loudspeakers (the SR loudspeaker 23, the SL loudspeaker 24, and the WF loudspeaker 25, or the FR loudspeaker 21, the FL loudspeaker, and the WF loudspeaker 25) as shown in FIG. 39. An exemplary structure of the signal processing section 2 used in the above-described case is shown in FIG. 40. Note that, in the above-described structure, the SR loudspeaker 23 and the SL loudspeaker 24 may be used as the control loudspeaker because the number of control points is two, thereby removing the WF loudspeaker 25.

Note that the transmission characteristics (the above-described P1 to P4) from the WF loudspeaker 25 to the four control points have been used in the above descriptions, but a BPF, etc., having an arbitrary frequency characteristic may be used if it can duplicate the time and level relationship among P1 to P4. In this case, the target characteristic filters 155 to 158 can be structured by level adjusters, delay devices, and the BPFs.

As described above, even if there are listeners A and B in the front seats and listeners C and D in the backseat, it is possible to optimally adjust the reproduction level of the WF signal so as to be suitable for each one of the listeners.

Note that, in the sixth embodiment, the method for performing control in a vehicle has been described, but is not limited thereto, and the sound image control system according to the sixth embodiment may be applied to a familiar room such as a soundproof room in a private home, for example, or an audio system.

Seventh Embodiment

Figure 41:
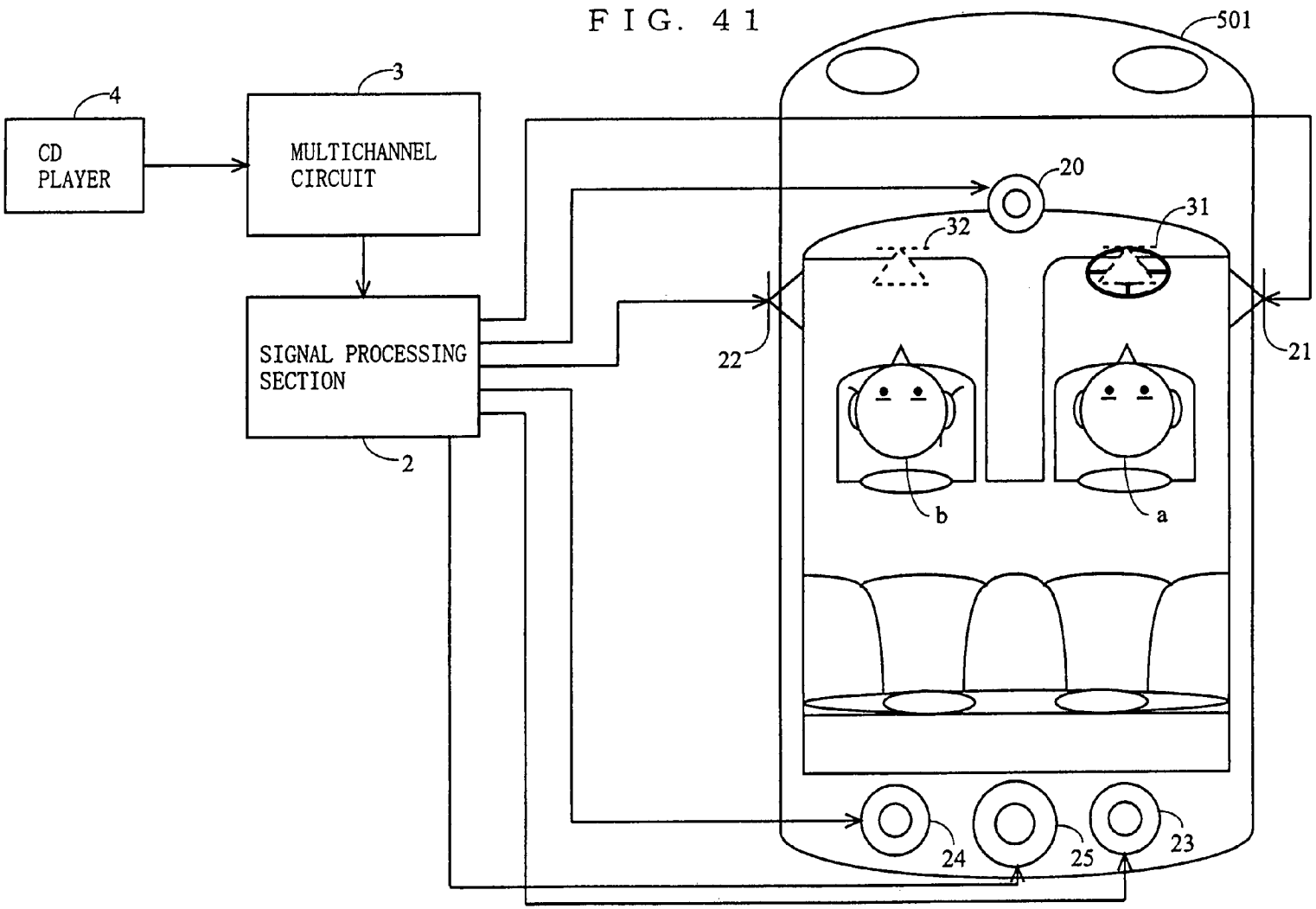
FIG. 41 is an illustration showing the structure of a sound image control system according to a seventh embodiment of the present invention.

Hereinafter, a sound image control system according to a seventh embodiment is described. In the above-described first to sixth embodiments, sound image localization control for the multichannel signals has been described. In the seventh embodiment, sound image localization control for 2 channel signals is described. FIG. 41 is an illustration showing the structure of the sound image control system according to the seventh embodiment. As shown in FIG. 41, the sound image control system according to the seventh embodiment differs from those described in the first to sixth embodiments in that a CD player 4 is used as the sound source in place of the DVD player 1, and a multichannel circuit 3 is additionally included. Note that the structure of the seventh embodiment differs from those described in the first to sixth embodiments in that the six loudspeakers including the WF loudspeaker 25 are used.

Figure 42:
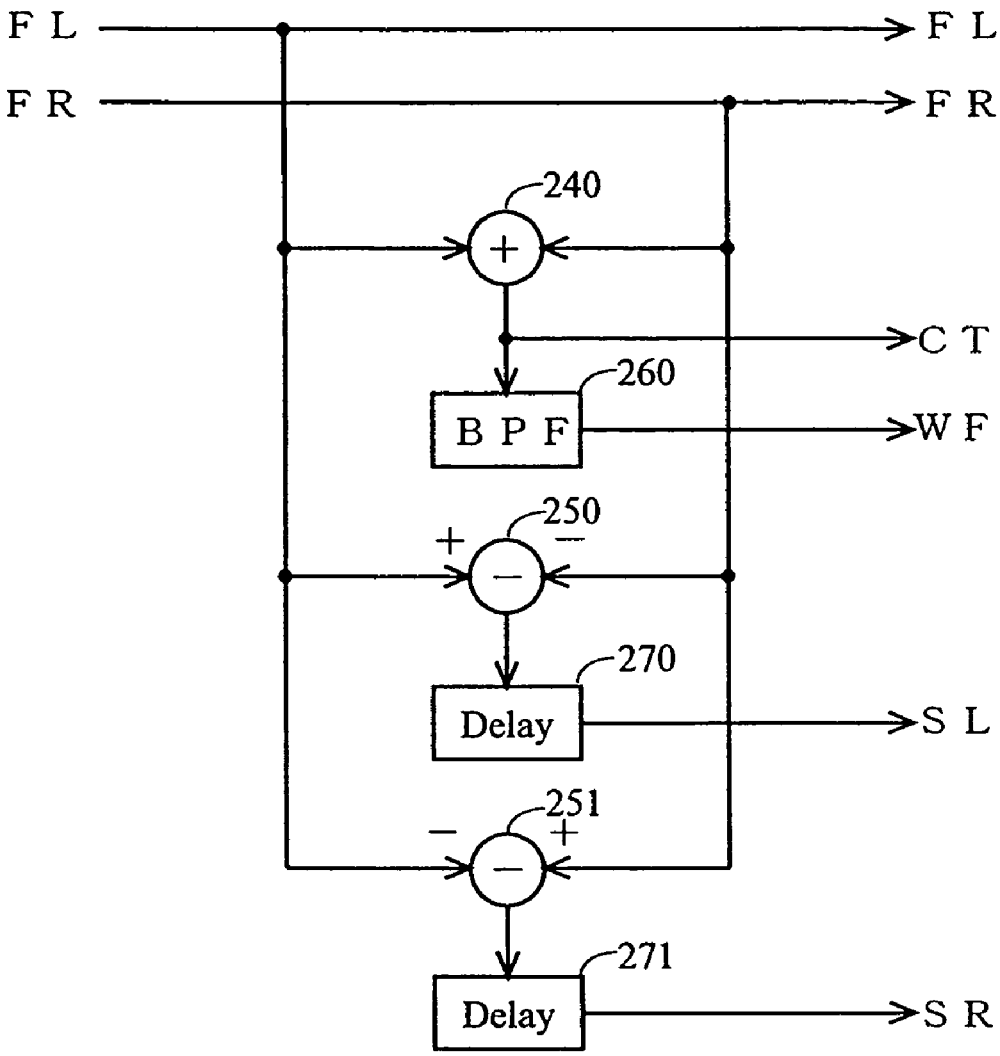
FIG. 42 is an illustration showing the exemplary structure of a multichannel circuit 3.

The 2 channel signals (the FL signal and the FR signal) output from the CD player 4 are converted into 5.1 channel signals by the multichannel circuit 3. FIG. 42 is an illustration showing the exemplary structure of the multichannel circuit 3. The input FL signal and the FR signal are directly converted into the FL signal and the FR signal of the signal processing section 2, respectively. Also, the input FL signal and the FR signal are converted into the CT, SL, and SR signals in such a manner as described below.

In FIG. 41, the FL signal and the FR signal are added by an adder 240, whereby the CT signal is generated. In general, the signal to be localized in a center position, such as vocals, for example, is included in the FL signal and the FR signal at the same phase. Thus, addition allows the level of the same phase components to be emphasized. Also, the generated CT signal is limited in a range of a band of the WF signal by a band pass filter 260 (hereinafter, referred to as BPF), whereby the WF signal is generated. As is the case with the signal to be localized in a center position, in general, the lower frequency components are included in the FL signal and the FR signal at the same phase. Thus, the WF signal is generated by the above-described processing.

On the other hand, the FR signal is subtracted from the FL signal by a subtracter 250, thereby extracting the difference between the FL signal and the FR signal. That is, the components uniquely included in the respective FL and FR signals are extracted. In other words, the same phase components to be localized in a center position are reduced. As a result, the SL signal is generated. Similarly, the FL signal is subtracted from the FR signal by a subtracter 251, whereby the SR signal is generated. Then, the generated SL and SR signals are subjected to an appropriate time delay by the respective delay devices 270 and 271, thereby enhancing the surround effect. For example, two different types of delay time, which are relatively longer than those applied to the FL signal, FR signal, and the CT signal, are set in the delay devices 270 and 271 for the respective SL and SR signals. Furthermore, additional setting may be made so as to simulate the reflected sound. As described above, in the seventh embodiment, the 5.1 channel signals are generated from the 2 channel signals. However, the generation method is not limited to that shown in FIG. 42, and a well-known method such as Dolby Surround Pro-Logic (TM) may be used.

Figure 43:
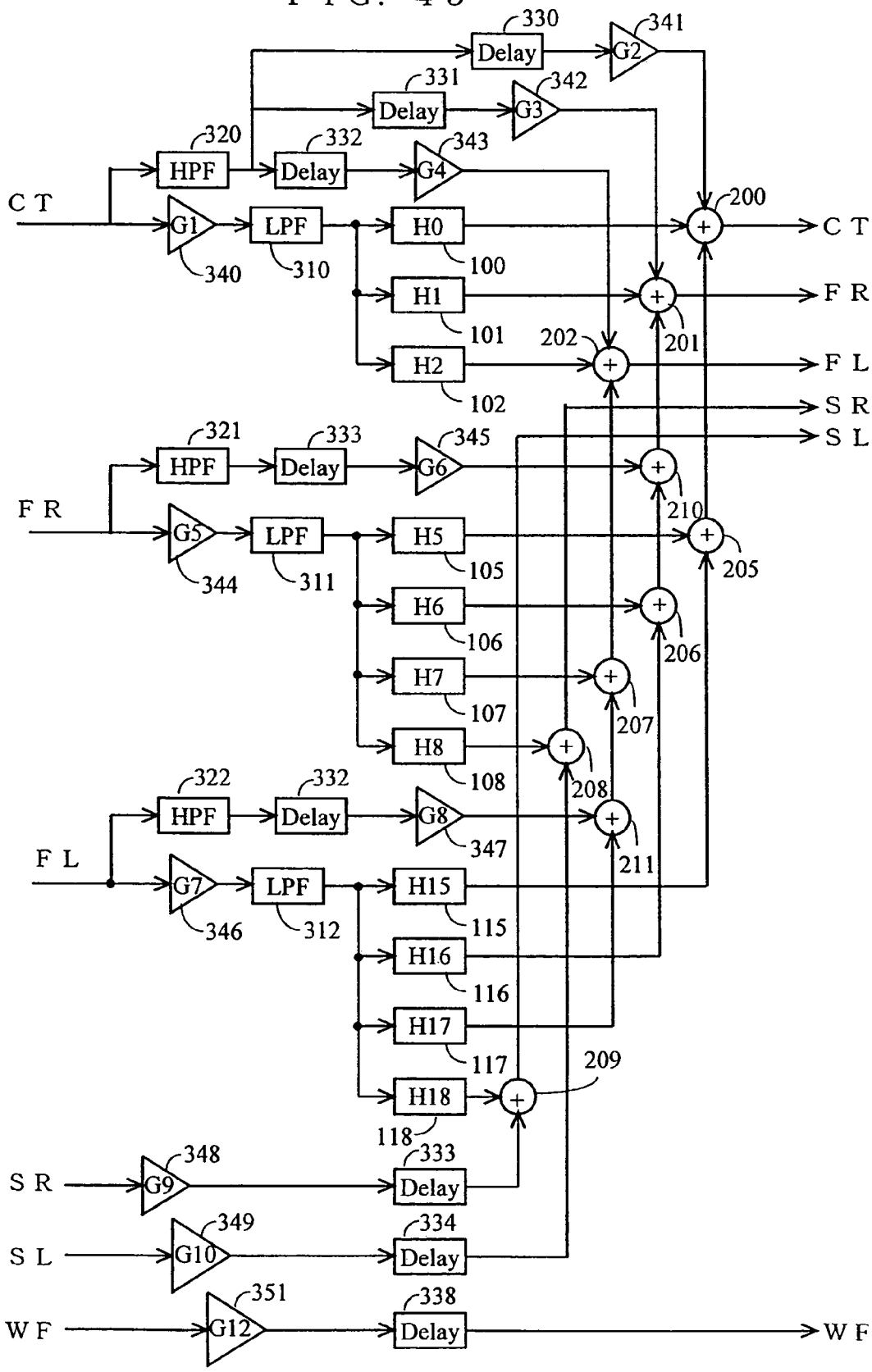
FIG. 43 is an illustration showing the exemplary structure of the signal processing section 2 of the seventh embodiment of the present invention.
Figure 44A:
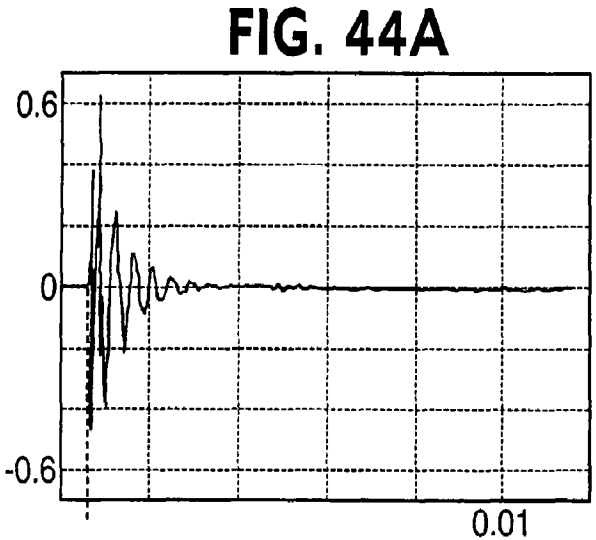
FIG. 44A is a line graph showing a time characteristic (impulse response) of a transmission characteristic GR in an eighth embodiment of the present invention.
Figure 44C:
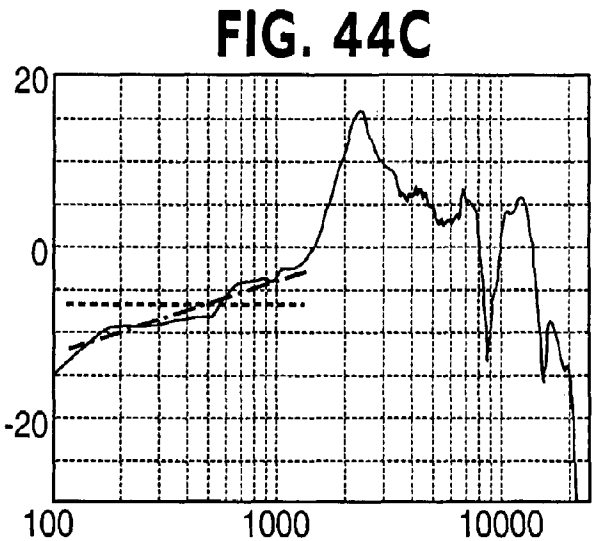
FIG. 44C is a line graph showing an amplitude frequency characteristic (transfer function) of the transmission characteristic GR in the eighth embodiment of the present invention.
Figure 44B:
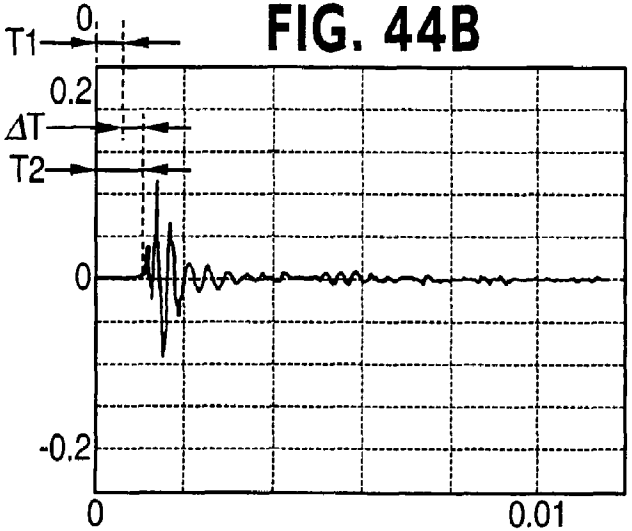
FIG. 44B is a line graph showing a time characteristic (impulse response) of a transmission characteristic GL in the eighth embodiment of the present invention.
Figure 44D:
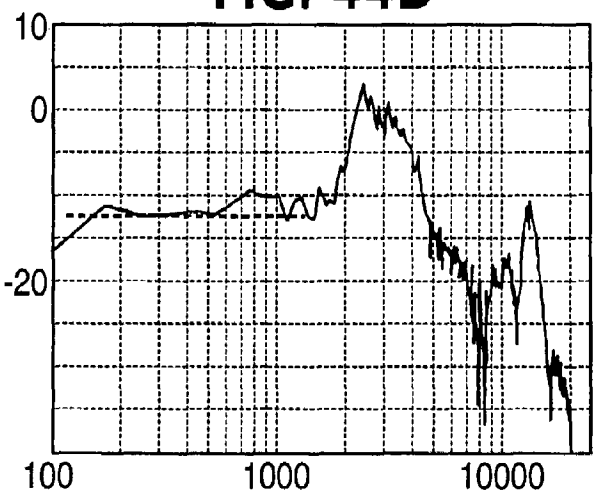
FIG. 44D is a line graph showing an amplitude frequency characteristic (transfer function) of the transmission characteristic GL in the eighth embodiment of the present invention.
Figure 45A:
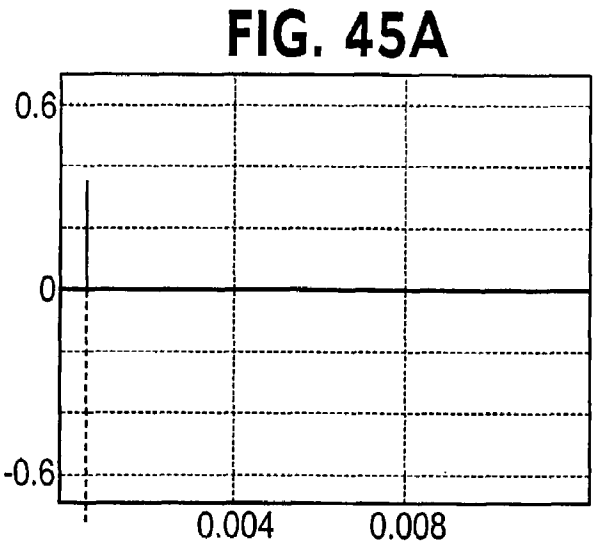
FIG. 45A is a line graph showing a time characteristic (impulse response) of the transmission characteristic GR in the eighth embodiment of the present invention.
Figure 45C:
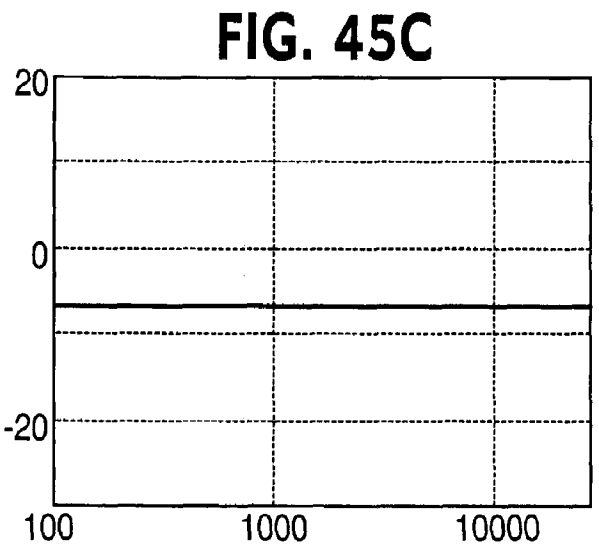
FIG. 45C is a line graph showing an amplitude frequency characteristic (transfer function) of the transmission characteristic GR in the eighth embodiment of the present invention.
Figure 45B:
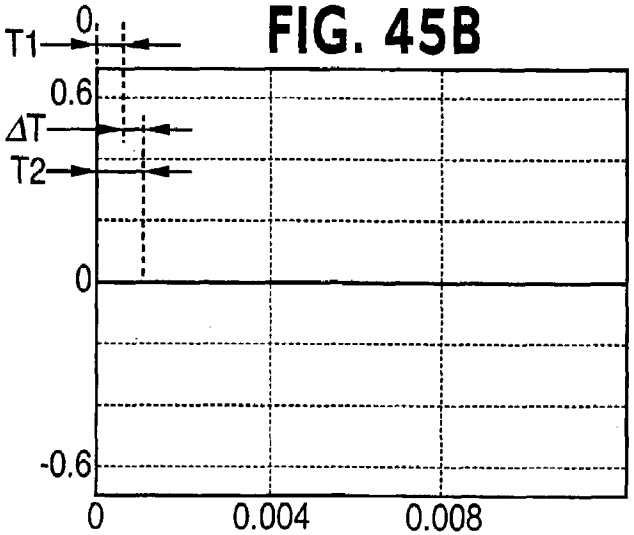
FIG. 45B is a line graph showing a time characteristic (impulse response) of the transmission characteristic GL in the eighth embodiment of the present invention.
Figure 45D:
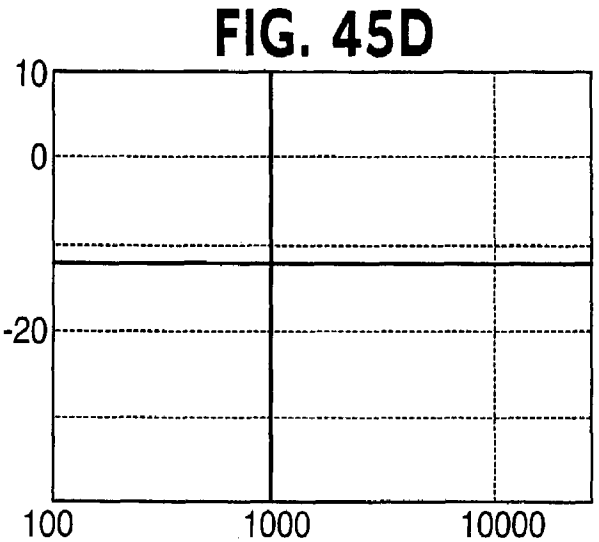
FIG. 45D is a line graph showing an amplitude frequency characteristic (transfer function) of the transmission characteristic GL in the eighth embodiment of the present invention.

The 5.1 channel signals generated as described above are subjected to sound image localization control by the signal processing section 2, as is the case with the first to sixth embodiments. FIG. 43 is an illustration showing the exemplary structure of the signal processing section 2 of the seventh embodiment. The signal processing section 2 operates in a manner similar to that shown in, for example, FIG. 21 or FIG. 35. Thus, the detailed descriptions of the operation thereof are omitted.

As such, it is possible to enhance the realism by converting the 2 channel signals output from the sound source into the 5.1 channel signals concurrently with localizing a sound image in a position of the target sound source. Especially, it is possible to localize a sound image of the CT signal at the respective fronts of the listeners A and B, which has been impossible in a conventional 2 channel signal reproduction. The above-described structure allows novel and unprecedented services using the 2 channel sound source to be provided.

Eighth Embodiment

Hereinafter, a sound image control system according to an eighth embodiment is described. In the eighth embodiment, a target characteristic is set in a manner different from those described in the other embodiments. FIGS. 44A to 44D are line graphs showing the same target characteristics as shown in FIG. 4. In the case where sound image localization control by filter signal processing is performed for the lower frequency components of a signal, it is possible to obtain an approximation of a substantially flat characteristic as shown in dotted line in FIGS. 44C and 44D. In the eighth embodiment, the time (T1, T2) and level approximated to delay characteristics shown in FIG. 45 are set in the target characteristic filters 151 to 154 shown in FIG. 8 as the target characteristics. In FIG. 45, all the components other than the lower frequency components have flat characteristics, but an LPF characteristic for limiting a frequency in a target range may be multiplied. Also, as shown in dashed line of FIG. 44C, a simple approximated characteristic closer to the target characteristic may be used in place of a flat characteristic.

Figures 46A, 46B, 46C, 46D, 46E, 46F:
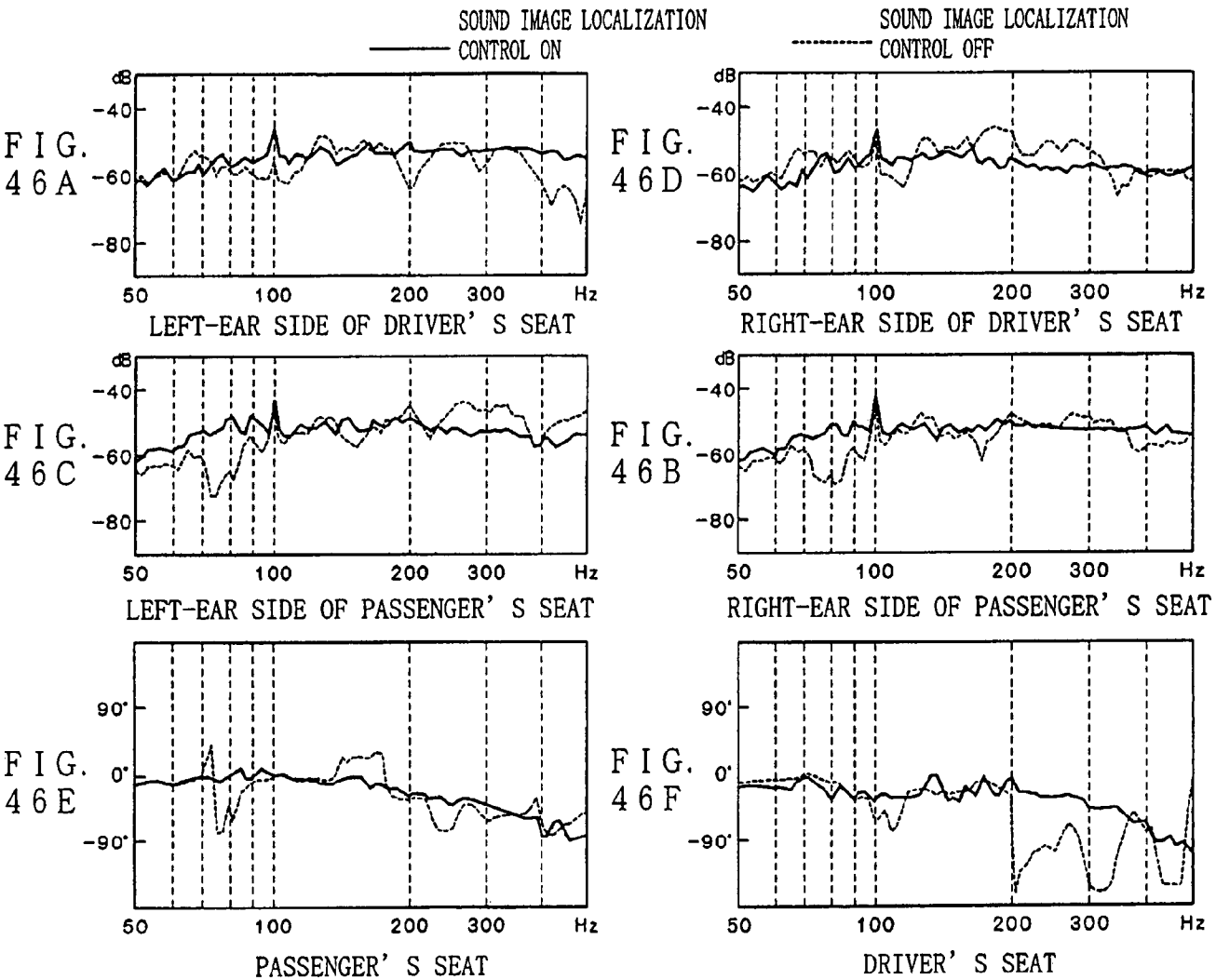
FIG. 46A is a line graph showing a sound image control effect (amplitude characteristic) on the left-ear side of a driver's seat in the eighth embodiment of the present invention.
FIG. 46B is a line graph showing a sound image control effect (amplitude characteristic) on the right-ear side of the driver's seat in the eighth embodiment of the present invention.
FIG. 46C is a line graph showing a sound image control effect (amplitude characteristic) on the left-ear side of a passenger's seat in the eighth embodiment of the present invention.
FIG. 46D is a line graph showing a sound image control effect (amplitude characteristic) on the right-ear side of the passenger's seat in the eighth embodiment of the present invention.
FIG. 46E is a line graph showing a sound image control effect (a phase characteristic indicating the difference between the right and left ears) in the passenger's seat in the eighth embodiment of the present invention.
FIG. 46F is a line graph showing a sound image control effect (a phase characteristic indicating the difference between the right and left ears) in the driver's seat in the eighth embodiment of the present invention.
Figure 47:
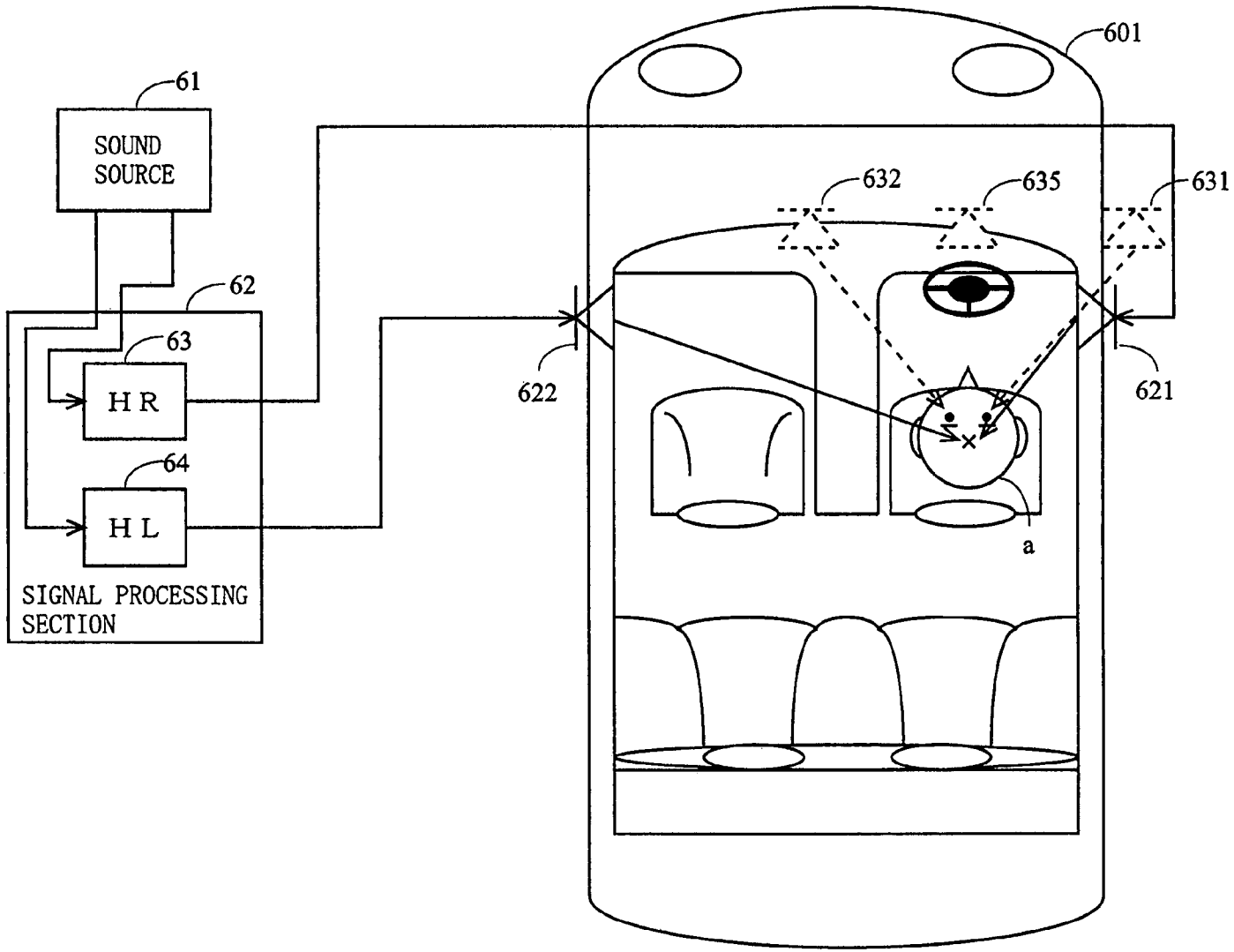
F I G. 4 7 PRIOR ART
FIG. 47 is an illustration showing the entire structure of a conventional sound image control system.

FIGS. 46A to 46F are line graphs showing a sound image control effect in the case where the target characteristics shown in FIG. 45 are set. In FIG. 46, an exemplary case where a sound image of the CT signal is localized in a position of the display is shown. FIGS. 46A and 46B show amplitude frequency characteristics in a driver's seat. FIGS. 46C and 46D show amplitude frequency characteristics in a passenger's seat. FIG. 46E shows a phase characteristic indicting the difference between the right and left ears in the passenger's seat. FIG. 46F shows a phase characteristic indicating the difference between the right and left ears in the driver's seat. Note that, in FIG. 46, the dotted line indicates a case where control is OFF, and the solid line indicates a case where control is ON.

As shown in FIG. 46, the amplitude frequency characteristic is flattened in the driver's seat and the passenger's seat. As a result, the quality of sound is improved by preventing unevenness peculiar to the amplitude characteristic. Also, the phase characteristic is improved and changed to a characteristic close to a straight line. Especially, as shown in FIG. 46F, a portion of a reversed phase in the 200 to 300 Hz range is improved, thereby reducing a sense of discomfort resulting from a reversed phase or unstable localization. Note that the right and left ears of the listeners A and B have different target characteristics, respectively. Specifically, the phase characteristic indicating the difference between the right and left ear shown in FIG. 46F is measured based on the left ear of the listener A in the driver's seat, and the phase characteristic indicting the difference between the right and left ear shown in FIG. 46E is measured based on the right ear of the listener B in the passenger's seat. Thus, the phase characteristics are significantly shifted in a higher frequency range. As described above, it is possible to obtain an effect of improving the quality of sound as well as the sound image localization effect by replacing the target characteristic with a simple time delay or level adjustment.

Note that, in the above descriptions, the case where a target characteristic approximated to the actual transmission characteristic has been described, but it is possible to set the amplitude frequency characteristic arbitrarily, to some extent, after obtaining approximated phase characteristic (time characteristic). Thus, it is possible to adjust the quality of sound in order to produce clear and sharp sounds or deep bass sounds, for example, concurrently with performing sound image control.

As described above, according to the sound image control system of the present invention, it is possible to concurrently perform sound image control for the four points in the vicinity of both ears of both two listeners. Furthermore, the loudspeaker is not placed in a position diagonally or diametrically opposite to the target sound source positions, whereby it is possible to simplify the circuit structure and reduce the amount of calculation without impairing the sound image control effect.

Also, an input signal is divided into lower frequency components and higher frequency components. Sound image localization control is performed for the lower frequency components so as to be equal to the target characteristic at the control point, but sound image localization control is not performed for the higher frequency components. Thus, it is possible to reduce the amount of calculation required for signal processing.

Furthermore, signal processing is performed for the woofer signal by a plurality of loudspeakers so that sound pressures at a plurality of control points are substantially equal to each other, whereby it is possible to equalize the reproduction level of the woofer signal at a plurality of points. Also, it is possible to improve the quality of sound and provide an arbitrary characteristic by approximating the target characteristic from the target sound source to the control point with respect to a delay or a level.

Still further, the signal processing section performs sound image control for the front two seats in the vehicle, and reproduces all the input signals from the sound source for the backseat from the rear loudspeakers without performing sound image control, whereby it is possible to obtain the improved balance among the levels of the channel signals and improve clarity, etc., of sound without impairing the sound image control effect in the front seats.

While the invention has been described in detail, the foregoing description is in all aspects illustrative and not restrictive. It is understood that numerous other modifications and variations can be devised without departing from the scope of the invention.

What is claimed is:

1. A sound image control system for controlling sound image localization positions by reproducing an audio signal from a plurality of actual loudspeakers, said system comprising:

at least four actual loudspeakers for reproducing the audio signal; and a signal processing section for setting four points corresponding to positions of both ears of first and second listeners as control points, and performing signal processing for the audio signal as input into each of said at least four actual loudspeakers so as to produce first and second target sound source positions, wherein the first and second target sound source positions, which are both virtual sound source positions and are produced individually for each of the first and second listeners, are sound image localization positions as perceived simultaneously and individually by the first and second listeners, respectively, such that the first target sound source position is in a direction relative to the first listener that extends from the first listener toward the second listener and is inclined at a predetermined azimuth angle, and the second target sound source position is in a direction relative to the second listener that extends from the first listener toward the second listener and is inclined at the predetermined azimuth angle, wherein said signal processing section has control characteristics which simultaneously give predetermined sound image control effect to the first and second listeners, and inputs control signals, a total number of the control signals being the same as a total number of the speakers, to the speakers to which the control signals respectively correspond, so as to reproduce sounds in a time-continuous manner, wherein said signal processing section is operable to control the first and second target sound source positions so that a distance from the second listener to the second target sound source position is shorter than a distance from the first listener to the first target sound source position, and wherein the control characteristics of said signal processing section are a solution of equations in each of which, at each of the four control points, combined characteristics obtained by combining the control signals of said processing section which have reached each of the four control points from said at least four actual loudspeakers to which the control signals respectively correspond are equal to transmission characteristics from each of the first and second target sound source positions to each of the four control points corresponding thereto.

2. The sound image control system according to claim 1, wherein, when the first and second virtual target sound source positions are assumed to be set at an angle of θ degrees with respect to a forward direction of the respective listeners, a distance between the first and second listeners is assumed to be X, a velocity is assumed to be P, transmission times from the second virtual target sound source position corresponding to the second listener to the both ears of the second listener are assumed to be T1 and T2, transmission times from the first virtual target sound source position corresponding to the first listener to the both ears of the first listener are assumed to be T3 and T4, T1, T2, T3, and T4 are assumed to be set in order of increasing distance from the respective target sound source positions, the two target sound source positions are set so as to satisfy a following condition, $T1<T2\leqq T3\ (=T2+X\sin\theta/P)<T4$.

3. The sound image control system according to claim 1, wherein said signal processing section is operable to stop inputting the audio signal into an actual loudspeaker, among said at least four actual loudspeakers, placed in a position diagonally opposite to the first and second target sound source positions with respect to a center position between the first and second listeners.

4. The sound image control system according to claim 1, wherein, when the two target sound source positions are set in front of the respective listeners, said signal processing section is operable to stop inputting the audio signal into an actual loudspeaker, among said at least four actual loudspeakers, placed in a rear position of the respective listeners.

5. The sound image control system according to claim 1, wherein said signal processing section includes:

a frequency dividing section for dividing the audio signal into lower frequency components and higher frequency components relative to a predetermined frequency;

a lower frequency processing section for performing signal processing for the lower frequency components of the audio signal to be input into each one of said at least four actual loudspeakers and inputting the processed signal thereinto; and a higher frequency processing section for inputting the higher frequency components of the audio signal into an actual loudspeaker closest to a center position between the first and second target sound source positions so that the processed signal is in phase with the signal input into said at least four actual loudspeakers by said lower frequency processing section.

6. The sound image control system according to claim 5, wherein:

said at least four actual loudspeakers include a tweeter placed in front of a center position between the first and second listeners; and when the first and second target sound source positions are set in front of the respective listeners, said higher frequency processing section is operable to input the higher frequency components of the audio signal into said tweeter.

7. The sound image control system according to claim 1, wherein:

said at least four actual loudspeakers are placed in a vehicle, and at least one actual loudspeaker among said at least four actual loudspeakers is placed on a backseat side;

the first and second listeners are in the front seats of the vehicle; and when signal processing is performed for an audio signal having a plurality of channels, said signal processing section placed in the vehicle is operable to input all channel audio signals into the at least one actual loudspeaker placed on the backseat side without performing signal processing.

* * * * *

UNITED STATES PATENT AND TRADEMARK OFFICE

CERTIFICATE OF CORRECTION

PATENT NO. : 7,386,139 B2
APPLICATION NO. : 10/454541
DATED : June 10, 2008
INVENTOR(S) : Hiroyuki Hashimoto et al.

It is certified that error appears in the above-identified patent and that said Letters Patent is hereby corrected as shown below:

ON THE FRONT PAGE

In section (57), line 16, "T1=T2≦T3<T4" should read --T1<T2≦T3<T4--.

Signed and Sealed this

Seventh Day of October, 2008

JON W. DUDAS
*Director of the United States Patent and Trademark Office*